US007487964B2

(12) United States Patent
Suzuki et al.

(10) Patent No.: US 7,487,964 B2
(45) Date of Patent: Feb. 10, 2009

(54) SHEET FINISHER FOR AN IMAGE FORMING APPARATUS

(75) Inventors: Nobuyoshi Suzuki, Tokyo (JP); Kenji Yamada, Tokyo (JP); Masahiro Tamura, Tokyo (JP); Hiromoto Saitoh, Kanagawa (JP); Shuuya Nagasako, Kanagawa (JP); Naohiro Kikkawa, Tokyo (JP); Junichi Iida, Kanagawa (JP); Junichi Tokita, Kanagawa (JP); Shingo Matsushita, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 470 days.

(21) Appl. No.: 11/254,868

(22) Filed: Oct. 21, 2005

(65) Prior Publication Data

US 2006/0180999 A1 Aug. 17, 2006

(30) Foreign Application Priority Data

Oct. 21, 2004 (JP) ..... 2004-307045
Jan. 18, 2005 (JP) ..... 2005-010471

(51) Int. Cl.
*B65H 43/00* (2006.01)

(52) U.S. Cl. ..... 271/176; 271/207; 271/213; 271/220

(58) Field of Classification Search ..... 271/176, 271/207, 213, 215, 220
See application file for complete search history.

(56) References Cited

U.S. PATENT DOCUMENTS 2,579,541 A * 12/1951 Bobst ..... 271/215
3,968,364 A * 7/1976 Miller ..... 250/237 R
5,692,411 A 12/1997 Tamura
6,145,825 A 11/2000 Kunihiro et al.
6,199,853 B1 3/2001 Andoh et al.
6,231,045 B1 5/2001 Yamada et al.
6,264,191 B1 7/2001 Suzuki et al.
6,296,247 B1 10/2001 Tamura et al.
6,322,070 B2 11/2001 Yamada et al.
6,343,785 B1 2/2002 Yamada et al.
6,394,448 B2 5/2002 Suzuki et al.
6,416,052 B2 7/2002 Yamada et al.
6,494,449 B2 12/2002 Tamura et al.
6,494,453 B1 12/2002 Yamada et al.

(Continued)

FOREIGN PATENT DOCUMENTS

JP 10-198104 7/1998

(Continued)

OTHER PUBLICATIONS

U.S. Appl. No. 11/682,238, filed Mar. 5, 2007, Iida et al.

*Primary Examiner*—David H Bollinger
(74) *Attorney, Agent, or Firm*—Oblon, Spivak, McClelland, Maier & Neustadt, P.C.

(57) ABSTRACT

A sheet finishing apparatus for an image forming apparatus includes a discharging member configured to discharge recording media. A tray is configured to receive the discharged recording media. A rotatable moving member is configured to contact the discharged recording media such that an angular position of the rotatable member changes in response to a number of the recording media on the tray. A detecting member is configured to detect a movement of the moving member. A controller is configured to control an output of the recording media to the tray based on an output of the detecting member.

19 Claims, 35 Drawing Sheets

U.S. PATENT DOCUMENTS

| | | | | |
|---|---|---|---|---|
| 6,527,269 | B2 | 3/2003 | Yamada et al. | |
| 6,549,734 | B2 | 4/2003 | Yamada et al. | |
| 6,631,896 | B2 | 10/2003 | Yamada et al. | |
| 6,698,744 | B2 | 3/2004 | Yamada et al. | |
| 6,783,124 | B2 | 8/2004 | Tamura et al. | |
| 6,832,759 | B2 | 12/2004 | Nagasako et al. | |
| 6,871,851 | B2 | 3/2005 | Tamura et al. | |
| 6,889,974 | B2 | 5/2005 | Tamura et al. | |
| 6,905,118 | B2 | 6/2005 | Yamada et al. | |
| 6,921,069 | B2 | 7/2005 | Suzuki et al. | |
| 2001/0050459 | A1* | 12/2001 | Tamura et al. | 271/217 |
| 2002/0135119 | A1 | 9/2002 | Suzuki et al. | |
| 2003/0006543 | A1 | 1/2003 | Tamura et al. | |
| 2003/0057641 | A1 | 3/2003 | Yamada et al. | |
| 2003/0160376 | A1 | 8/2003 | Yamada et al. | |
| 2003/0215275 | A1 | 11/2003 | Tamura et al. | |
| 2003/0219295 | A1 | 11/2003 | Saitoh et al. | |
| 2003/0234487 | A1 | 12/2003 | Tamura et al. | |
| 2004/0051238 | A1 | 3/2004 | Yamada et al. | |
| 2004/0104525 | A1 | 6/2004 | Suzuki et al. | |
| 2004/0254054 | A1 | 12/2004 | Suzuki et al. | |
| 2004/0256783 | A1 | 12/2004 | Iida et al. | |
| 2005/0061131 | A1 | 3/2005 | Tamura et al. | |
| 2005/0067764 | A1 | 3/2005 | Tamura et al. | |
| 2005/0067777 | A1 | 3/2005 | Iida et al. | |
| 2005/0082747 | A1 | 4/2005 | Tamura et al. | |
| 2006/0180999 | A1 | 8/2006 | Suzuki et al. | |

FOREIGN PATENT DOCUMENTS

| | | |
|---|---|---|
| JP | 10-279163 | 10/1998 |
| JP | 11-193162 | 7/1999 |
| JP | 2002-104709 | 4/2002 |
| JP | 2002-104712 | 4/2002 |
| JP | 2002-137860 | 5/2002 |
| JP | 2003-073010 | 3/2003 |

* cited by examiner

| FIG. 17A |
| --- |
| FIG. 17B |

| | SENSOR 505a | SENSOR 505b |
|---|---|---|
| ARM POSITION ① | OFF | ON |
| ARM POSITION ② | OFF | OFF |
| ARM POSITION ③ | ON | OFF |
| ARM POSITION ④ | ON | ON |

| FIG. 34A |
|---|
| FIG. 34B |
| FIG. 34C |

SHEET FINISHER FOR AN IMAGE FORMING APPARATUS

BACKGROUND OF THE INVENTION

1. Field of the Invention

The present invention relates to a sheet finisher for an image forming apparatus, and more specifically to the sheet finisher that detects movement of an arm member contacting recording media output to a tray of the sheet finisher.

2. Discussion of the Related Art

Conventionally, a stack of recording media folded in a predetermined manner is discharged to a tray or sheet loading system of a sheet finishing apparatus. For example, a typical sheet loading system includes a discharge roller that discharges a center-folded and stapled stack of sheets (sometimes referred to as a sheet stack). The sheet loading system includes a pressure arm that presses a surface of the sheet stack received on the tray, and a detecting member that detects the presence and absence of the sheet stack on the tray. The sheet loading system is generally sized to receive several dozen sheets.

In order to prevent the output of a larger number of sheet stacks than can be received by the tray, it is known to control the output to the sheet stacks to the tray based on an output from the detecting member. However, the detecting member is able only to detect the receipt of the first sheet stack on the tray. Therefore, after the detecting member detects the first sheet stack, a separate counter counts the number of sheet stacks output to the tray. When the counter counts a number of sheet stacks equal to a predetermined number, a signal indicating a tray full condition prevents further sheet stacks from being output to the tray. After a user removes the sheet stacks loaded on the tray, the detecting member detects the absence of any sheet stacks on the tray, and the counter is reset.

FIG. 1 is a side view of a known sheet finishing apparatus including a sheet loading system. As shown in the figure, the sheet finishing apparatus includes lower outlet rollers 1083, a lower tray 1203, a pressure arm 1501, a rotation fulcrum 1501*a*, and a sensor 1401. Center-bound sheet stacks are received on the lower tray 1203.

Specifically, sheet stacks of recording media folded in a predetermined manner are output by the lower outlet rollers 1083 to the lower tray 1203. The rotation fulcrum 1501*a* of the pressure arm 1501 is disposed adjacent the lower outlet rollers 1083. The pressure arm 1501 presses the surface of the sheet stacks. The sensor 1401 detects the presence or absence of the first sheet stack in the lower tray 1203. After the sensor 1401 detects the first sheet stack, a separate counter counts the number of sheet stacks output to the lower tray 1203. When the counter counts a number of sheet stacks equal to a predetermined number, a signal indicating a tray full condition prevents further sheet stacks from being output to the lower tray 1203.

A memory that stores the counted number of sheet stacks may be erased, however, when the power to the image forming apparatus including the sheet finishing apparatus is turned off, or when the image forming apparatus enters a power saving mode. Because the sheet finishing apparatus cannot determine the number of sheet stacks on the lower tray 1203 after the memory is erased, the image forming apparatus indicates the tray full condition and requires that all sheet stacks on the lower tray 1203 be removed before output of additional sheet stacks to the lower tray 1203 is permitted. Emptying the lower tray 1203 is required even if only one sheet stack is on the lower tray 1203, because the number of sheet stacks on the lower tray 1203 cannot be determined.

When the image forming apparatus is not located near the user, it is inconvenient for the user to make multiple required trips to remove all of the sheet stacks from the lower tray 1203.

SUMMARY OF THE INVENTION

The present invention has been made in view of the above-mentioned circumstances.

An object of the present invention is to overcome one or more of the above discussed or other disadvantages.

The present invention can provide a sheet finishing apparatus including a discharging member configured to discharge recording media. A tray is configured to receive the discharged recording media. A rotatable moving member is configured to contact the discharged recording media such that an angular position of the rotatable member changes in response to a number of the recording media on the tray. A detecting member is configured to detect a movement of the moving member. A controller is configured to control an output of the recording media to the tray based on an output of the detecting member.

The present invention can further provide a sheet finishing apparatus including means for discharging recording media. Means are used for receiving the discharged recording media. Means are used for contacting the discharged recording media. An angular position of the means for contacting changes in response to a number of the recording media on the means for receiving. Means are used for detecting movement of the means for contacting. Means are used for controlling an output of the recording media to the means for receiving based on an output of the means for detecting.

The present invention can further provide a sheet finishing apparatus including a discharging member configured to discharge recording media. A tray is configured to receive the discharged recording media. A rotatable moving member is configured to contact the discharged recording media such that an angular position of the rotatable member changes in response to a number of the recording media on the tray. A detecting member is configured to detect a movement of the moving member. A controller is configured to control an output of the recording media to the tray based on an output of the detecting member and a result of a comparison between first and second jobs of the sheet finishing apparatus.

The present invention can further provide a sheet finishing apparatus including means for discharging recording media. Means are used for receiving the discharged recording media. Means are used for contacting the discharged recording media. An angular position of the means for contacting changes in response to a number of the recording media on the means for receiving. Means are used for detecting movement of the means for contacting. Means are used for controlling an output of the recording media to the means for receiving based on an output of the means for detecting and a result of a comparison between first and second jobs of the sheet finishing apparatus.

The present invention can further provide a sheet finishing apparatus including a discharging member configured to discharge recording media. A tray is configured to receive the discharged recording media. A rotatable moving member is configured to contact the discharged recording media such that an angular position of the rotatable member changes in response to a number of the recording media on the tray. A detecting member is configured to detect a movement of the moving member. A controller is configured to control an output of the recording media to the tray based on an output of the detecting member, information on a first job of the sheet finishing apparatus, and information on a second job of the sheet finishing apparatus.

The present invention can further provide a sheet finishing apparatus including means for discharging recording media. Means are used for receiving the discharged recording media. Means are used for contacting the discharged recording media. An angular position of the means for contacting changes in response to a number of the recording media on the means for receiving. Means are used for detecting movement of the means for contacting. Means are used for controlling an output of the recording media to the means for receiving based on an output of the means for detecting, information on a first job of the sheet finishing apparatus, and information on a second job of the sheet finishing apparatus.

The present invention can further provide a method of monitoring recording media output to a tray of a sheet finisher including determining first information with respect to a first job performed on recording media output to the tray, determining second information with respect to a second job to be performed on the recording media, and comparing the first and second information to determine whether the recording media of the second job is to be output to the tray.

The present invention can further provide a sheet finishing apparatus for an image forming apparatus including a tray configured to receive recording media thereon. A moving member is configured to contact the recording media on the tray such that a position of the member changes in response to a number of the recording media on the tray. A detector is configured to detect a position of the moving member.

The present invention can still further provide a method of determining a status of a sheet finisher tray of an image forming unit, which includes disposing a member to move in response to a number of recording media on the tray, disposing a first sensor to determine whether a first portion of the moving member is sensed, disposing a second sensor to determine whether a second portion of the moving member is sensed, and determining whether further output to the tray is permitted based on the determinations of the first and second sensors.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
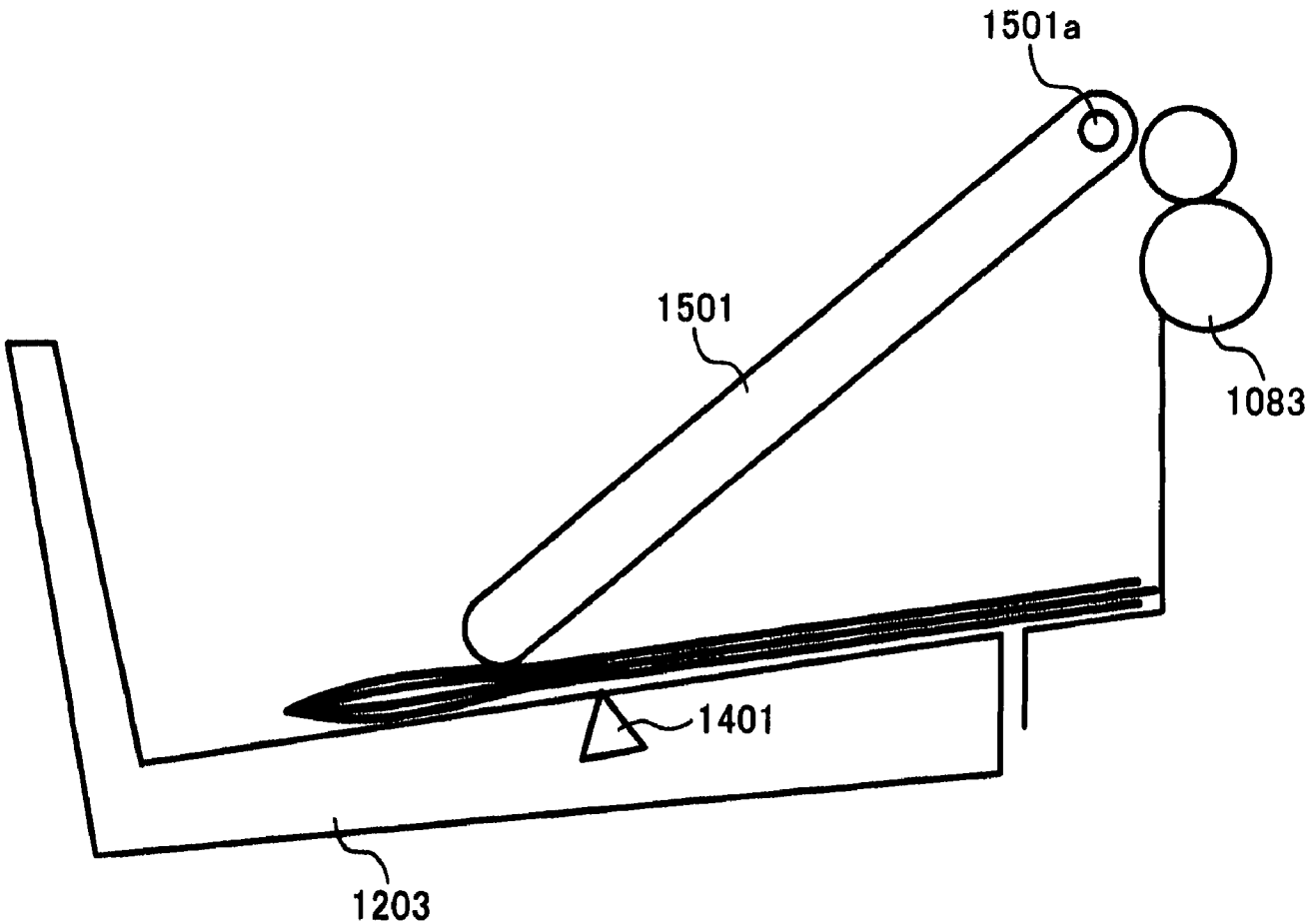
FIG. 1 BACKGROUND ART
FIG. 1 is a side view of a known sheet finishing apparatus including a sheet loading system having a tray on which center-bound sheet stacks are received.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

It is important to note that, in the exemplary embodiments hereinafter described, a discharging member corresponds to lower outlet rollers 83. A tray corresponds to a lower tray 203. A moving member corresponds to a pressure arm 501. A first detecting member may correspond to first and second sensors 505*a* and 505*b*. A controller and a counter may correspond to a CPU 360. A second detecting member that detects the presence or absence of the tray may correspond to the pressure arm 501, and the first and second sensors 505*a* and 505*b*.

Figure 2:
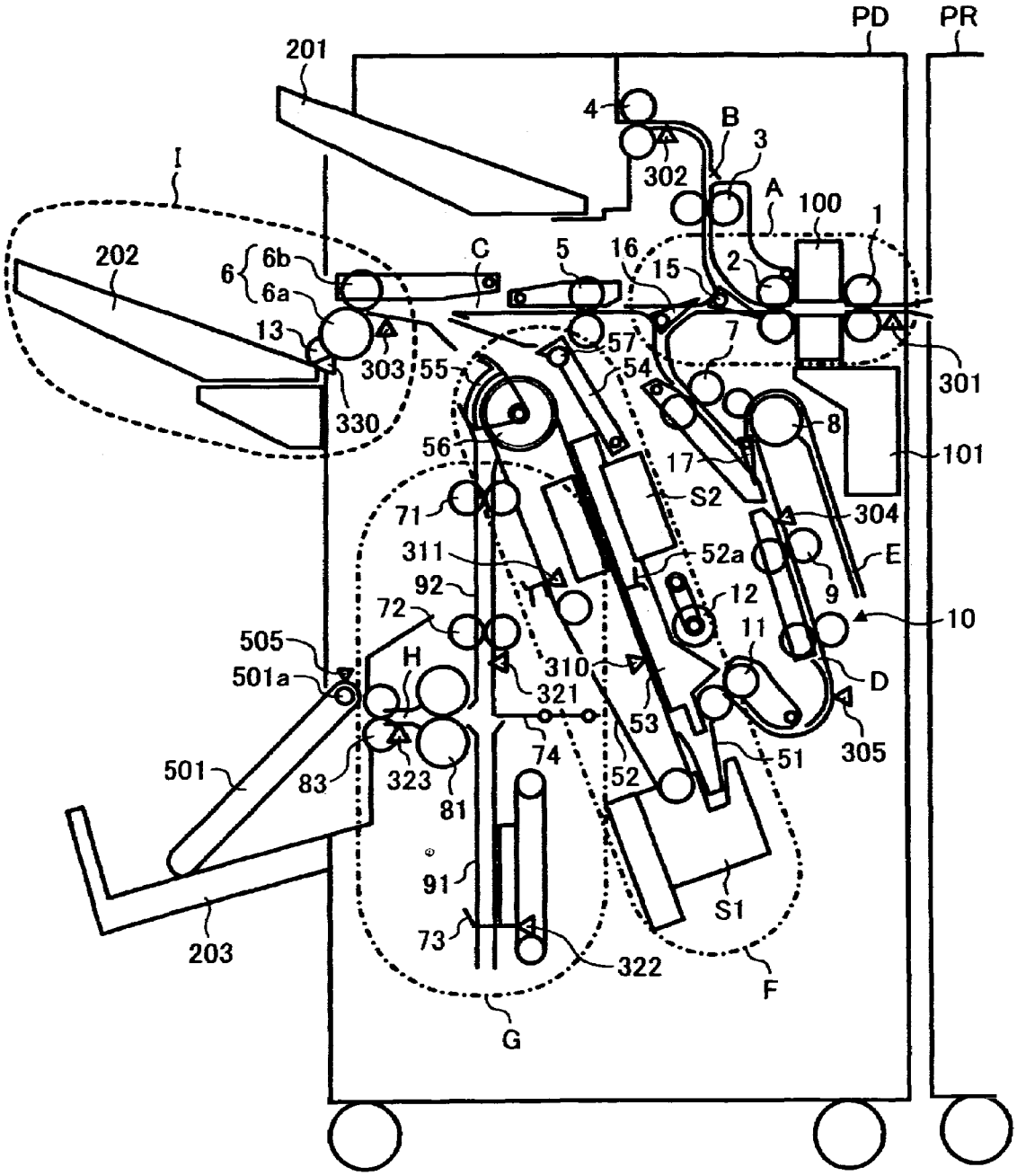
FIG. 2 is a side view of an image forming system and a sheet finishing apparatus mounted thereto according to an embodiment of the present invention and an image forming apparatus.

Referring to FIG. 2 of the drawings, an image forming system according to an embodiment of the present invention is shown and directed mainly toward the first object.

As shown in FIG. 2, the image forming system is generally made up of an image forming apparatus PR and a sheet finishing apparatus PD operatively connected to one side of the image forming apparatus PR. A recording sheet or recording medium driven out of the image forming apparatus PR is introduced in the sheet finishing apparatus PD. In the sheet finishing apparatus PD, there is a plurality of sheet conveying paths. A sheet conveying path A includes finishing mechanism for finishing a single recording sheet. In the illustrative embodiment, this finishing mechanism is implemented as a punch unit or punching mechanism 100. Path selectors 15 and 16 steer the recording sheet coming in through the sheet conveying path A to any one of a sheet conveying path B terminating at an upper tray 201, a sheet conveying path C terminating at a shift tray 202, and a processing tray F. The processing tray F is used to position, staple or otherwise process a recording sheet or recording sheets and, in this sense, will sometimes be referred to as a staple tray hereinafter.

The image forming apparatus PR further includes at least an image processor, an optical writing unit, a developing unit, an image transferring unit, and a fixing unit although not shown specifically. The image processor converts an image signal input thereto to image data that can be printed out. The optical writing unit optically scans the surface of a photoconductive element in accordance with the image data output from the image processor, thereby forming an electrostatic latent image. The developing unit develops the electrostatic latent image with toner to thereby produce a corresponding toner image. The image transferring unit transfers the toner image onto a recording sheet. The fixing unit fixes the toner image on the recording sheet. While the image forming apparatus PR is assumed to execute an electrophotographic process, it may alternatively be of the type executing any other conventional image forming process, e.g., an ink-jet or a thermal transfer image forming process. In the illustrative embodiment, the image processor, optical writing unit, developing unit, image transferring unit and fixing unit constitute image forming mechanism in combination.

Recording sheets sequentially brought to the staple tray F via the sheet conveying paths A and D are positioned one by one, stapled or otherwise processed, and then steered by a guide plate 54 and a movable guide 55 to either one of the sheet conveying path C and another processing tray G. The processing tray G folds or otherwise processes the sheets and, in this sense, will sometimes be referred to as a fold tray hereinafter. The sheets folded by the fold tray G are guided to a lower tray 203 via a sheet conveying path H. The sheet finishing path D includes a path selector 17 constantly biased to a position shown in FIG. 2 by a light-load spring, which is not shown. An arrangement is made such that after the trailing edge of a sheet has moved away from the path selector 17, among a prestack roller 8, rollers 9 and 10 and a staple outlet roller 11, at least the prestack roller 8 and roller 9 are rotated in the reverse direction to convey the trailing edge of the sheet to a prestacking portion E and cause the recording sheet to stay there. In this case, the sheet can be conveyed together with the next recording sheet placed thereon. Such an operation may be repeated to convey two or more recording sheets together.

On the sheet conveying path A merging into the sheet conveying paths B, C, and D, there are sequentially arranged an inlet sensor 301 responsive to a recording sheet coming into the finishing apparatus PD, an inlet roller pair 1, the punch unit 100, a waste hopper 101, a roller pair 2, and the path selectors 15 and 16. Springs (not shown) constantly bias the path selectors 15 and 16 to the positions shown in FIG. 2. When solenoids (not shown) are turned on, the path selectors 15 and 16 rotate upward and downward, respectively, to thereby steer the sheet to desired one of the sheet conveying paths B, C and D.

More specifically, to guide a recording sheet to the conveying path B, the path selector 15 is held in the position shown in FIG. 2 while the solenoid assigned thereto is turned off. To guide a sheet to the conveying path C, the solenoids are turned on to rotate the path selectors 15 and 16 upward and downward, respectively. Further, to guide a recording sheet to the conveying path D, the path selector 16 is held in the position shown in FIG. 2 while the solenoid assigned thereto is turned off; at the same time, the solenoid assigned to the path selector 15 is turned on to rotate it upward.

In the illustrative embodiment, the finishing apparatus PD is capable of selectively effecting punching (the punch unit 100), jogging and edge stapling (jogger fences 53 and an edge stapler S1), center stapling (the jogger fences 53 and a pair of center staplers S2), sorting (a shift tray 202) or folding (a fold plate 74, first fold roller pair 81, and second fold roller pair which is not shown, as desired).

<Shift Tray Section>

A shift tray outlet section I is located at the most downstream position of the sheet finishing apparatus PD and includes a shift outlet roller pair 6, a return roller 13, a sheet surface sensor 330, and the shift tray 202. The shift tray outlet section I additionally includes a shifting mechanism J shown in FIG. 3 and a shift tray elevating mechanism K shown in FIG. 4.

Figure 3:
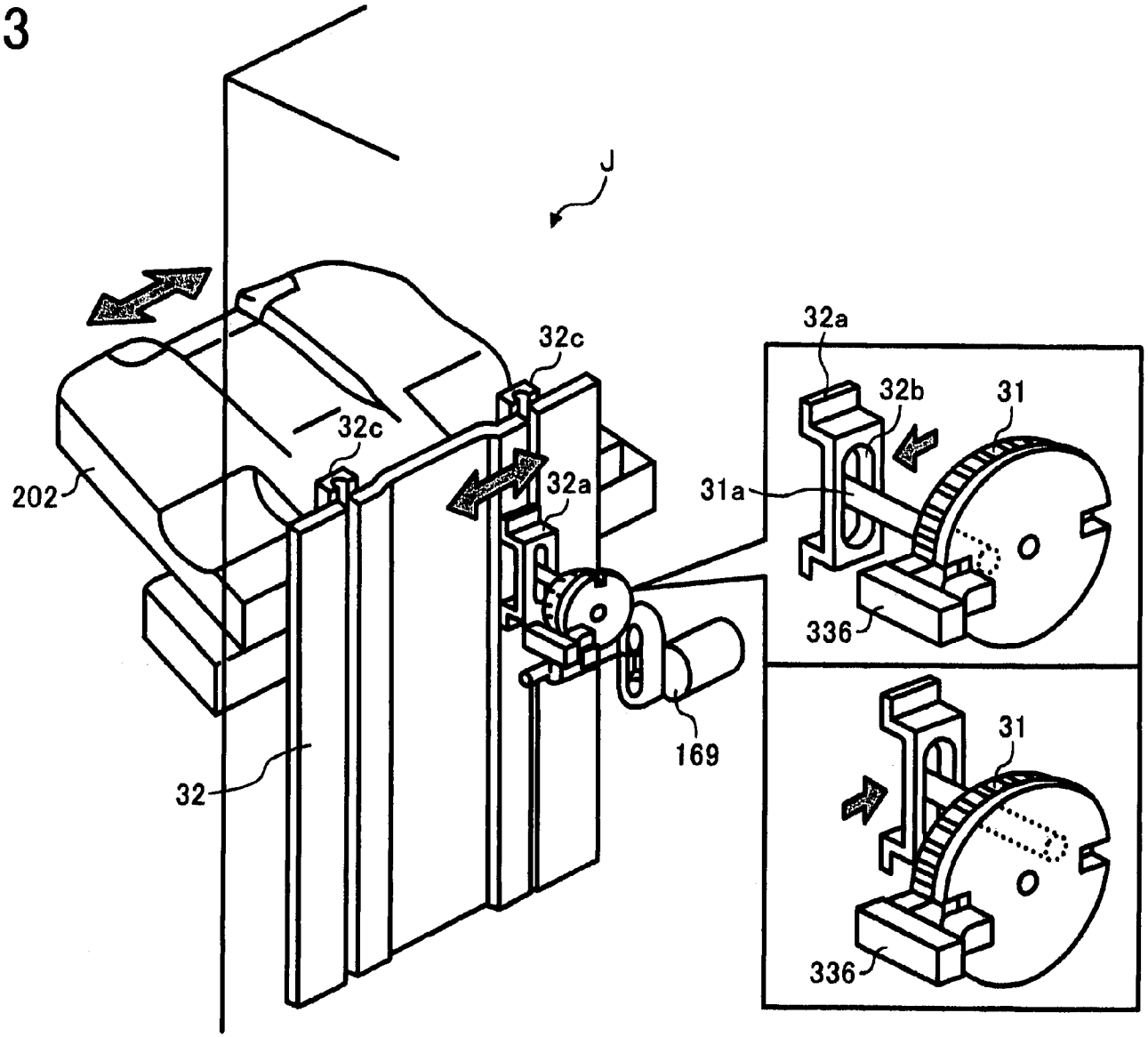
FIG. 3 is a fragmentary, enlarged isometric view showing a shifting mechanism included in the sheet finishing apparatus.
Figure 4:
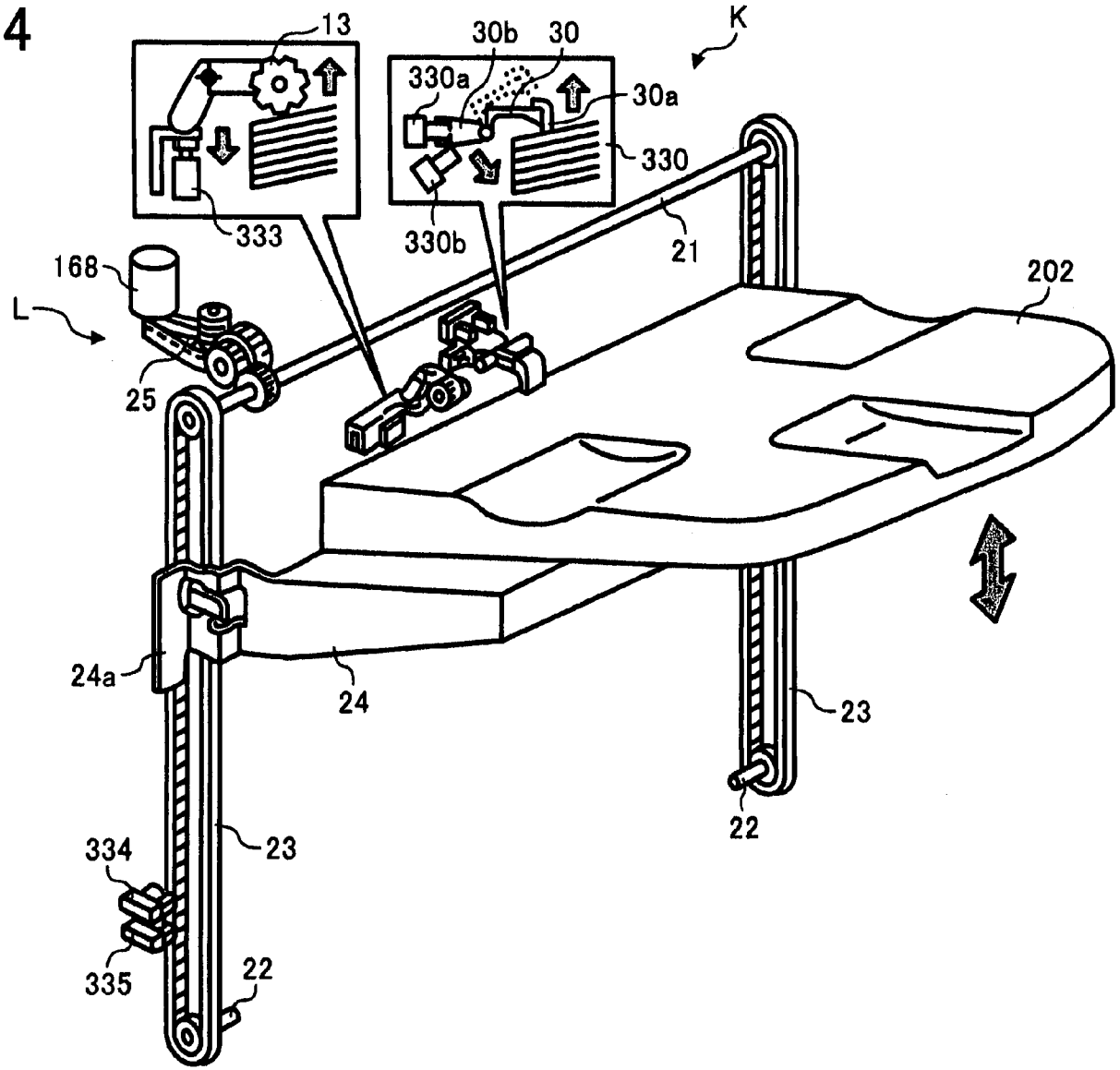
FIG. 4 is a fragmentary, enlarged isometric view showing a shift tray elevating mechanism included in the sheet finishing apparatus.

As shown in FIGS. 2 and 4, the return roller 13 contacts a recording sheet driven out by the shift outlet roller pair 6 and causes the trailing edge of the sheet to abut against an end fence 32 shown in FIG. 3 for thereby positioning it. The return roller 13 is formed of sponge and is caused to rotate by the shift outlet roller 6. A limit switch 333 (see FIG. 4) is positioned in the vicinity of the return roller 13 so that it can raise the return roller 13 when the shift tray 202 is lifted, and the limit switch 333 may turn on, causing a tray elevation motor 168 to stop rotating. This prevents the shift tray 202 from overrunning. Further, as shown in FIG. 2, the sheet surface sensor 330 senses the surface of a recording sheet or that of a sheet stack driven out to the shift tray 202.

As shown in FIG. 4 specifically, the sheet surface sensor 330 is made up of a lever 30, a sheet surface sensor 330*a* relating to stapling, and a sheet surface sensor 330*b* relating to non-stapling. The lever 30 is angularly movable about its shaft portion and made up of a contact end 30*a* contacting the top of the trailing edge of a recording sheet on the shift tray 202 and a sectorial interrupter 30*b*. The upper (sheet surface) sensor 330*a* and lower (sheet surface) sensor 330*b* are mainly used for staple discharge control and shift discharge control, respectively.

More specifically, in the illustrative embodiment, the sheet surface sensors 330*a* and 330*b* respectively turn on when interrupted by the sectorial interrupter 30*b* of the lever 30. Therefore, when the shift tray 202 is lifted with the contact end 30*a* of the lever 30 moving upward, the sheet surface sensor 330*a* turns off. As the shift tray 202 is further lifted, the sheet surface sensor 330*b* turns off. When the outputs of the sheet surface sensors 330*a* and 330*b* indicate that recording sheets are stacked on the shift tray 202 to a preselected height, the tray elevation motor 168 is driven to lower the shift tray 202 by a preselected amount. The top of the sheet stack on the shift tray 202 is therefore maintained at a substantially constant height.

<Shift Tray Elevating Mechanism>

The shift tray elevating mechanism K will be described in detail with reference to FIG. 4.

As shown in FIG. 4, the mechanism K includes a drive unit L for moving the shift tray 202 upward or downward via a drive shaft 21. Timing belts 23 are passed over the drive shaft 21 and respective driven shafts 22 under tension via timing pulleys (not shown). A side plate 24 supports the shift tray 202 and is affixed to the timing belts 23. In this configuration, the entire unit including the shift tray 202 is supported by the timing belts 23 in such a manner as to be movable up and down.

The drive unit L includes a worm gear 25 in addition to the tray elevation motor 168, which is a reversible drive source. Torque output from the tray elevation motor 168 is transmitted to the last gear of a gear train mounted on the drive shaft 21 to thereby move the shift tray 202 upward or downward. The worm gear 25 included in the driveline allows the shift tray 202 to be held at a preselected position and therefore prevents the shift tray 202 from dropping by accident.

An interrupter 24*a* is formed integrally with the side plate 24 of the shift tray 202. A full sensor 334 responsive to the full condition of the shift tray 202 and a lower limit sensor 335 responsive to the lower limit position of the shift tray 202 are positioned below the interrupter 24*a*. The full sensor 334 and lower limit sensor 335, which are implemented by photosensors, respectively turn off when interrupted by the interrupter 24*a*. In FIG. 4, the shift outlet roller 6 is not shown.

As shown in FIG. 3, the shifting mechanism J includes a shift motor 169 and a shift cam 31. When the shift motor 169 serving as a drive source 169 causes the shift cam 31 to rotate, the shift cam 31 causes the shift tray 202 to move back and forth in a direction perpendicular to a direction of sheet discharge. A pin 31*a* is studded on the shift cam 31 at a position spaced from the axis of the shift cam 31 by a preselected distance. The tip of the pin 31*a* is movably received in an elongate slot 32*b* formed in an engaging member 32*a*, which is affixed to the back of the end fence 32 not facing the shift tray 202. The engaging member 32*a* moves back and forth in a direction perpendicular to the direction of sheet discharge in accordance with the angular position of the pin 31*a*, entraining the shift tray 202 in the same direction. The shift tray 202 stops at a front position and a rear position in the direction perpendicular to the sheet surface of FIG. 2 (corresponding to the positions of the shift cam 31 shown in FIG. 3). A shift sensor 336 is responsive to a notch formed in the shift cam 31. To stop the shift tray 202 at the above-described two positions, the shift motor 169 is selectively turned on or off on the basis of the output of the shift sensor 336.

Guide channels 32*c* are formed in the front surface of the end fence 32. The rear edge portions of the shift tray 202 are movably received in the guide channels 32*c*. The shift tray 202 is therefore movable up and down and movable back and forth in the direction perpendicular to the direction of sheet discharged, as needed. The end fence 32 guides the trailing edges of recording sheets stacked on the shift tray 202 for thereby aligning them.

<Sheet Discharging Section>

Figure 5:
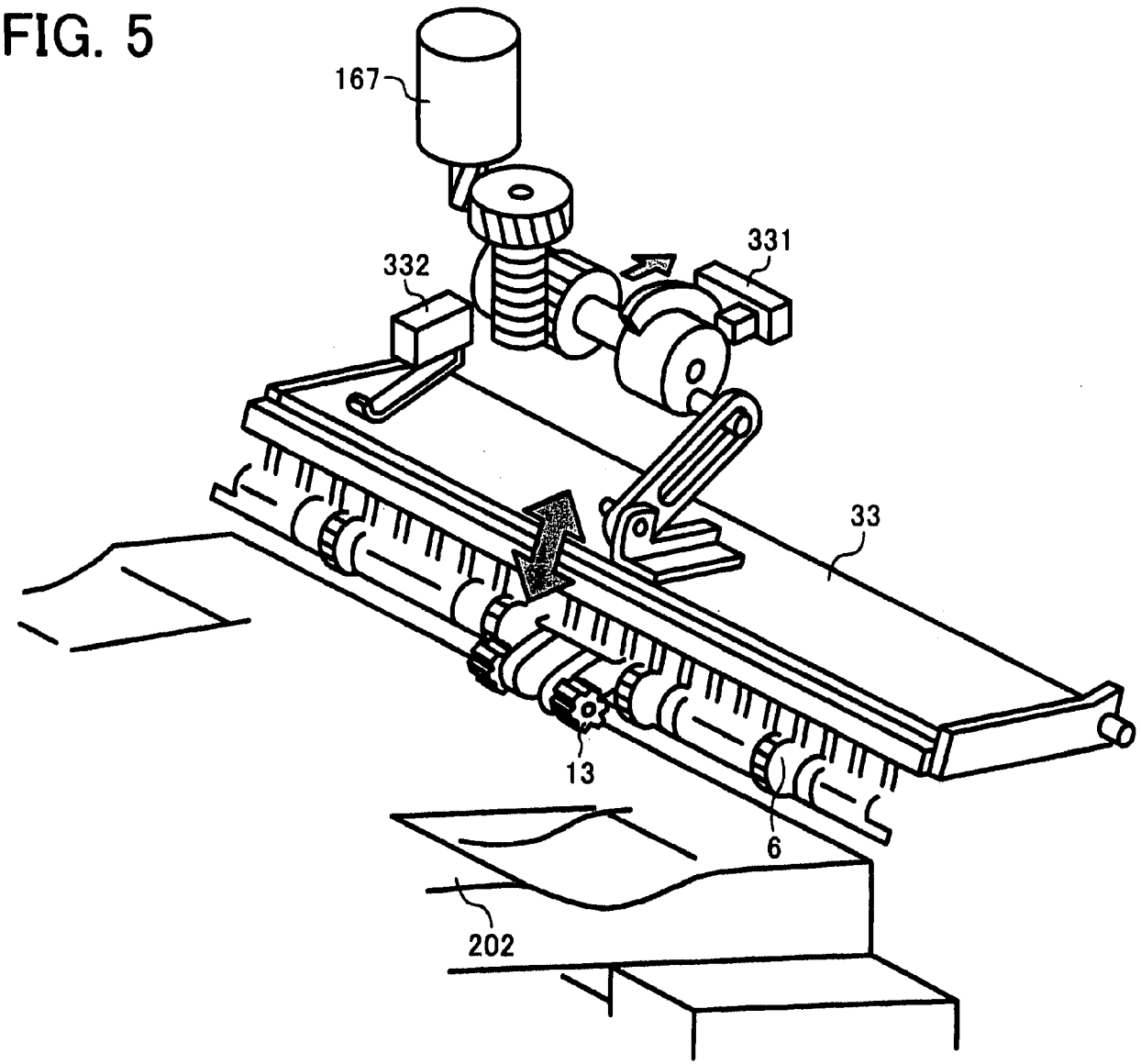
FIG. 5 is an isometric view showing part of the sheet finishing apparatus configured to discharge sheets to the shift tray.

FIG. 5 shows a specific configuration of the arrangement for discharging a recording sheet to the shift tray 202. As shown in FIGS. 2 and 5, the shift roller pair 6 has a drive roller 6*a* and a driven roller 6*b*. A guide plate 33 is supported at its upstream side in the direction of sheet discharge and angularly movable in the up-and-down direction. The driven roller 6*b* is supported by the guide plate 33 and contacts the drive roller 6*a* due to its own weight or by being biased, nipping a recording sheet between it and the drive roller 6*a*. When a stapled sheet stack is to be driven out to the shift tray 202, the guide plate 33 is lifted and then lowered at a preselected timing, which is determined based on a detection signal of a shift outlet sensor 303 (see FIG. 2). Further, a stop position of the guide plate 33 is determined on the basis of the output of a guide plate sensor 331. A guide plate motor 167 drives the guide plate 33 in such a manner in accordance with the ON/OFF state of a limit switch 332.

<Configuration of a Staple Tray>

Figure 6:
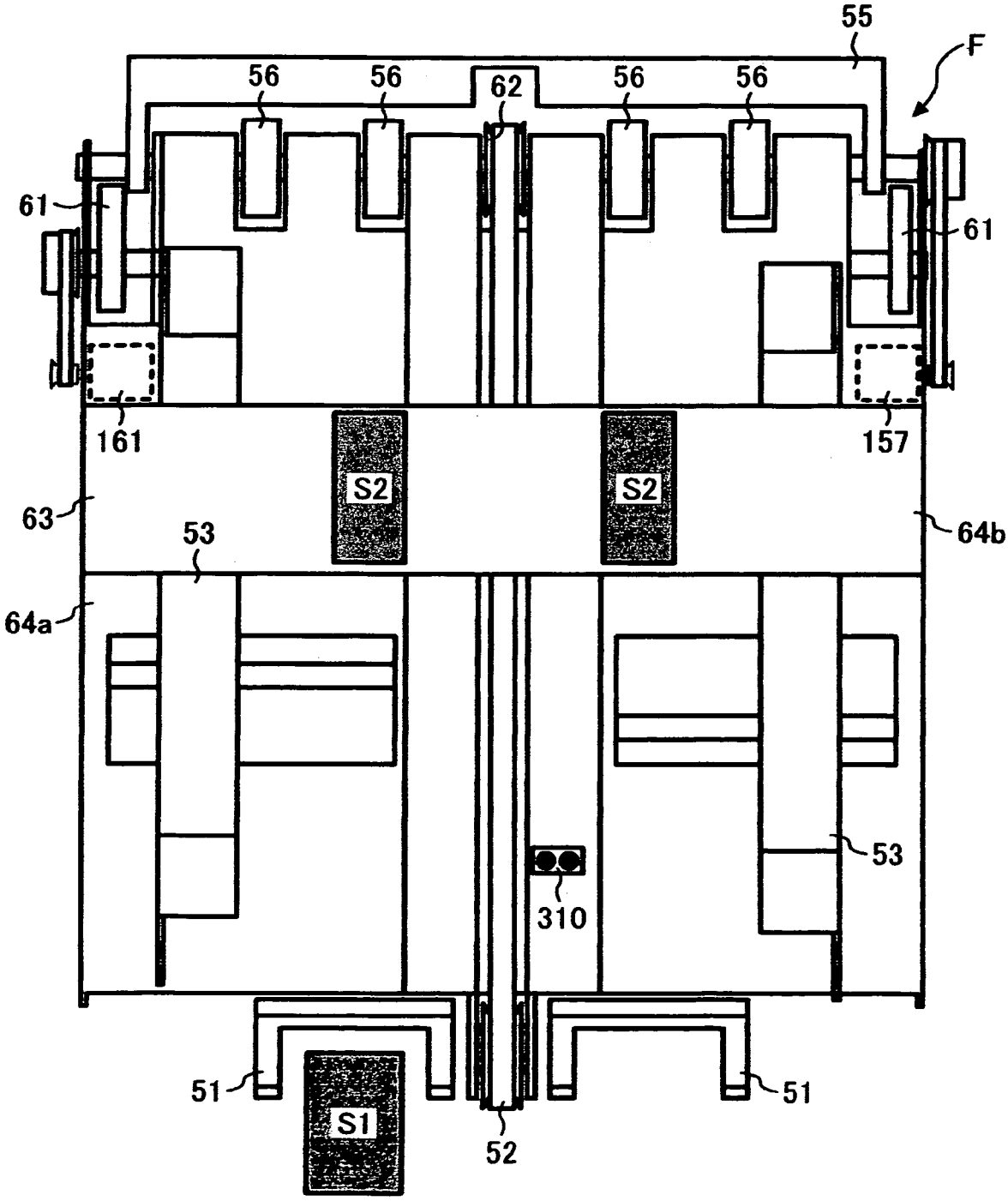
FIG. 6 is a plan view showing a staple tray included in the sheet finishing apparatus, as seen in a direction perpendicular to a sheet conveying surface.
Figure 7:
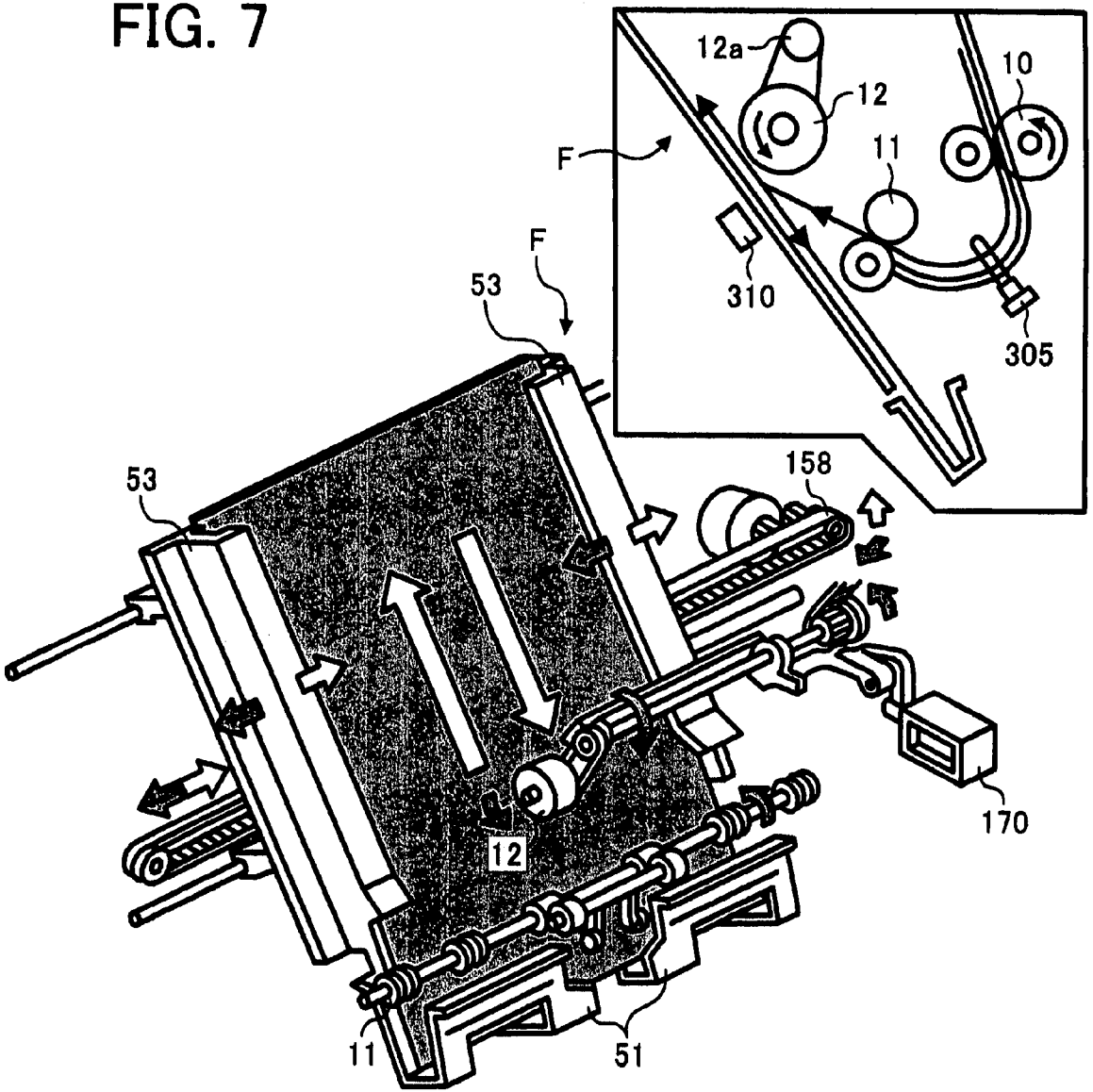
FIG. 7 is an isometric view showing the staple tray and a mechanism for driving it.
Figure 8:
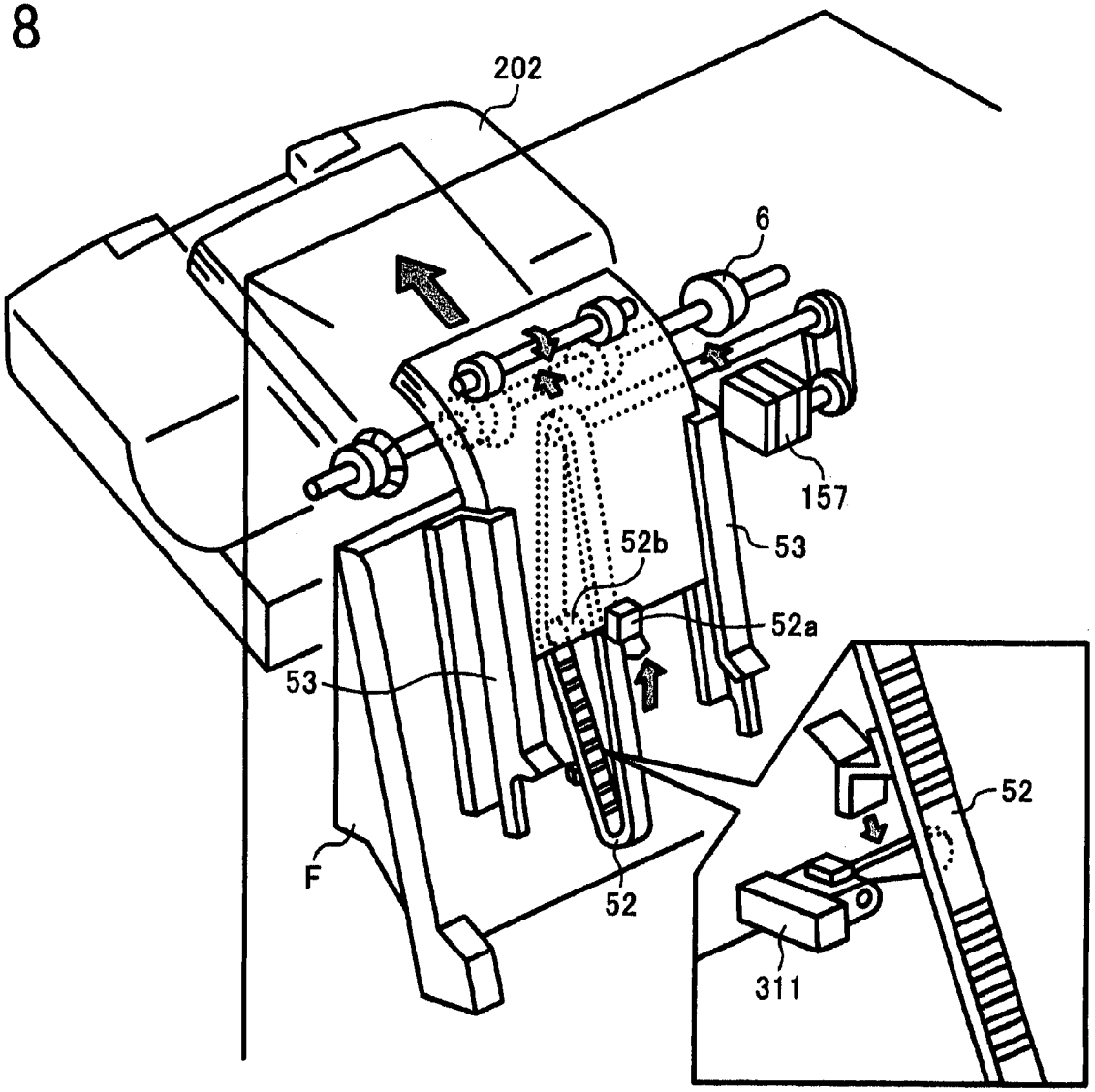
FIG. 8 is an isometric view showing a mechanism included in the sheet finishing apparatus for discharging a sheet stack.

Referring to FIGS. 6 through 8, a schematic structure and functions of the staple tray F are described.

FIG. 6 shows the staple tray F as seen in a direction perpendicular to the sheet conveyance plane. FIG. 7 shows a drive mechanism assigned to the staple tray F. FIG. 8 shows a sheet stack discharging mechanism.

As shown in FIG. 7, sheets sequentially conveyed by the staple outlet roller pair 11 to the staple tray F are sequentially stacked on the staple tray F. At this instant, a knock roller 12 knocks every recording sheet for positioning it in the vertical direction (direction of sheet conveyance) while jogger fences 53 position the recording sheet in the horizontal direction perpendicular to the sheet conveyance (sometimes referred to as a direction of sheet width). Between consecutive jobs, i.e., during an interval between the last sheet of a sheet stack and the first sheet of the next sheet stack, a control unit 350 (see FIG. 17A) outputs a staple signal for causing the edge stapler S1 to perform a stapling operation. A discharge belt 52 with a hook 52*a* immediately conveys the stapled sheet stack to the shift outlet roller pair 6, so that the shift outlet roller pair 6 conveys the sheet stack to the shift tray 202 held at a receiving position.

<Sheet Discharging Mechanism>

As shown in FIG. 8, a belt HP (Home Position) sensor 311 senses the hook 52*a* of the discharge belt 52 brought to its home position. More specifically, two hooks 52*a* and 52*b* are positioned on the discharge belt 52 face-to-face at spaced locations in the circumferential direction and alternately convey sheet stacks stapled on the staple tray F one after another. The discharge belt 52 may be moved in the reverse direction such that one hook 52*a* held in a stand-by position and the back of the other hook 52*b* position the leading edge of the sheet stack stored in the staple tray F in the direction of sheet conveyance, as needed. The hook 52*a* therefore plays the role of positioning means at the same time.

As shown in FIGS. 6 and 8, a discharge motor 157 causes the discharge belt 52 to move via a discharge shaft (not shown). The discharge belt 52 and a drive pulley 62 therefor are positioned at the center of a discharge shaft (not shown) in the direction of sheet width. Discharge rollers 56 are mounted on the discharge shaft in a symmetrical arrangement. The discharge rollers 56 rotate at a higher peripheral speed than the discharge belt 52.

<Staple Processing Mechanism>

A staple processing mechanism will be described hereinafter. As shown in FIG. 7, a solenoid 170 causes the knock roller 12 to move about a fulcrum 12*a* in a pendulum fashion, so that the knock roller 12 intermittently acts on recording sheets sequentially driven to the staple tray F and causes their trailing edges to abut against rear fences 51. The knock roller 12 rotates counterclockwise about its axis. A jogger motor 158 drives the jogger fences 53 via a timing belt and causes them to move back and forth in the direction of sheet width.

Figure 9:
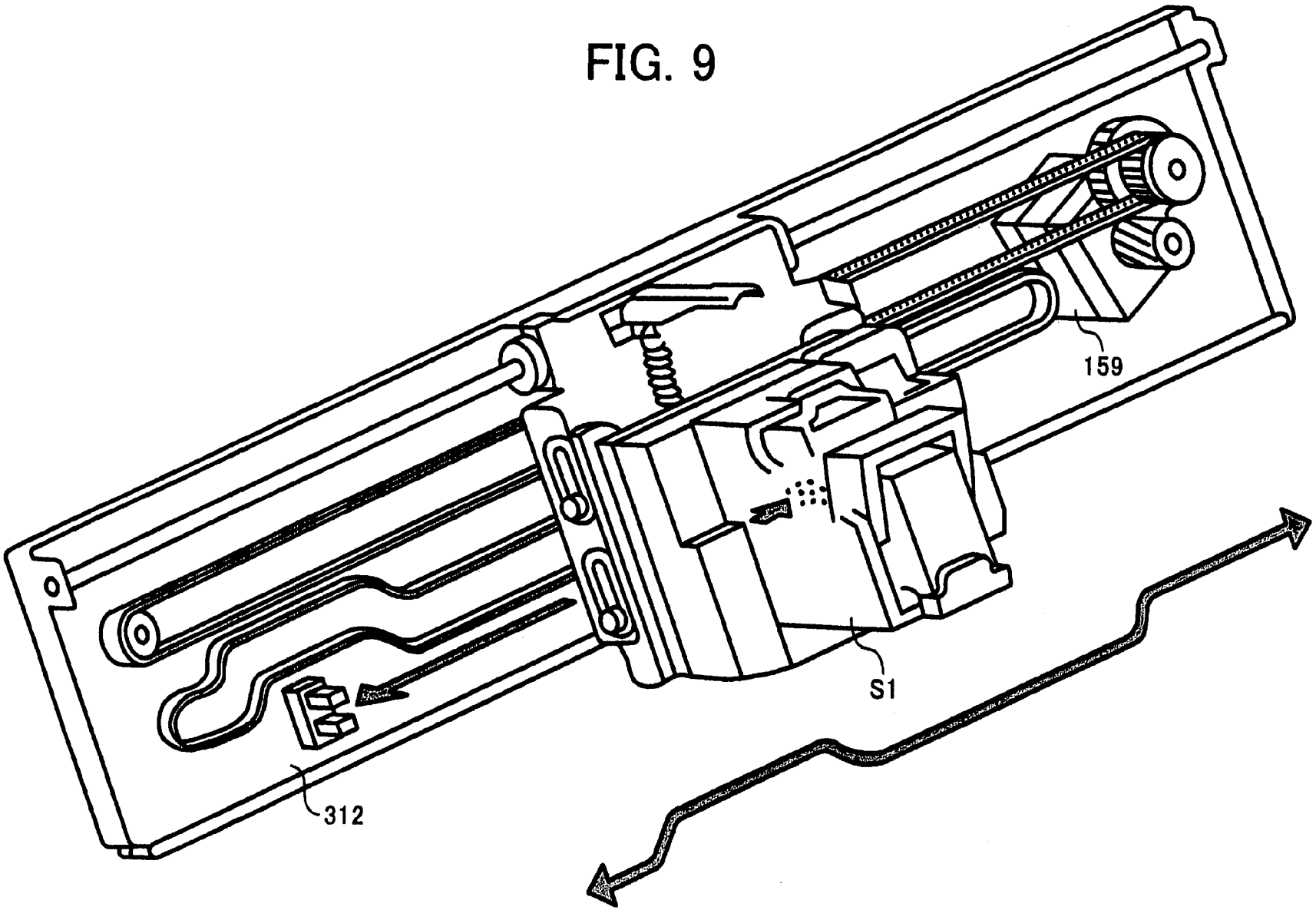
FIG. 9 is an isometric view showing an edge stapler included in the sheet finishing apparatus together with a mechanism for moving it.

As shown in FIG. 9, a mechanism for moving the edge stapler S1 includes a reversible, stapler motor 159 for driving the edge stapler S1 via a timing belt. The edge stapler S1 is movable in the direction of sheet width in order to staple a sheet stack at a desired edge position. A stapler HP sensor 312 is positioned at one end of the movable range of the edge stapler S1 in order to sense the edge stapler S1 brought to its home position. The stapling position in the direction of sheet width is controlled in terms of the displacement of the edge stapler S1 from the home position.

Figure 10:
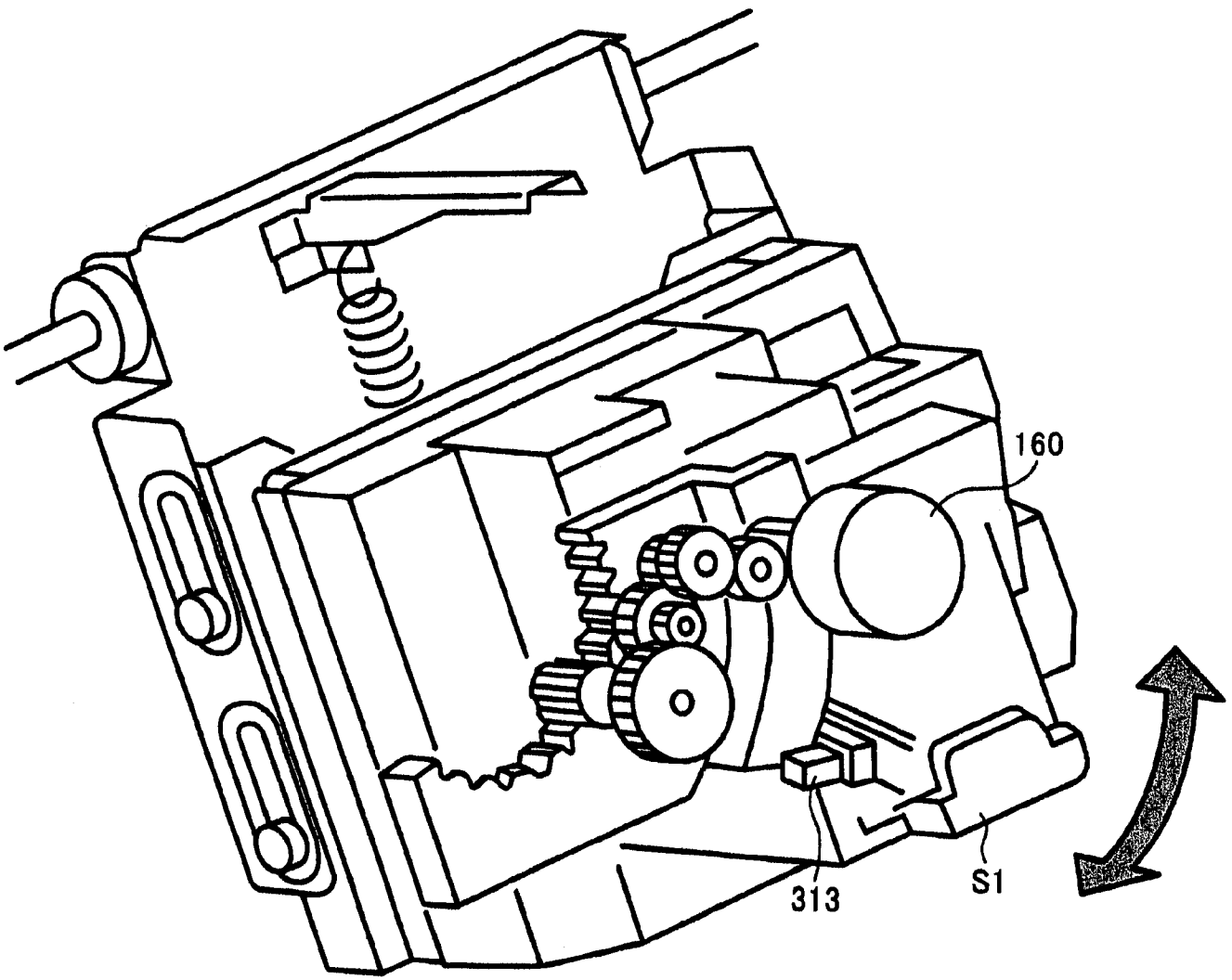
FIG. 10 is an isometric view showing a mechanism for rotating the edge stapler.

As shown in FIG. 10, the edge stapler S1 is capable of selectively driving a staple into a sheet stack in parallel to or obliquely relative to the edge of the sheet stack. Further, at the home position, only the stapling mechanism portion of the edge stapler S1 is rotatable by a preselected angle for the replacement of staples. For this purpose, an oblique motor 160 causes the above mechanism of the edge stapler S1 to rotate until a sensor 313 senses the mechanism reached a preselected replacement position. After oblique stapling or the replacement of staples, the oblique motor 160 causes the stapling mechanism portion to return to its original angular position.

As shown in FIGS. 2 and 6, the pair of center staplers S2 are affixed to a stay 63 and are located at a position where the distance between the rear fences 51 and their stapling positions is equal to or greater than one-half of the length of the maximum sheet size, as measured in the direction of conveyance, that can be stapled. The pair of center staplers S2 are symmetrical to each other with respect to the center in the direction of sheet width. The pair of center staplers S2 themselves are conventional and will not be described specifically. Briefly, after a sheet stack has been fuilly positioned by the jogger fences 53, the rear fences 51, and the knock roller 5, the discharge belt 52 lifts the trailing edge of the sheet stack with its hooks 52*a* and 52*b* to a position where the center of the sheet stack in the direction of sheet conveyance coincides with the stapling positions of the pair of center staplers S2. The pair of center staplers S2 are then driven to staple the sheet stack. The stapled sheet stack is conveyed to the fold tray G and folded at the center, as will be described in detail later.

FIG. 6 further shows a front frame plate 64*a*, a rear frame plate 64*b*, and a sheet sensor 310 responsive to the presence and absence of a sheet stack on the staple tray F.

<Sheet Stack Steering Mechanism>

Figure 16:
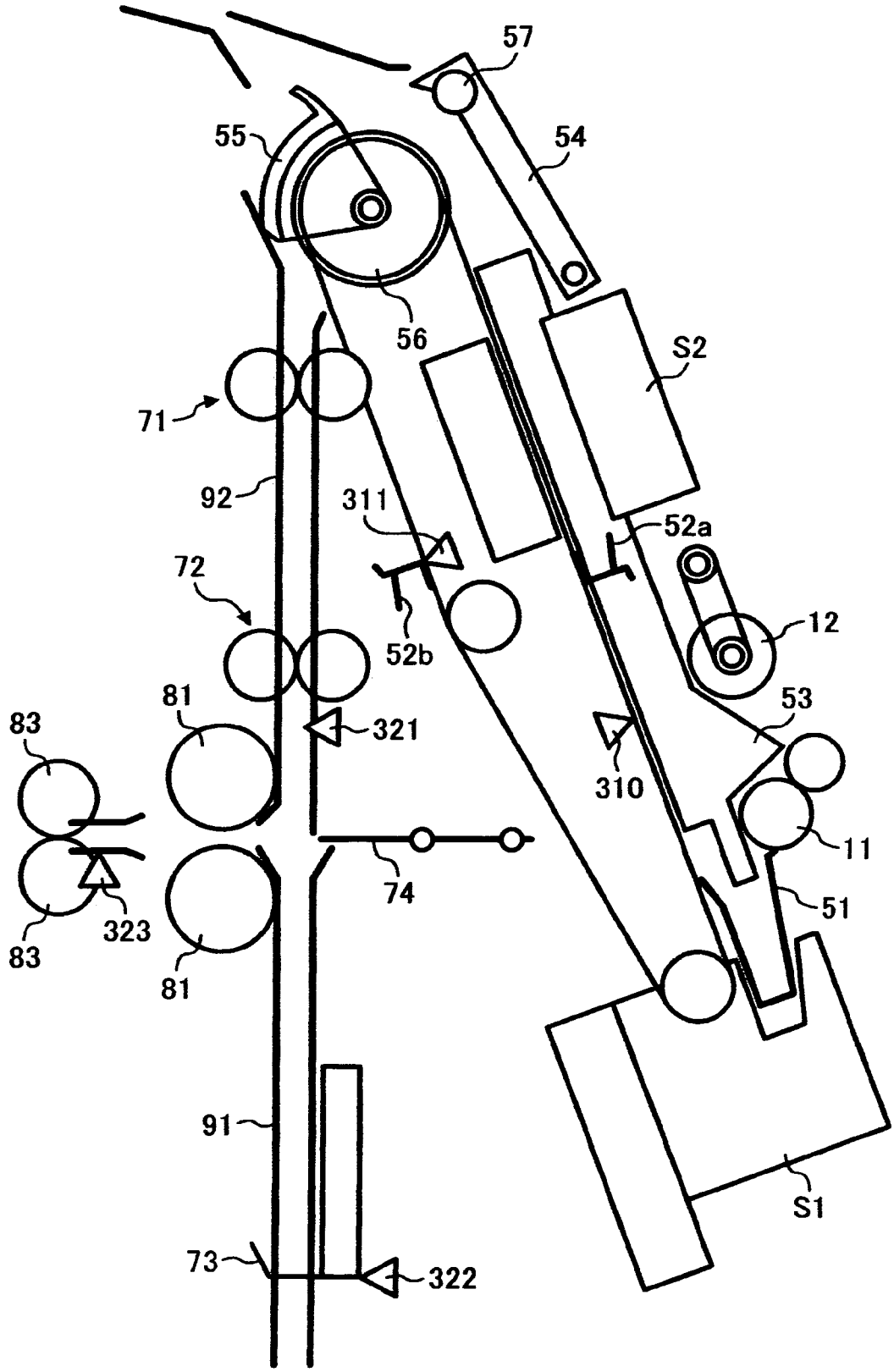
FIG. 16 is a side view illustrating the staple tray and fold tray in detail.

Reference will be made to FIG. 16 as well as to FIG. 2 for describing a mechanism for steering a sheet stack. To allow the sheet stack stapled by the center staplers S2 to be folded at the center on the fold tray G, sheet stack steering means is located at the most downstream side of the staple tray F in the direction of sheet conveyance in order to steer the stapled sheet stack toward the fold tray G.

Figure 11:
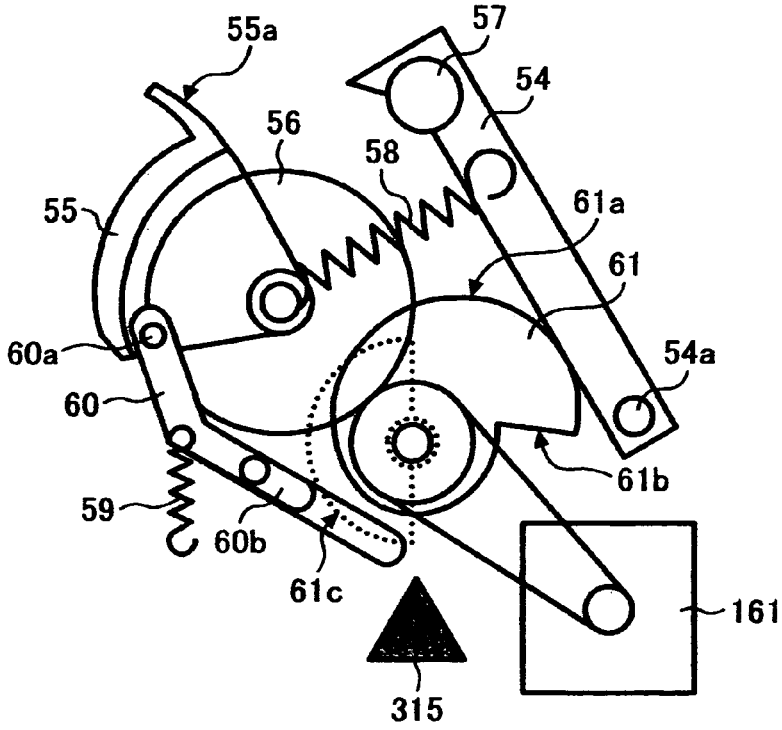
FIGS. 11 through 13 are side views demonstrating the consecutive operating conditions of a sheet stack steering mechanism included in the sheet finishing apparatus.
Figure 12:
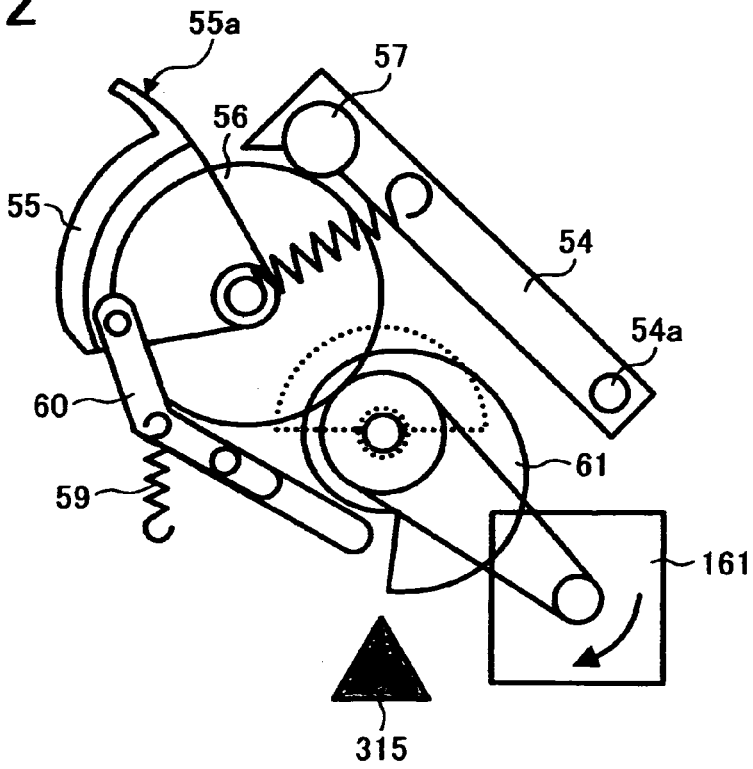
Figure 13:
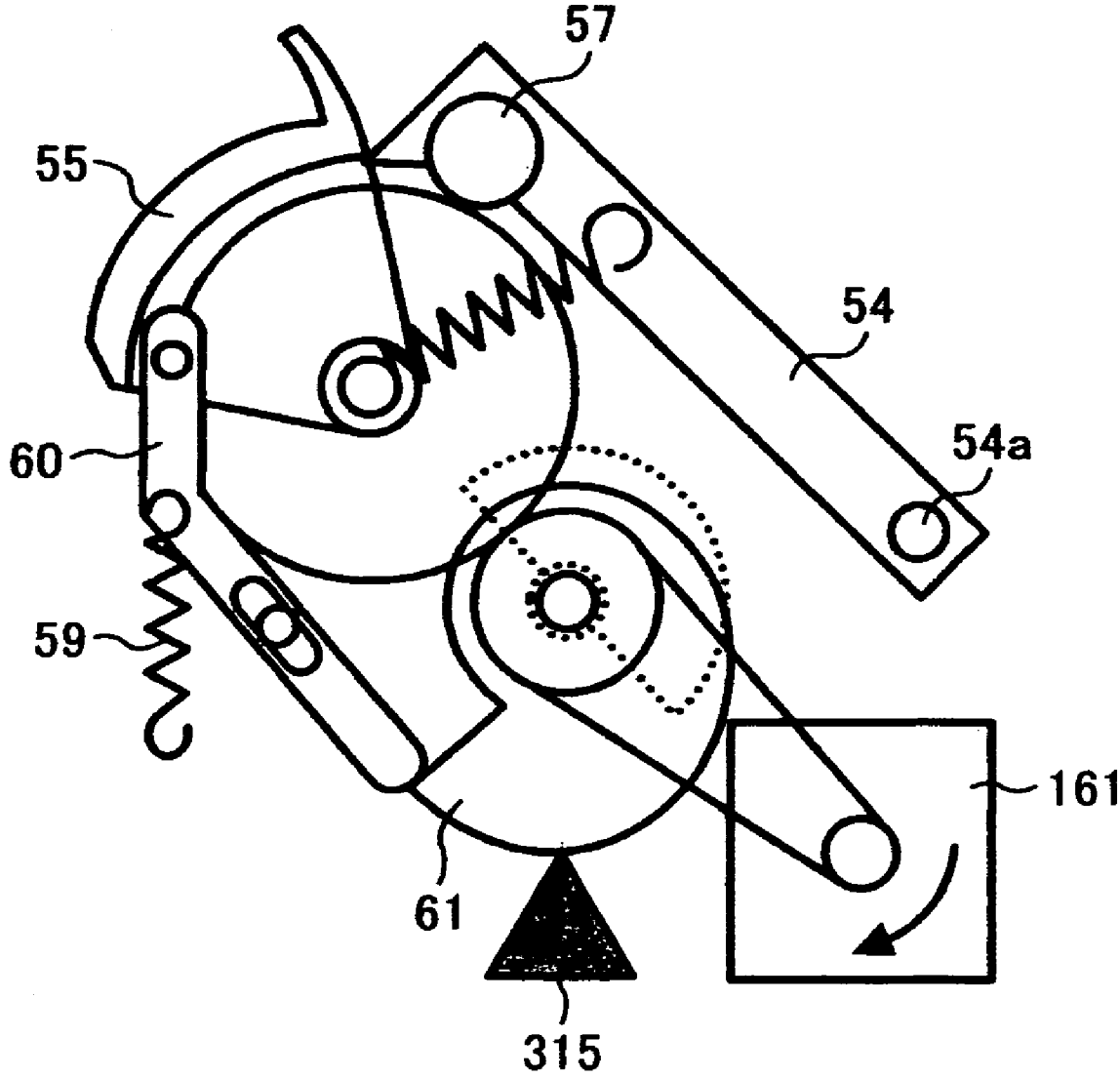

As shown in FIGS. 1 and 16, the steering mechanism includes the guide plate 54 and the movable guide 55 mentioned earlier. As shown in FIGS. 11 through 13, the guide plate 54 is angularly movable about a fulcrum 54*a* in the up-and-down direction and supports the press roller 57, which is freely rotatable, on its downstream end. A spring 58 constantly biases the guide plate 54 toward the discharge roller 56. The guide plate 54 is held in contact with a cam 61 having a cam surface 61*a*. The cam 61 is driven by a steer motor 161.

The movable guide 55 is angularly movably mounted on the shaft of the discharge roller 56. A link arm 60 is connected to one end of the movable guide 55 remote from the guide plate 54 at a joint 60*a*. A pin studded on the front frame plate 64*a*, as shown in FIG. 6, is movably received in an elongate slot 60*b* formed in the link arm 60, limiting the movable range of the movable guide 55. A spring 59 holds the link arm 60 in the position shown in FIG. 11. When the steer motor 161 causes the cam 61 to rotate to a position where its cam surface 61*b* presses the link arm 60, the movable guide 55 connected to the link arm 60 angularly moves upward along the surface or the discharge roller 56. A guide HP sensor 315 senses the home position of the cam 61 on sensing an interrupter portion 61*c* of the cam 61. Therefore, the stop position of the cam 61 is controlled on the basis of the number of drive pulses input to the steer motor 161 counted from the home position of the cam 61.

FIG. 11 shows a positional relation to hold between the guide plate 54 and the movable guide 55 when the cam 61 is held at its home position. As shown in FIG. 11, a guide surface 55*a* of the movable guide 55 is curved and spaced from the surface of the discharge roller 56 by a preselected distance. While a part of the guide plate 55 downstream of the press roller 57 in the direction of sheet conveyance is curved complementarily to the surface of the discharge roller 56, the other part upstream of the same is flat in order to guide a sheet stack toward the shift outlet roller 6. In this condition, the mechanism is ready to convey a sheet stack to the conveying path C. More specifically, the movable guide 55 is sufficiently retracted from the route along which a sheet stack is to be conveyed from the staple tray F to the conveying path C.

FIG. 12 shows a condition wherein the guide plate 54 is moved about the fulcrum 54*a* counterclockwise (downward) by the cam 61 with the press roller 57 pressing the discharge roller 56. As shown in FIG. 12, when the cam 61 rotates clockwise, it causes the guide plate 54 to move from the opening position to the pressing position along the cam surface 61*a* of the cam 61. As the cam 61 further rotates clockwise, its cam surface 61*b* raises the link arm 60 and thereby causes the movable guide 55 to move.

FIG. 13 shows a condition wherein the cam 61 has further rotated from the above position to move the movable guide 55 clockwise (upward). In this condition, the guide plate 54 and movable guide 55 form the route extending from the staple tray F toward the fold tray G. FIG. 6 shows the same relation as seen in the direction of depth.

In the condition shown in FIG. 11, a sheet stack positioned and stapled on the staple tray F can be delivered to the shift tray 202 while, in the condition shown in FIG. 13, the sheet stack can be delivered to the fold tray G. The guide surface 55*a* of the movable guide 55 can block the space in which the guide 55 is movable, allowing a sheet stack to be smoothly delivered to the fold tray G. In this manner, the guide plate 54 and movable plate 55 are sequentially moved in this order while overlapping each other, forming a smooth path for conveyance.

Although the path selectors 15 and 16 shown in FIG. 2 are capable of switching the conveyance path, they do not exert a conveying force themselves. Therefore, when the selector 15 or 16 steers a stack of several sheets or several ten sheets by a large angle, the sheet stack is apt to jam the path due to a difference in friction between the outer surface and the inner surface.

While in the illustrative embodiment the guide plate 54 and movable guide 55 share a single drive motor, each of them may be driven by a respective drive motor, so that the timing of movement and stop position can be controlled in accordance with the sheet size and the number of sheets stapled together.

<Sheet Folding Tray>

The fold tray G will be described specifically with reference to FIGS. 14 and 15. As shown, the fold tray G includes the fold plate 74 for folding a sheet stack at the center. The fold plate 74 is formed with elongate slots 74*a*, each of which being movably received in one of pins 64*c* studded on each of the front and rear frame plates 64*a* and 64*b*. A pin 74*b* studded on the fold plate 74 is movably received in an elongate slot 76*b* formed in a link arm 76. The link arm 76 is angularly movable about a fulcrum 76*a*, causing the fold plate 74 to move in the right-and-left direction as viewed in FIGS. 14 and 15. More specifically, a pin 75*b* studded on a fold plate cam 75 is movably received in an elongate slot 76*c* formed in the link arm 76. In this condition, the link arm 76 angularly moves in accordance with the rotation of the fold plate cam 75, causing the fold plate 74 to move back and forth perpendicularly to a lower guide plate 91 and an upper guide plate 92 (see FIGS. 2 and 16).

To fold a sheet stack at the center, the center of the sheet stack should be coincident with a folding position assigned to the fold plate 74. For this purpose, in the illustrative embodiment, a movable rear fence 73 is included in the lower guide plate 91 such that the trailing edge of a folded sheet stack (leading edge when the sheet stack is to be conveyed) rests on the movable rear fence 73. The movable rear fence 73 is movable upward or downward to bring the center of the sheet stack resting thereon to the folding position.

Figure 14:
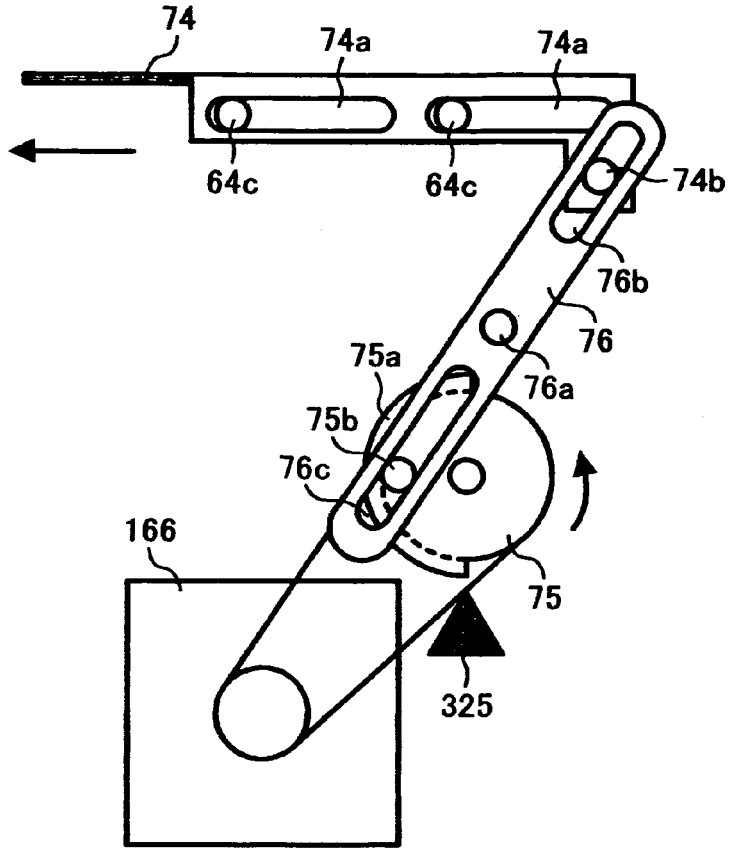
FIGS. 14 and 15 are side views demonstrating the consecutive operating conditions of a fold plate included in the sheet finishing apparatus.

A fold plate motor 166 causes the fold plate cam 75 to rotate in a direction indicated by an arrow in FIG. 14. The stop position of the fold plate cam 75 is determined on the basis of the output of a fold plate HP sensor 325 responsive to the opposite ends of a semicircular interrupter portion 75*a* included in the cam 75.

FIG. 14 shows the fold plate 74 in the home position where the fold plate 74 is fully retracted from the sheet stack storing range of the fold tray G. When the fold plate cam 75 is rotated in the direction indicated by the arrow, the fold plate 74 is moved in the direction indicated by an arrow and enters the sheet stack storing range of the fold tray G.

Figure 15:
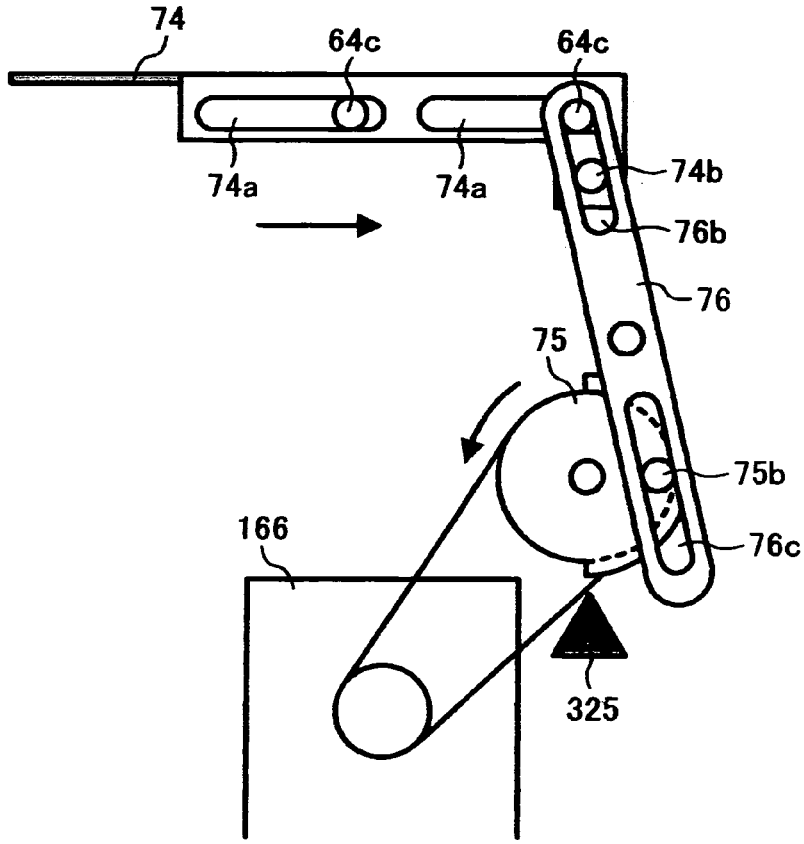

FIG. 15 shows a position where the fold plate 74 pushes the center of a sheet stack on the fold tray G into the nip between the first fold roller pair 81. When the fold plate cam 75 is rotated in a direction indicated by an arrow in FIG. 15, the fold plate 74 moves in a direction indicated by an arrow out of the sheet stack storing range.

While the illustrative embodiment is assumed to fold a sheet stack at the center, it is capable of folding even a single sheet at the center. In such a case, because a single sheet does not have to be stapled at the center, it is fed to the fold tray G as soon as it is driven out, folded by the fold plate 74 and the first fold roller pair 81, and then delivered to the lower tray 203, as shown in FIG. 2.

<Control Unit>

Figures 17, 17A:
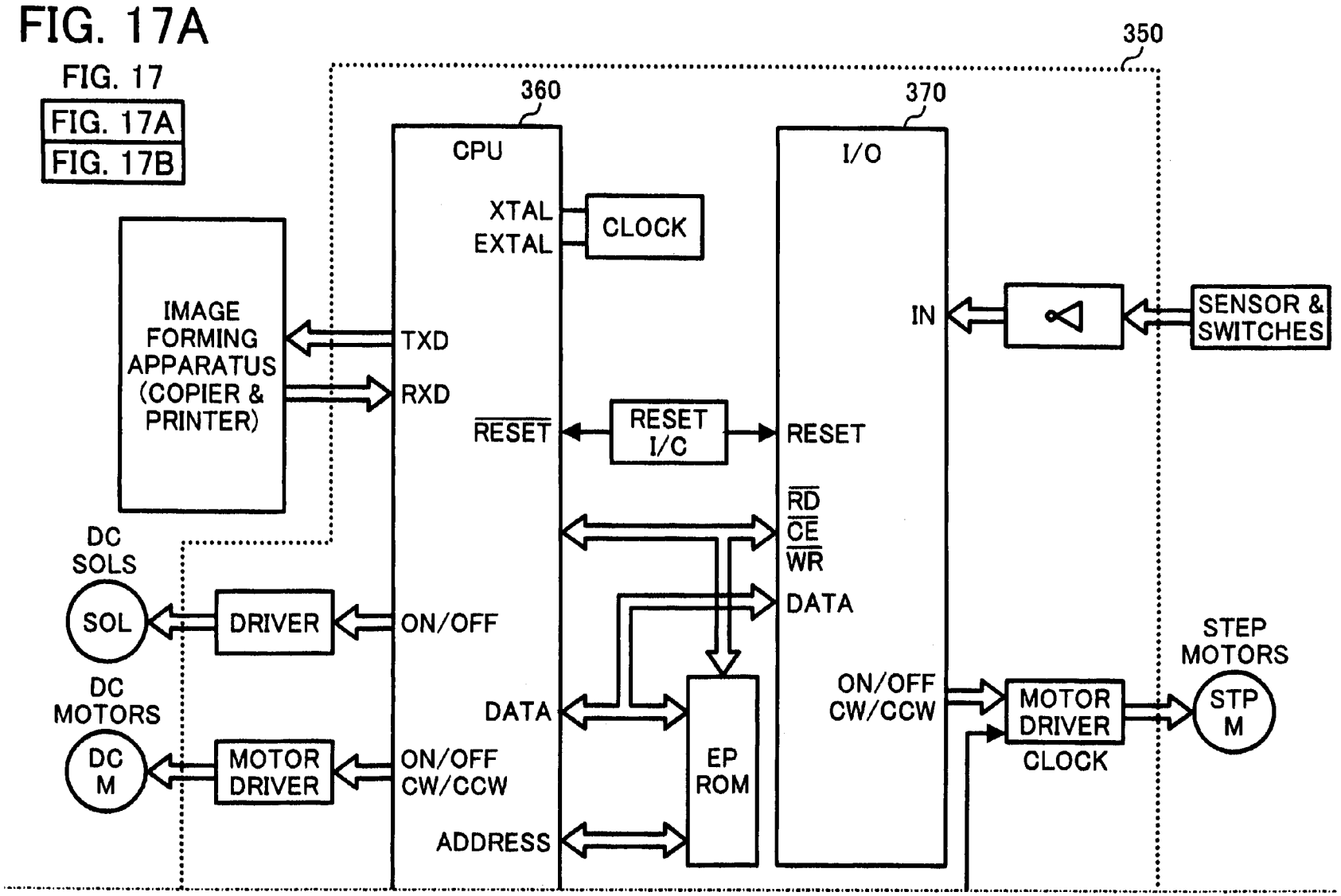
FIGS. 17A and 17B are schematic block diagrams showing a control system included in the image forming system, particularly control circuitry assigned to the sheet finishing apparatus.
Figure 17B:
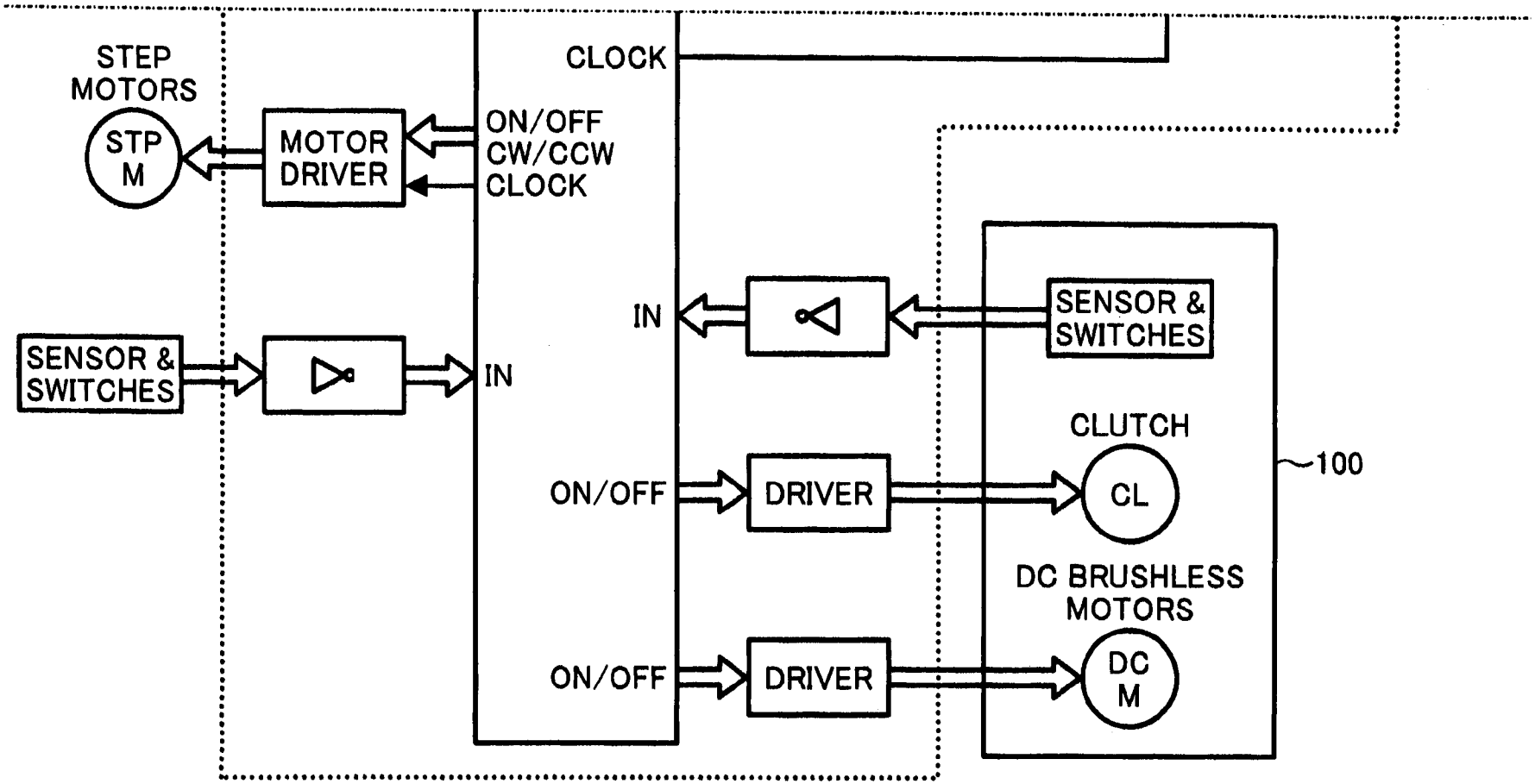

Reference will be made to FIG. 17 for describing a control system included in the illustrative embodiment. As shown, the control system includes the control unit 350 implemented as a microcomputer including a CPU (Central Processing Unit) 360 and an I/O (Input/Output) interface 370. The outputs of various switches arranged on a control panel, not shown, mounted on the image forming apparatus PR are input to the control unit 350 via the I/O interface 370. Also, the inputs to the control unit 350 via the I/O interface 370 are the output of the inlet sensor 301 (shown in FIG. 2), the output of an upper outlet sensor 302 (shown in FIG. 2), the output of the shift outlet sensor 303 (shown in FIG. 2), the output of a prestack sensor 304 (shown in FIG. 2), the output of a staple discharge sensor 305 (shown in FIGS. 2 and 7), the output of the sheet sensor 310 (shown in FIGS. 2, 6 and 7), the output of the belt HP sensor 311 (shown in FIGS. 2 and 7), the output of the staple HP sensor 312 (shown in FIG. 9), the output of the stapler oblique HP sensor 313 (shown in FIG. 10), the output of a jogger fence HP sensor (not shown), the output of the guide home position sensor 315 (shown in FIGS. 11 through 13), the output of a stack arrival sensor 321 (shown in FIG. 16), the output of a movable rear fence HP sensor 322 (shown in FIGS. 2 and 16), the output of a fold position pass sensor 323 (shown in FIGS. 2 and 16), the output of a lower outlet sensor (not shown), the output of the fold plate HP sensor 325 (shown in FIGS. 14 and 15), the output of the sheet surface sensors 330 (shown in FIGS. 2 and 4), 330*a* and 330*b* (both shown in FIG. 4), and the output of the guide plate sensor 331 (shown in FIG. 5).

A CPU 360 serving as a controller controls the drive of solenoids such as the knock solenoid (SOL) 170 (shown in FIG. 7) and the motors of the sheet finishing apparatus PD based on the above various input signals. The motors of the sheet finishing apparatus PD of the present exemplary embodiment include the tray motor 168 (shown in FIG. 4) assigned to the shift tray 202, the guide plate motor 167 (shown in FIG. 5) assigned to the guide plate 33, the shift motor 169 (shown in FIG. 3) assigned to the shift tray 202, a knock roller motor (not shown) assigned to the knock roller 12, conveyer motors for driving the conveyor rollers, outlet motors for driving the outlet rollers, the discharge motor 157 (shown in FIG. 6) assigned to the discharge belt 52, the jogger motor 158 (shown in FIG. 7) assigned to the jogger fences 53, the stapler motor 159 (shown in FIG. 9) assigned to the edge stapler S1, the motor 160 (shown in FIG. 10) assigned to the edge stapler S1, the steer motor 161 (shown in FIG. 11) assigned to the guide plate 54 and movable guide 55, a motor (not shown) assigned to rollers for conveying a sheet stack, a rear fence motor (not shown) assigned to the movable rear fence 73, the fold plate motor 166 (shown in FIGS. 14 and 15) assigned to the fold plate 74, a fold motor (not shown)

assigned to upper and lower rollers 71 and 72 (shown in FIGS. 2 and 16), the first fold roller pair 81, and lower outlet rollers 83 (described below). Pulse signals of a staple conveyor motor (not shown) assigned to the staple outlet rollers 11 are input to the CPU 360 and counted thereby. The CPU 360 controls the knock solenoid 170 and the jogger motor 158 in accordance with the number of pulse signals counted. The fold roller motor is implemented by a stepping motor and controlled by the CPU 360 either directly via a motor driver or indirectly via the I/O 370 and motor driver.

Further, each of the CPU 360 causes the punch unit 100 to operate by controlling a clutch or a motor. The CPU 360 controls the finishing apparatus PD in accordance with a program stored in a ROM (Read Only Memory), not shown, by using a RAM (Random Access Memory), not shown, as a work area.

<Operations of the Control Unit>

Specific operations to be executed by the CPU 360 in various modes available with the illustrative embodiment will be described hereinafter.

(1) Non-Staple Mode A

First, in a non-staple mode A, a sheet is conveyed via the sheet conveying paths A and B to the upper tray 201 without being stapled. To implement this mode, the path selector 15 is moved clockwise, as viewed in FIG. 2, to unblock the sheet conveying path B. The operation of the CPU 360 in the non-staple mode will be described with reference to FIG. 18.

Figure 18:
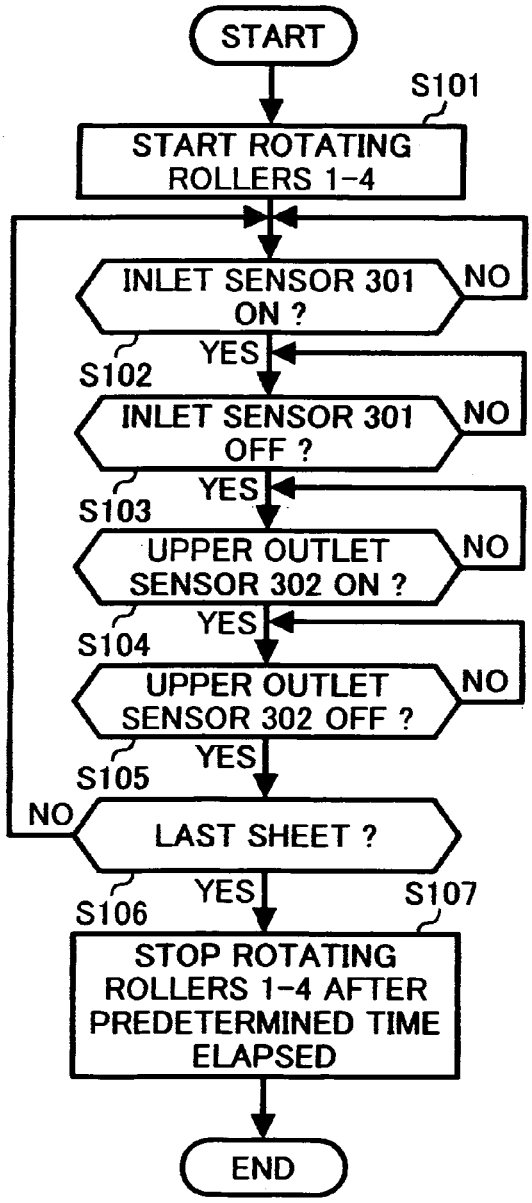
FIG. 18 is a flowchart demonstrating a non-staple mode A available with the sheet finishing apparatus.

As shown in FIG. 18, before a recording sheet driven out of the image forming apparatus PR enters the finishing apparatus PD, the CPU 360 causes the inlet roller pair 1 and the conveyor roller pair 2 on the sheet conveying path A and a conveyor roller pair 3 and an upper outlet roller pair 4 on the sheet conveying path B to start rotating in step S101. The CPU 360 then checks whether the inlet sensor 301 is turned on in step S102. When the inlet sensor 301 is turned on, the result of step S102 is YES, and the process proceeds to step S103. When the inlet sensor 301 is not turned on, the result of step S102 is NO, and the process repeats the procedure until the result of step S102 becomes YES. Then, the CPU 360 checks whether then inlet sensor 301 is turned off in step S103. When the inlet sensor 301 is turned off, the result of step S103 is YES, and the process proceeds to step S104. When the inlet sensor 301 is not turned off, the result of step S103 is NO, and the process repeats the procedure until the result of step S103 becomes YES.

In step S104, the CPU 360 checks whether the upper outlet sensor 302 is turned on for thereby confirming the passage of recording sheets. When the upper outlet sensor 302 is turned on, the result of step S104 is YES, and the process proceeds to step S105. When the upper outlet sensor 302 is not turned on, the process repeats the procedure until the result of step S104 becomes YES. Then, the CPU 360 checks whether the upper outlet sensor 302 is turned off in step S105. When the upper outlet sensor 302 is turned off, the result of step S105 is YES, and the process proceeds to step S106. When the upper outlet sensor 302 is not turned off, the process repeats the procedure until the result of step S105 becomes YES.

In step S106, the CPU 360 determines whether the last sheet has passed. When the last sheet has passed, the result of step S106 is YES, and the process proceeds to step S107. When the last sheet has not passed yet, the result of step S106 is NO, and the process goes back to step S102.

In step S107, when a preselected period at time elapses since the passage of the last sheet, the result of step S106 is YES, and the CPU 360 causes the above-described rollers 1, 2, 3, and 4 to stop rotating, and completes the operation procedure. In this manner, all the sheets handed over from the image forming apparatus PR to the finishing apparatus PD are sequentially stacked on the upper tray 201 without being stapled. If desired, the punch unit 100, which intervenes between the inlet roller pair 1 and conveyor roller pair 2, may punch the consecutive sheets.

<Non-Staple Mode B>

In a non-staple mode B, the recording sheets are routed through the sheet conveying paths A and C to the shift tray 202. In this mode, the path selectors 15 and 16 are respectively moved counterclockwise and clockwise, unblocking the sheet conveying path C. The non-staple mode B will be described with reference to FIG. 19.

Figure 19:
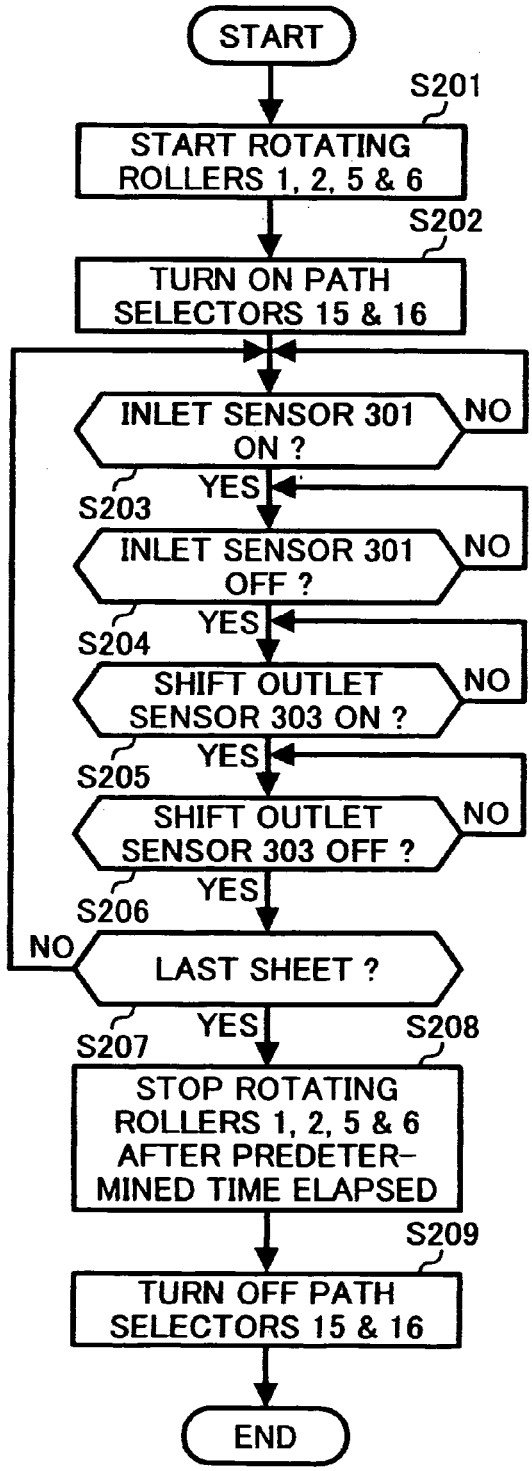
FIG. 19 is a flowchart demonstrating a non-staple mode B available with the sheet finishing apparatus.

As shown in FIG. 19, before a recording sheet driven out of the image forming apparatus PR enters the finishing apparatus PD, the CPU 360 causes the inlet roller pair 1 and conveyor roller pair 2 on the sheet conveying path A and a conveyor roller pair 5 and the shift outlet roller pair 6 on the sheet conveying path C to start rotating in step S201. The CPU 360 then turns on the solenoids assigned to the path selectors 15 and 16 in step S202 to thereby move the path selectors 15 and 16 counterclockwise and clockwise, respectively. Subsequently, the CPU 360 checks whether the inlet sensor 301 is turned on in step S203. When the inlet sensor 301 is turned on, the result of step S203 is YES, and the process proceeds to step S204. When the inlet sensor 301 is not turned off, the result of step S203 is NO, and the process repeats the procedure until the result of step S203 becomes YES. Then, the CPU 360 determines whether the inlet sensor 301 is turned off in step S204. When the inlet sensor 301 is turned off, the result of step S204 is YES, and the process proceeds to step S205. When the inlet sensor 301 is not turned off, the result of step S204 is NO, and the process repeats the procedure until the result of step S204 becomes YES.

After step S204, the CPU 360 checks the shift outlet sensor 303 is turned on in step S205. When the shift outlet sensor 303 is turned on, the result of step S205 is YES, and the process proceeds to step S206. When the shift outlet sensor 303 is not turned on, the result of step S205 is NO, and the process repeats the procedure until the result of step S205 becomes YES. Then, the CPU 360 checks whether the shift outlet sensor 303 is turned off in step S206 to thereby confirm the passage of the sheets. When the result of step S206 is YES, the process proceeds to step S207. When the result of step S206 is NO, the process repeats the procedure until the result of step S206 becomes YES.

In step S207, the CPU 360 determines whether the last sheet has passed. When the last sheet has passed, the result of step S207 is YES, and the process proceeds to step S208. When the last sheet has not passed yet, the result of step S207 is NO, and the process goes back to step S203.

When a preselected period of time elapses since the passage of the last sheet in step S207, the CPU 360 causes the various rollers 1, 2, 5, and 6 to stop rotating in step S208, and turns off the solenoids or path selectors 15 and 16 in step S209. In this manner, all the sheets that have entered the finishing apparatus PD are sequentially stacked on the shift tray 202 without being stapled. Again, the punch unit 100 intervening between the inlet roller pair 1 and conveyor roller pair 2 may punch the consecutive sheets, if desired.

<Sort/Stack Mode>

In a sort/stack mode, the recording sheets are also sequentially delivered from the sheet conveying path A to the shift tray 202 via the sheet conveying path C. A difference is that the shift tray 202 is shifted perpendicularly to the direction of sheet discharge copy by copy in order to sort the recording sheets. The path selectors 15 and 16 are respectively rotated counterclockwise and clockwise as in the non-staple mode B, thereby unblocking the sheet conveying path C. The sort/stack mode will be described with reference to FIG. 20.

Figure 20:
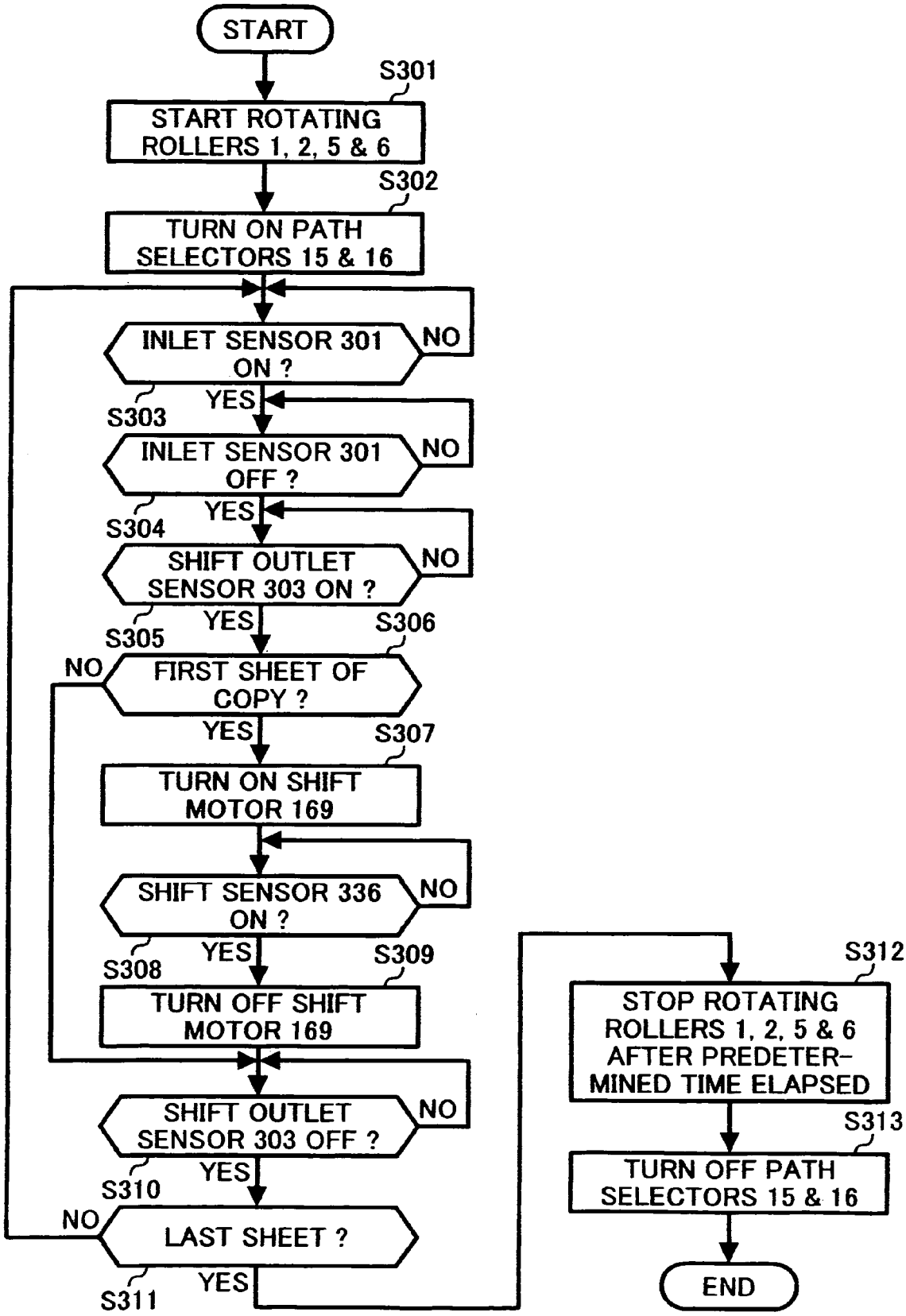
FIG. 20 is a flowchart demonstrating a sort/stack mode available with the sheet finishing apparatus.

As shown in FIG. 20, before a recording sheet driven out of the image forming apparatus PR enters the finishing apparatus PD, the CPU 360 causes the inlet roller pair 1 and conveyor roller pair 2 on the sheet conveying path A and the conveyor roller pair 5 and shift outlet roller pair 6 on the sheet conveying path C to start rotating in step S301. The CPU 360 then turns on the solenoids assigned to the path selectors 15 and 16 in step S302 to thereby move the path selectors 15 and 16 counterclockwise and clockwise, respectively. Subsequently, the CPU 360 checks whether the inlet sensor 301 is turned on in step S303. When the inlet sensor 301 is turned on, the result of step S303 is YES, the process proceeds to step S304. When the inlet sensor 301 is not turned on, the result of step S303 is NO, and the process repeats the procedure until the result of step S303 becomes YES. Then, the CPU 360 checks whether the inlet sensor 301 is turned off in step S304. When the inlet sensor 301 is turned off, the result of step S304 is YES, and the process proceeds to step S305. When the inlet sensor 301 is not turned off, the result of step S304 is NO, and the process repeats the procedure until the result of step S304 becomes YES. After step S304, the CPU 360 checks if the shift outlet sensor 303 is turned on in step S305. When the result of step S305 is YES, the process goes to step S306. When the result of step S305 is NO, the process repeats the procedure until the result of step S305 becomes YES.

In step S306, the CPU 360 determines whether the recording sheet that has passed the shift outlet sensor 303 is the first sheet of a copy. When the result of step S306 is YES, the process proceeds to step S307. When the result of step S306 is NO, the process goes to step S310.

In step S307, the CPU 360 turns on the shift motor 169 in step S307 to thereby move the shift tray 202 perpendicularly to the direction of sheet conveyance until the shift sensor 336 senses the tray 202 is turned on in step S308. When the result of step S308 is YES, the process goes to step s309. When the result of step S308 is NO, the process repeats the procedure until the result of step S308 becomes YES. The CPU 360 then turns off the shift motor 169 in step S309. After step S309, the CPU 360 determines whether the recording sheet moves away from the shift outlet sensor 303 in step S310. When the sheet moves away from the shift outlet sensor 303, the result of step S310 is YES, and the CPU 360 then determines whether or not the recording sheet is the last sheet in step S311. When the result of step S310 is NO, the process repeats the procedure until the result of step S310 becomes YES. When the recording sheet is the last sheet, the result of step S311 is YES, and the process goes to step S312. When the recording sheet is not the last sheet of a copy, the result of step S311 is NO, and the process goes back to step S303.

In step S312, the CPU 360 causes, on the elapse of a preselected period of time, the inlet roller pair 1, conveyor roller pairs 2 and 5 and shift outlet roller pair 6 to stop rotating in step S312, and turns off the solenoids assigned to the path selectors 15 and 16 in step S313. In this manner, all the recording sheets that have sequentially entered the finishing apparatus PD are sorted and stacked on the shift tray 202 without being stapled. Also in this mode, the punch unit 100 may punch the consecutive sheets, if desired.

<Staple Mode>

In a staple mode, the sheets are conveyed from the path A to the staple tray F via the sheet conveying path D, positioned and stapled on the staple tray F, and then discharged to the shift tray 202 via the sheet conveying path C. In this mode, the path selectors 15 and 16 both are rotated counterclockwise to unblock the route extending from the sheet conveying path A to the sheet conveying path D. The staple mode will be described with reference to FIGS. 21A and 21B.

Figures 21, 21A, 21B:
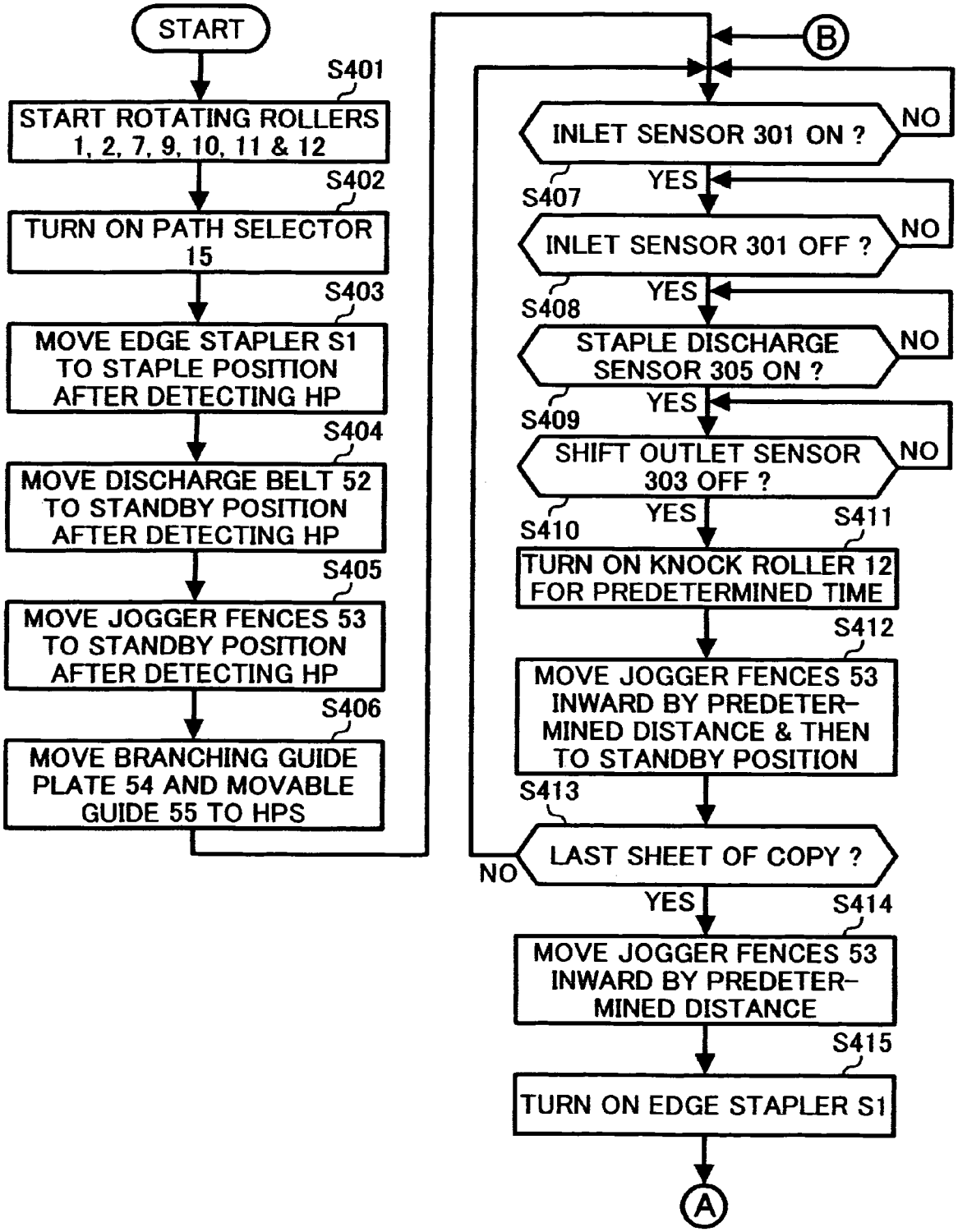
FIGS. 21A and 21B are flowcharts demonstrating a staple mode available with the sheet finishing apparatus.
Figure 21B:
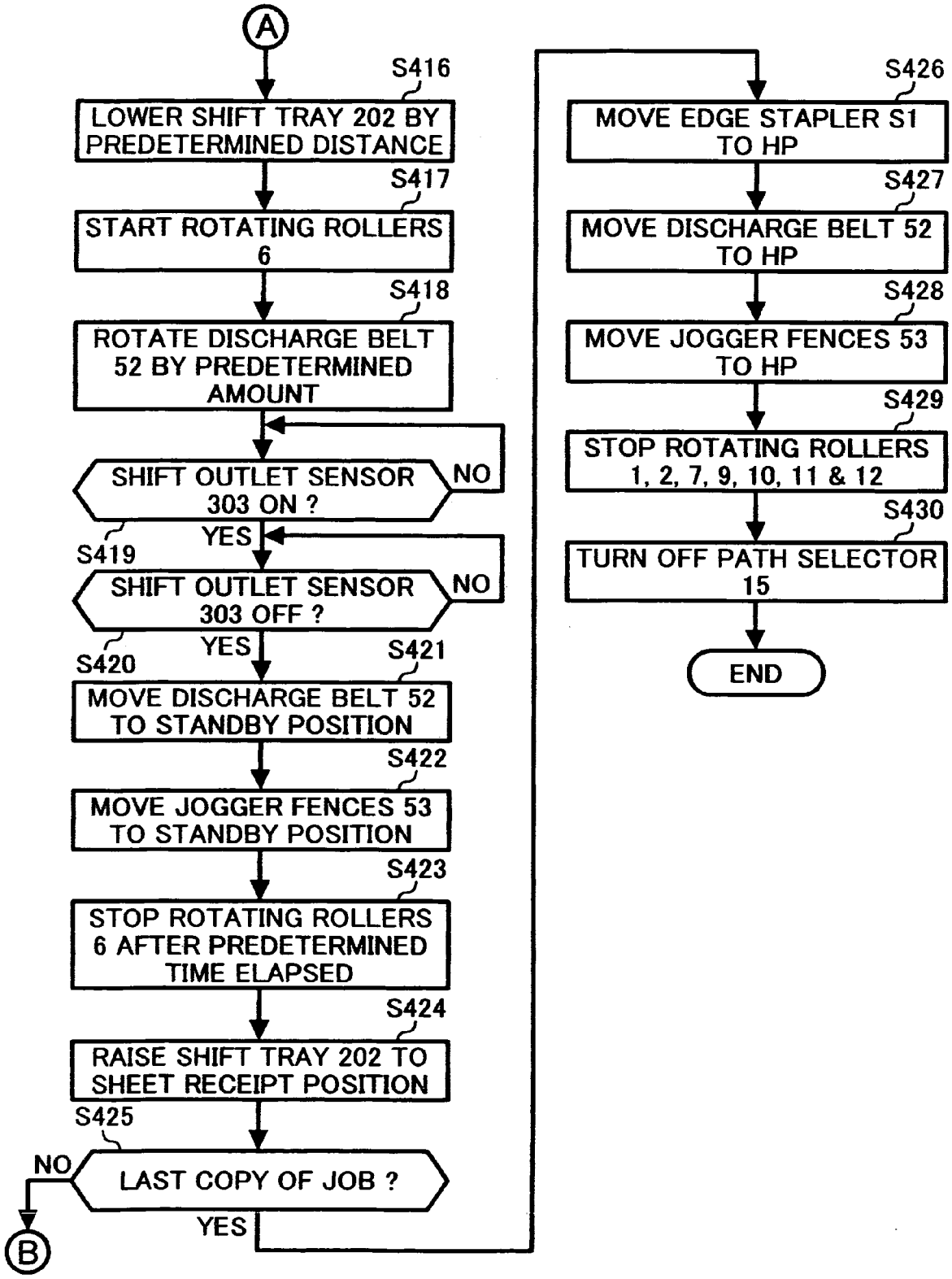

As shown in FIGS. 21A and 21B, before a recording sheet driven out of the image forming apparatus PR enters the finishing apparatus PD, the CPU 360 causes the inlet roller pair 1 and conveyor roller pair 2 on the sheet conveying path A and a conveyor roller pair 7, the conveyor roller pairs 9 and 10, and staple outlet roller 11 on the sheet conveying path D and knock roller 12 to start rotating in step S401. The CPU 360 then turns on the solenoid assigned to the path selector 15 in step S402 to thereby cause the path selector 15 to rotate counterclockwise.

After the stapler HP sensor 312 has sensed the edge stapler S1 at the home position, the CPU 360 drives the stapler motor 159 to move the edge stapler S1 to a preselected stapling position in step S403. Also, after the belt HP sensor 311 has sensed the discharging discharge belt 52 at the home position, the CPU 360 drives the discharge motor 157 to bring the discharging discharge belt 52 to a stand-by position in step S404. Further, after the jogger fence motor HP sensor (not shown) has sensed the jogger fences 53 at the home position, the CPU 360 moves the jogger fences 53 to a stand-by position in step S405. In addition, the CPU 360 causes the guide plate 54 and movable guide 55 to move to their home positions in step S406.

In step S407, the CPU 360 determines whether the inlet sensor 301 has turned on. When the inlet sensor 301 has turned on, the result of step S407 is YES, and the process proceeds to step S408. When the inlet sensor 301 has not turned on, the result of step S407 is NO, and the process repeats the procedure until the result of step S407 becomes YES. In step S408, the CPU 360 determines whether the inlet sensor 301 has turned off. When the inlet sensor 301 has turned off, the result of step S408 is YES, and the process proceeds to step S409. When the inlet sensor 301 has not turned off, the result of step S408 is NO, and the process repeats the procedure until the result of step S408 becomes YES.

In step S409, the CPU 360 determines whether the staple discharge sensor 305 has turned on. When the staple discharge sensor 305 has turned on, the result of step S409 is YES, and the process proceeds to step s410. When the result of step S409 is NO, the process repeats the procedure until the result of step S409 becomes YES.

In step S410, the CPU 360 determines whether the staple discharge sensor 305 has turned off. When the staple discharge sensor 305 has turned off, the result of step S410 is YES, and the process proceeds to step S411. When the staple discharge sensor 305 has not turned off, the result of step S410 is NO, and the process repeats the procedure until the result of step S410 becomes YES.

In step S411, a recording sheet is present on the staple tray F. In this case, the CPU 360 turns on the knock solenoid 170 for a preselected period of time to cause the knock roller 12 to contact the recording sheet and force it against the rear fences 51, thereby positioning the rear edge of the sheet. Subsequently in step S412, the CPU 360 drives the jogger motor 158 to move each jogger fence 53 inward by a preselected distance for thereby positioning the sheet in the direction of width perpendicular to the direction of sheet conveyance and then returns the jogger fence 53 to the stand-by position. In step S413, the CPU 360 determines whether the last sheet of a copy arrives at the staple tray F. When the last sheet has arrived, the result of step S413 is YES, and the process proceeds to step S414. When the last sheet has not arrived yet, the result of step S413 is NO, and the process goes back to step S407.

In step S414, the CPU 360 moves the jogger fences 53 inward to a position where they prevent the edges of the sheets from being dislocated. In this condition, the CPU 360 turns on the edge stapler S1 and causes it to staple the edge of the sheet stack in step S415.

In step S416, the CPU 360 lowers the shift tray 202 by a preselected amount in order to produce a space for receiving the stapled sheet stack. The CPU 360 then drives the shift discharge roller pair 6 via the shift discharge motor in step S417, and the discharge belt 52 by a preselected amount via the discharge motor 157 in step S418, so that the stapled sheet stack is raised toward the sheet conveying path C. As a result, the stapled sheet stack is driven out to the shift tray 202 via the shift outlet roller pair 6.

In step S419, the CPU 360 checks whether the shift outlet sensor 303 has turned on. When the shift outlet sensor 303 has turned on, the result of step S419 is YES, and the process proceeds to step S420. When the shift outlet sensor 303 has not turned on, the result of step s419 is NO, and the process repeats the procedure until the result of step S419 becomes YES. Then, the CPU 360 checks in step S420 whether the shift outlet sensor 303 has turned off. When the shift outlet sensor 303 has turned off, the result of step S420 is YES, the process proceeds to step S421. When the shift outlet sensor 303 has not turned off, the result of step S420 is NO, and the process repeats the procedure until the result of step S420 becomes YES.

In step S421, the sheet stack has moved away from the sensor 303. In this case, the CPU 360 moves the discharge belt 52 to its stand-by position. The CPU 360 then moves the jogger fences 53 to its stand-by position in step S422.

After step S422, the CPU 360 causes the shift outlet roller pair 6 to stop rotating on the elapse of a preselected period of time in step S423, and then raises the shift tray 202 to a sheet receiving position in step S424. The rise of the shift tray 202 is controlled in accordance with the output of the sheet surface sensor 330 responsive to the top of the sheet stack positioned on the shift tray 202.

The CPU 360 then determines whether or not the discharged sheet is the last copy or set of sheets in step S425. When the discharged sheet is the last copy, the result of step S425 is YES, and the process proceeds to step S426. When the discharged sheet is not the last copy, the result of step S425 is NO, and the process goes back to step s407.

Then, the CPU 360 moves the edge stapler S1 to its home position in step S426. In step S427, the CPU 360 moves the discharge belt 52 to its home position. And, in step S428, the CPU 360 moves the jogger fences 53 in to its home position.

After step S428, the CPU 360 causes the inlet roller pair 1, conveyor roller pairs 2, 7, 9 and 10, staple discharge roller pair 11 and knock roller 12 to stop rotating in step S429. Further, the CPU 360 turns off the solenoid assigned to the path selector 15 in step S430. Consequently, all the structural parts are returned to their initial positions. In this case, too, the punch unit 100 may punch the consecutive sheets before stapling.

The operation of the staple tray F in the staple mode will be described more specifically hereinafter.

As shown in FIG. 7, when the staple mode is selected, the jogger fences 53 each are moved from the home position to a stand-by position 7 mm short of one end of the width of sheets to be stacked on the staple tray F (step S405). When a sheet being conveyed by the staple discharge roller pair 11 passes the staple discharge sensor 305 (step S409), the jogger fence 53 is moved inward from the stand-by position by 5 mm.

The staple discharge sensor 305 senses the trailing edge of the sheet and sends its output to the CPU 360. In response, the CPU 360 starts counting drive pulses input to the staple motor (not shown) driving the staple discharge roller pair 11. On counting a preselected number of pulses, the CPU 360 energizes the knock solenoid 170 (step S412). The knock solenoid 170 causes the knock roller 12 to contact the sheet and force it downward when energized, so that the sheet is positioned by the rear fences 51. Every time a sheet to be stacked on the staple tray F passes the inlet sensor 301 or the staple discharge sensor 305, the output of the sensor 301 or 305 is sent to the CPU 360, causing the CPU 360 to count the sheet.

On the elapse of a preselected period of time since the knock solenoid 170 has been turned off, the CPU 360 causes the jogger motor 158 to move each jogger fence 53 further inward by 2.6 mm and then stop it, thereby positioning the sheet in the direction of width. Subsequently, the CPU 360 moves the jogger fence 53 outward by 7.6 mm to the stand-by position and then waits for the next sheet (step S412). The CPU 360 repeats such a procedure up to the last page (step S413). The CPU 360 again causes the jogger fences 53 to move inward by 7 mm and then stop (step S414), thereby causing the jogger fences 53 to retain the opposite edges of the sheet stack to be stapled. Subsequently, on the elapse of a preselected period of time, the CPU 360 drives the edge stapler S1 via the staple motor for thereby stapling the sheet stack (step S415). If two or more stapling positions are designated, after stapling at one position the CPU 360 moves the edge stapler S1 to another designated position along the rear edge of the sheet stack via the stapler motor 159. At this position, the edge stapler S1 again staples the sheet stack. This movement is repeated when three or more stapling positions are designated.

After the stapling operation, the CPU 360 drives the discharge belt 52 via the discharge motor 157 (step S418). At the same time, the CPU 360 drives the outlet motor to cause the shift outlet roller pair 6 to start rotating in order to receive the stapled sheet stack lifted by the hook 52*a* (step S417). At this instant, the CPU 360 controls the jogger fences 53 in a different manner in accordance with the sheet size and the number of sheets stapled together. For example, when the number of sheets stapled together or the sheet size is smaller than a preselected value, then the CPU 360 causes the jogger fences 53 to constantly retain the opposite edges of the sheet stack until the hook 52*a* fully lifts the rear edge of the sheet stack. When a preselected number of pulses are output since the turn-on of the sheet sensor 310 or the belt HP sensor 311, the CPU 360 causes the jogger fences 53 to retract by 2 mm and release the sheet stack. The preselected number of pulses corresponds to an interval between the time when the hook 52*a* contacts the trailing edge of the sheet stack and the time when it moves away from the upper ends of the jogger fences 53.

On the other hand, when the number of sheets stapled together or the sheet size is larger than the preselected value, the CPU 360 causes the jogger fences 53 to retract by 2 mm beforehand. In any case, as soon as the stapled sheet stack moves away from the jogger fences 53, the CPU 360 moves the jogger fences 53 further outward by 5 mm to the stand-by positions (step S422) for thereby preparing it for the next sheet. If desired, the restraint to act on the sheet stack may be controlled on the basis of the distance of each jogger fence from the sheet stack.

<Center Staple and Bind Mode>

Figure 25:
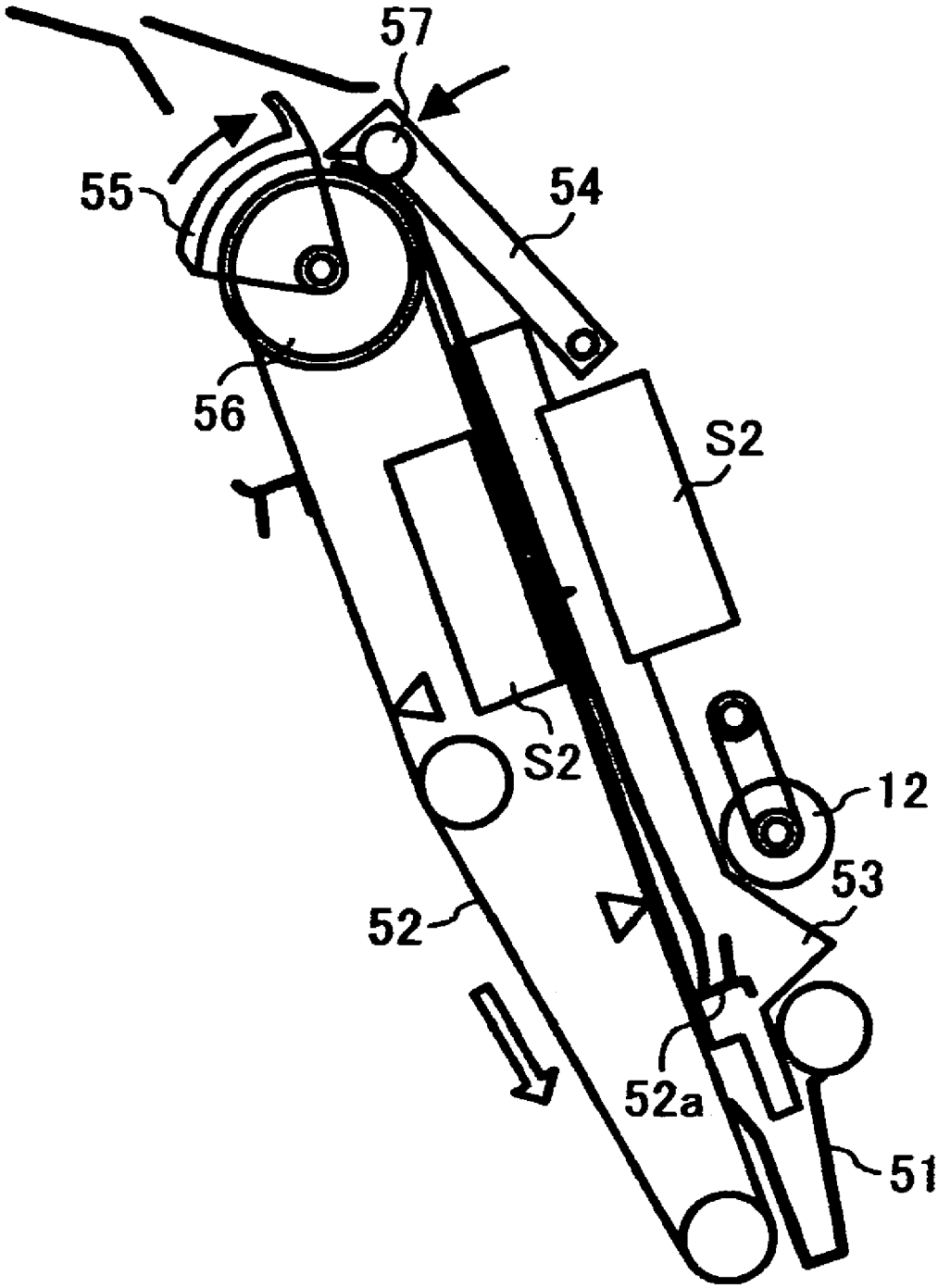
FIG. 25 is a side view illustrating the initial condition wherein the sheet stack steering mechanism steers a sheet stack stapled at the center on the staple tray in the center staple and fold mode.

In a center staple and bind mode, the recording sheets are sequentially conveyed from the sheet conveying path A to the staple tray F via the path D, positioned and stapled at the center on the tray F, folded on the fold tray G, and then driven out to the lower tray 203 via the sheet conveying path H. In this mode, the path selectors 15 and 16 both are rotated counterclockwise to unblock the route extending from the sheet conveying path A to the sheet conveying path D. Also, the guide plate 54 and movable guide plate 55 are closed, as shown in FIG. 25, guiding the stapled sheet stack to the fold tray G. The center staple and bind mode will be described with reference to FIGS. 22A and 22B.

Figure 22A:
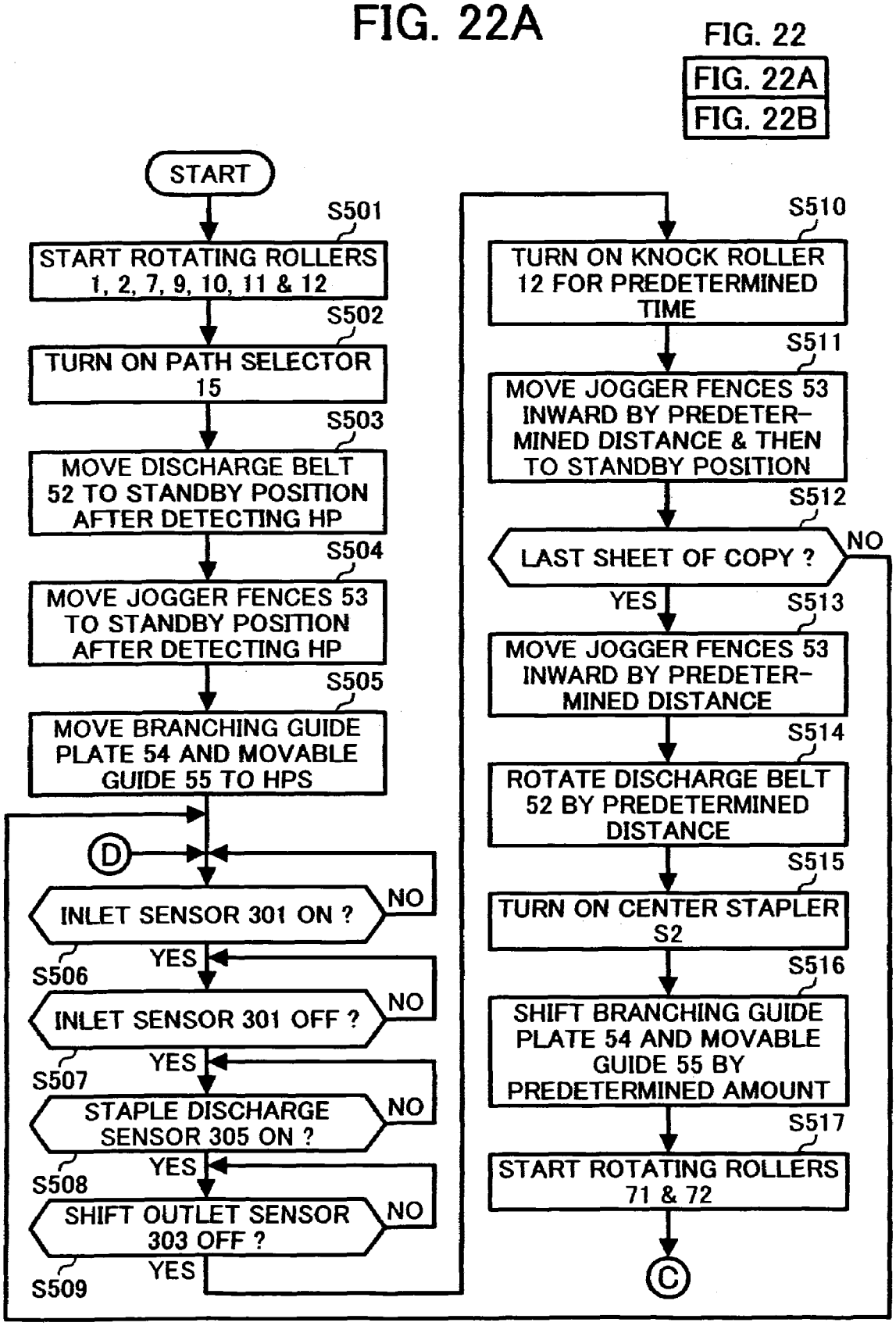
FIGS. 22A and 22B are flowcharts demonstrating a center staple mode and fold mode available with the sheet finishing apparatus.
Figure 22B:
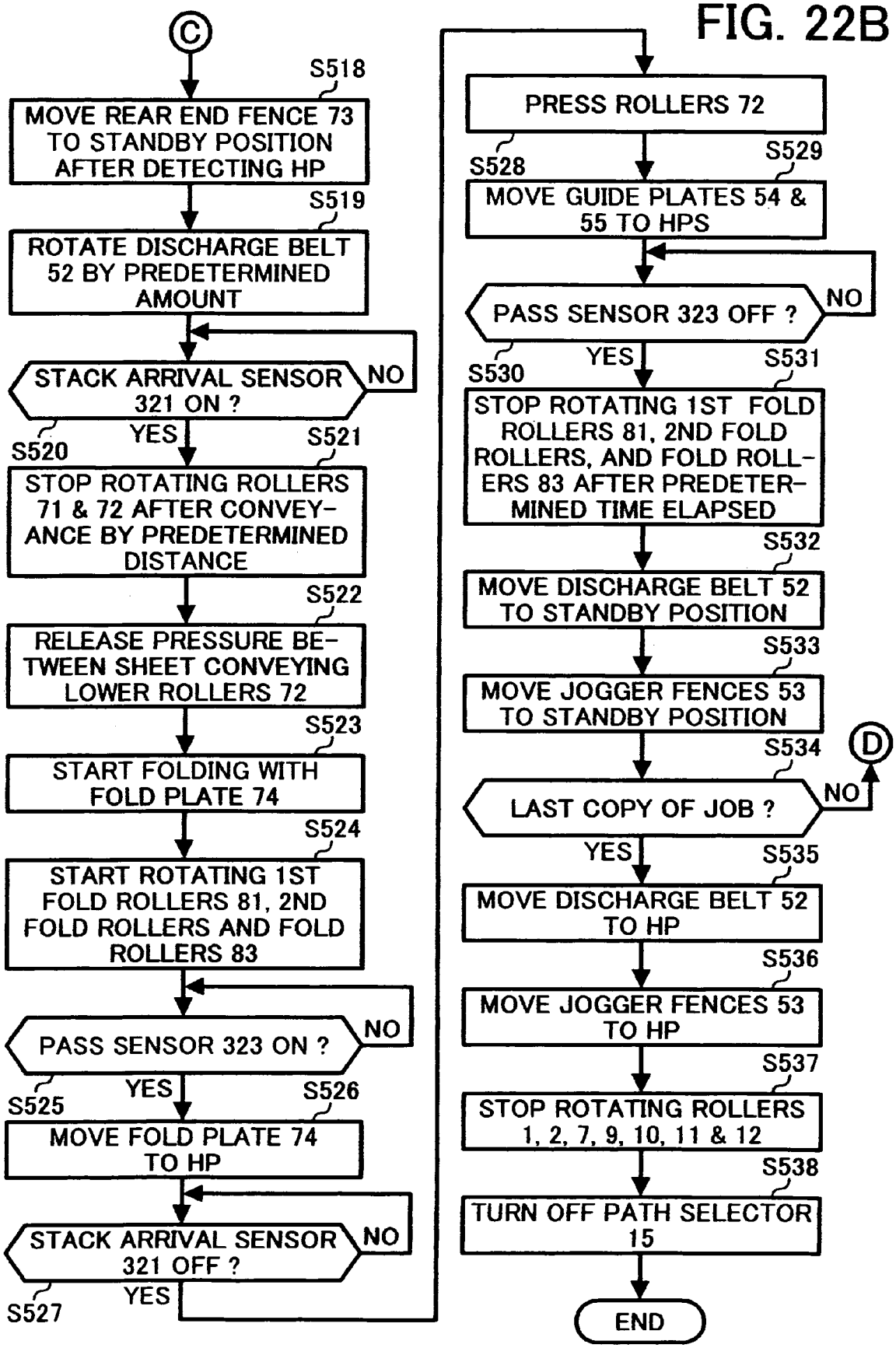

As shown in FIGS. 22A and 22B, before a recording sheet driven out of the image forming apparatus PR enters the finishing apparatus PD, the CPU 360 causes the inlet roller pair 1 and conveyor roller pair 2 on the sheet conveying path A and the conveyor roller pairs 7, 9 and 10 and staple outlet roller 11 on the sheet conveying path D and knock roller 12 to start rotating in step S501. The CPU 360 then turns on the solenoid assigned to the path selector 15 in step S502 to thereby cause the path selector 15 to rotate counterclockwise.

Subsequently, after the belt HP sensor 311 has sensed the discharge belt 52 at the home position, the CPU 360 drives the discharge motor 157 to move the discharge belt 52 to the stand-by position in step S503. Also, after the jogger fence HP sensor has sensed each jogger fence 53 at the home position, the CPU 360 moves the jogger fence 53 to the stand-by position in step S504. Further, the CPU 360 moves the guide plate 54 and movable guide 55 to their home positions in steps S505. After step S505, the process goes to step S506.

In step S506, the CPU 360 determines whether the inlet sensor 301 has turned on. When the inlet sensor 301 has turned on, the result of step S506 is YES, and the process proceeds to step S507. When the inlet sensor 301 has not turned on, the result of step S507 is NO, and the process repeats the procedure until the result of step S507 becomes YES.

In step S507, the CPU 360 then checks whether the inlet sensor 301 has turned off. When the inlet sensor 301 has turned off, the result of step S507 is YES, and the process proceeds to step S508. When the inlet sensor 301 has not turned off, the result of step S507 is NO, and the process repeats the procedure until the result of step S507 becomes YES.

In step S508, the CPU 360 then determines whether the staple discharge sensor 305 has turned on. When the staple discharge sensor 305 has turned on, the result of step S508 is YES, and the process proceeds to step S509. When the staple discharge sensor 305 has not turned on, the result of step S508 is NO, the process repeats the procedure until the result of step S508 becomes YES.

In step S509, the CPU 360 checks whether the shift outlet sensor 303 has turned on. When the shift outlet sensor 303 has turned on, the result of step S509 is YES, and the process goes to step S510. When the shift outlet sensor 303 has not turned on, the result of step S509 is NO, and the process repeats the procedure until the result of step S509 becomes YES.

In step S510, the CPU 360 determines that a recording sheet is present on the staple tray F. In this case, the CPU 360 turns on the knock solenoid 170 for the preselected period of time to cause the knock roller 12 to contact the sheet and force it against the rear fences 51, thereby positioning the trailing edge of the sheet. Subsequently, in step S511, the CPU 360 drives the jogger motor 158 to move each jogger fence 53 inward by the preselected distance for thereby positioning the sheet in the direction of width perpendicular to the direction of sheet conveyance and then returns the jogger fence 53 to the stand-by position. In step S512, the CPU 360 determines whether the last sheet of a copy has arrived at the staple tray F. When the last sheet has arrived, the result of step S512 is YES, and the process proceeds to step S513. When the last sheet has not arrived yet, the result of step S512 is NO, and the process goes back to step S506.

In step S513, the CPU 360 moves the jogger fences 53 inward to the position where they prevent the edges of the sheets from being dislocated.

After step S513, the CPU 360 turns on the discharge motor 157 to thereby move the discharge belt 52 by a preselected amount in step S514, so that the discharge belt 52 lifts the sheet stack to a stapling position assigned to the center staplers S2. Subsequently in step S515, the CPU 360 turns on the center staplers S2 at the intermediate portion of the sheet stack for thereby stapling the sheet stack at the center. The CPU 360 moves the guides 54 and 55 by a preselected amount each in order to form a path directed toward the fold tray G in step S516. The CPU 360 then causes the upper and lower roller pairs 71 and 72 of the fold tray G to start rotating in step S517. As soon as the movable rear fence 73 of the fold tray G is sensed at the home position, the CPU 360 moves the fence 73 to a stand-by position in step S518. The fold tray G is now ready to receive the stapled sheet stack.

After the step S518, the CPU 360 further moves the discharge belt 52 by a preselected amount in step S519, and causes the discharge roller 56 and press roller 57 to nip the sheet stack and convey it to the fold tray G. After step S519, the CPU 360 determines whether the leading edge of the stapled sheet stack has arrived at the stack arrival sensor 321. When the leading edge of the stapled sheet stack has arrived, the result of step S520 is YES, and the process proceeds to step S521. When the leading edge of the stapled sheet stack has not arrived yet, the result of step S520 is NO, and the process repeats the procedure until the result of step S520 becomes YES.

In step S521, the CPU 360 causes the upper and lower roller pairs 71 and 72 to stop rotating. Then the CPU 360 then releases the lower rollers 72 from each other in step S522. Subsequently, the CPU 360 causes the fold plate 74 to start folding the sheet stack in step S523, and causes the first fold roller pair 81, second fold roller pair, and lower outlet roller pair 83 to start rotating in step S524.

The CPU 360 then determines whether or not the folded sheet stack has moved away from the pass sensor 323 in step S525. When the folded sheet stack has moved away from the pass sensor 323, the result of step S525 is YES, and the process proceeds to step S526. When the folded sheet stack has not moved away from the pass sensor 323, the result of step S525 is NO, and the process repeats the procedure until the result of step S525 becomes YES.

In this stage, the second fold roller pair nips the leading edge of the sheet stack to make the fold of the sheet stack sharper, or more firm. Then, the CPU 360 causes both of the first fold roller pair 81 and the second fold roller pair (not shown) to stop rotating with the first fold roller pair 81 nipping the center portion of the sheet stack, thereby sharpening the fold of the sheet stack. Subsequently, on the elapse of a preselected period of time, the CPU 360 causes the first fold roller pair 81, the second fold roller pair (not shown), and the lower outlet roller pair 83 to start rotating to thereby convey the sheet stack. This is followed by the step S526 and successive steps.

In step S526, the CPU 360 returns the fold plate 74 to its home position. The CPU 360 then determines whether the stack arrival sensor 321 is turned off in step S527. When the stack arrival sensor 321 is turned off, the result of step S527 is YES, and the process proceeds to step S528. When the stack arrival sensor 321 is not turned off, the result of step S527 is NO, and the process repeats the procedure until the result of step S527 becomes YES.

In step S528, the CPU 360 brings the lower rollers 72 into contact, and moves the guide plate 54 and movable guide 55 to their home positions in step S529.

In the above-described condition, the CPU 360 determines whether or not the trailing edge of the folded sheet stack has moved away from the lower outlet sensor 323 in step S530. When the trailing edge of the folded sheet stack has moved away, the result of step S530 is YES, and the process proceeds to step S531. When the trailing edge of the folded sheet stack has not moved away, the result of step S530 is NO, and the process repeats the procedure until the result of step S530 becomes YES.

In step S531, the CPU 360 causes the first fold roller pair 81, the second fold roller pair, and the lower outlet roller pair 83 to further rotate for a preselected period of time and then stop in step S531, and then causes the discharge belt 52 to return to the stand-by position in step S532, and causes the jogger fences 53 to return to the stand-by position in step S533.

Subsequently in step S534, the CPU 360 determines whether or not the above-described sheet stack is the last copy of a single job to perform. When the sheet stack is the last copy, the result of step S534 is YES, and the process proceeds to step S535. When the sheet stack is not the last copy, the result of step S534 is NO, and the process goes back to step S506.

In step S535, the CPU 360 moves the discharge belt 52 to its home position.

After step S535, the CPU 360 moves the jogger fences 53 to its home position in step S536.

After step S536, the CPU 360 causes the inlet roller pair 1, roller pairs 2, 7, 9 and 10, staple discharge roller pair 11 and knock roller 12 to stop rotating in step S537, and turns off the solenoid assigned to the path selector 15 in step S538. As a result, all the structural parts are returned to their initial positions.

The stapling and folding operations to be performed in the center fold mode will be described in more detail hereinafter.

Figure 23:
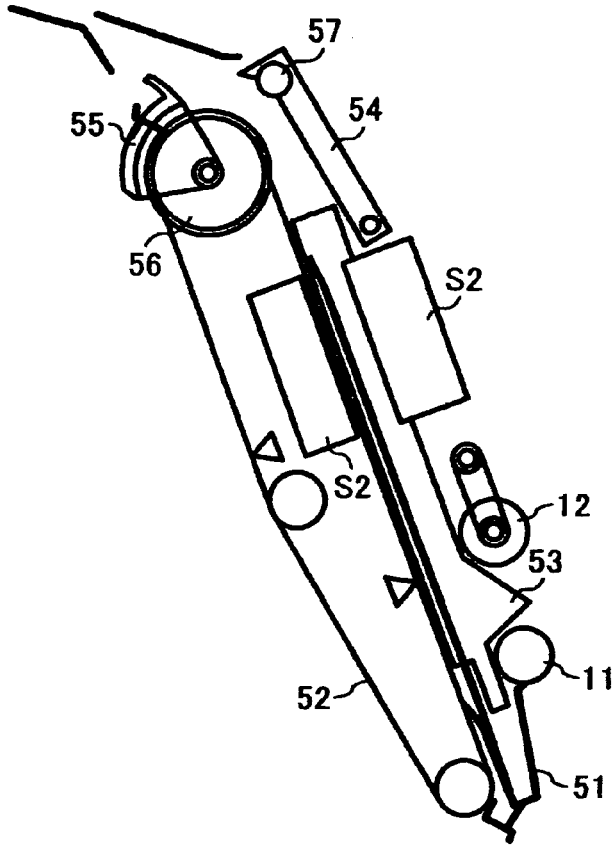
FIG. 23 is a side view illustrating how a sheet stack is positioned on the staple tray in the center staple and fold mode.
Figure 24:
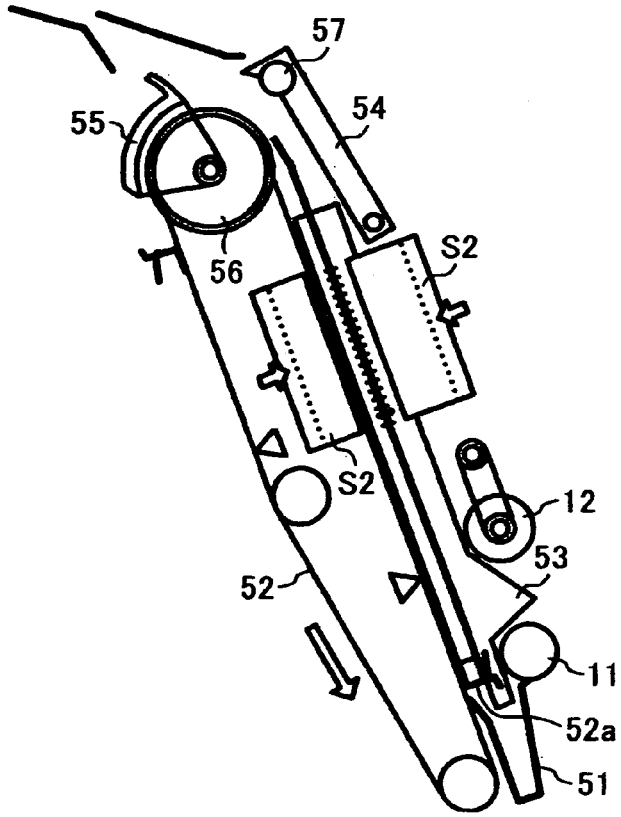
FIG. 24 is a side view illustrating how a sheet stack is stacked and stapled at the center on the staple tray in the center staple and fold mode.

A recording sheet is steered by the path selectors 15 and 16 to the path D and then conveyed by the roller pairs 7, 9 and 10, and staple discharge roller 11 to the staple tray F. The staple tray F operates in exactly the same manner as in the staple mode stated earlier before positioning and stapling (see FIG. 23). Subsequently, as shown in FIG. 24, the hook 52*a* conveys the sheet stack to the downstream side in the direction of conveyance by a distance matching with the sheet size. After the center staplers S2 have stapled the center of the sheet stack, the sheet stack is conveyed by the hook 52*a* to the downstream side by a preselected distance matching with the sheet size and then brought to a stop. The distance of movement of the sheet stack is controlled on the basis of the drive pulses input to the discharge motor 157.

Subsequently, as shown in FIG. 25, the sheet stack is nipped by the discharge roller 56 and press roller 57 and then conveyed by the hook 52*a* and discharge roller 56 to the downstream side such that it passes through the path formed between the guide plate 54 and movable guide 55 and extending to the fold tray G. The discharge roller 56 is mounted on a drive shaft (not shown) associated with the discharge belt 52 and therefore driven in synchronism with the discharge belt 52, as stated earlier.

Figure 26:
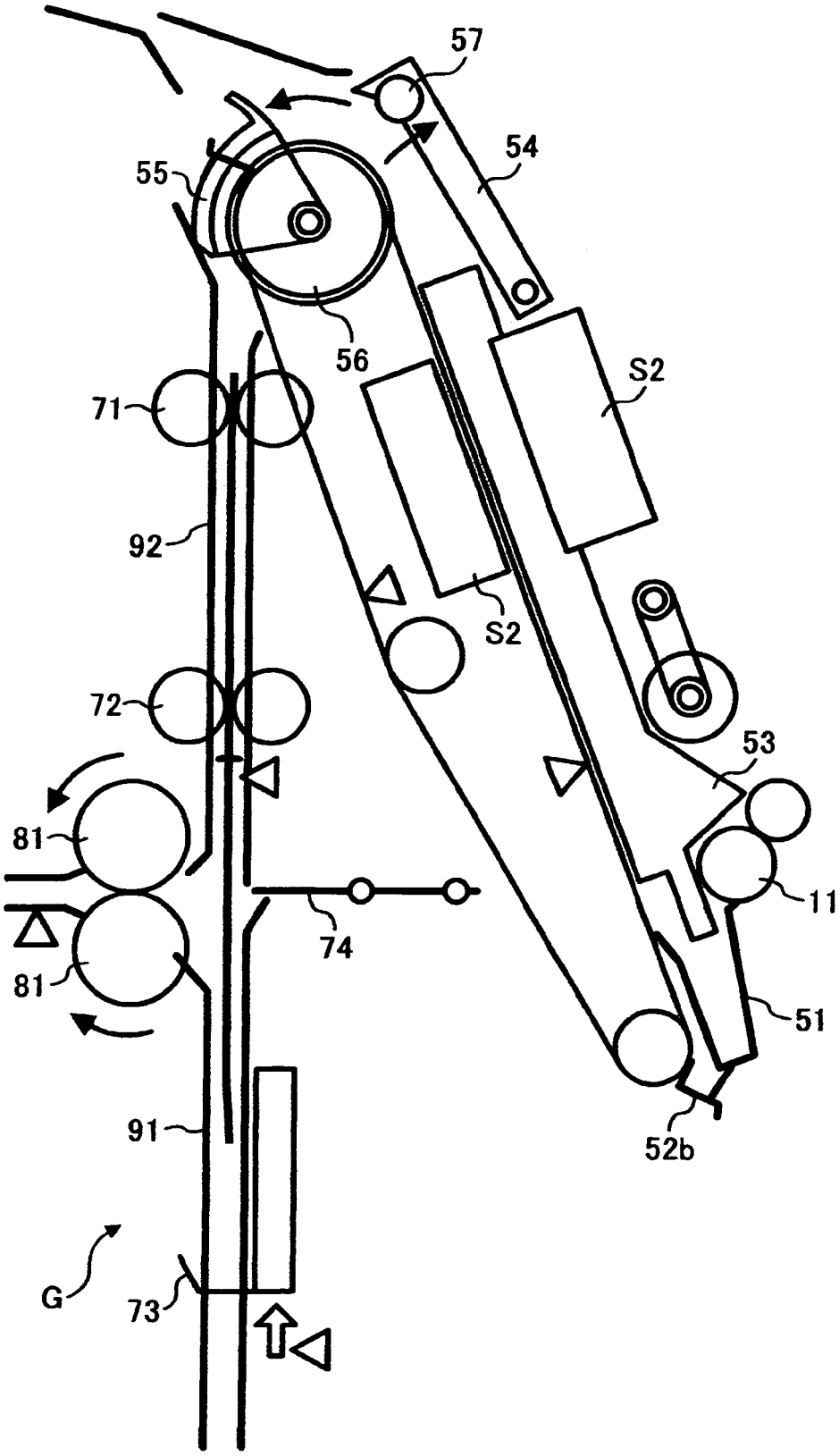
FIG. 26 is a side view illustrating a condition wherein the sheet stack steering mechanism has steered the sheet stack stapled in the center staple and fold mode toward a fold tray.
Figure 27:
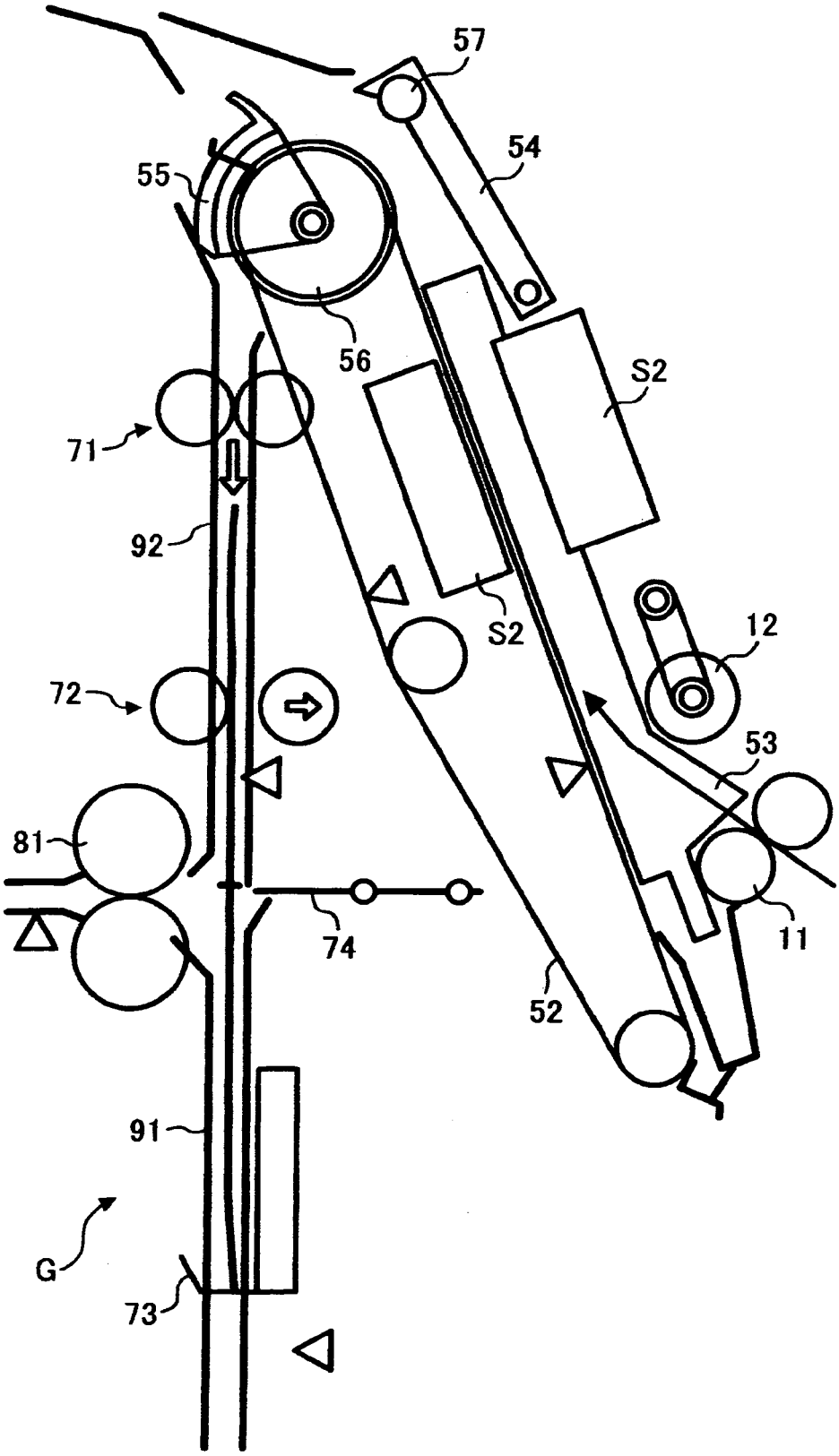
FIG. 27 is a side view illustrating a condition wherein the sheet stack is positioned at a fold position on the fold tray in the center staple and fold mode.

Subsequently, as shown in FIGS. 26 and 27, the sheet stack is conveyed by the upper and lower roller pairs 71 and 72 to the movable rear fence 73, which is moved from its home position to a position matching with the sheet size beforehand and held in a stop for guiding the lower edge of the sheet stack. At this instant, as soon as the other hook 52*b* on the discharge belt 52 arrives at a position close to the rear fence 51, the hook 52*a* is brought to a stop while the guides 54 and 55 are returned to the home positions to wait for the next sheet stack.

Figure 28:
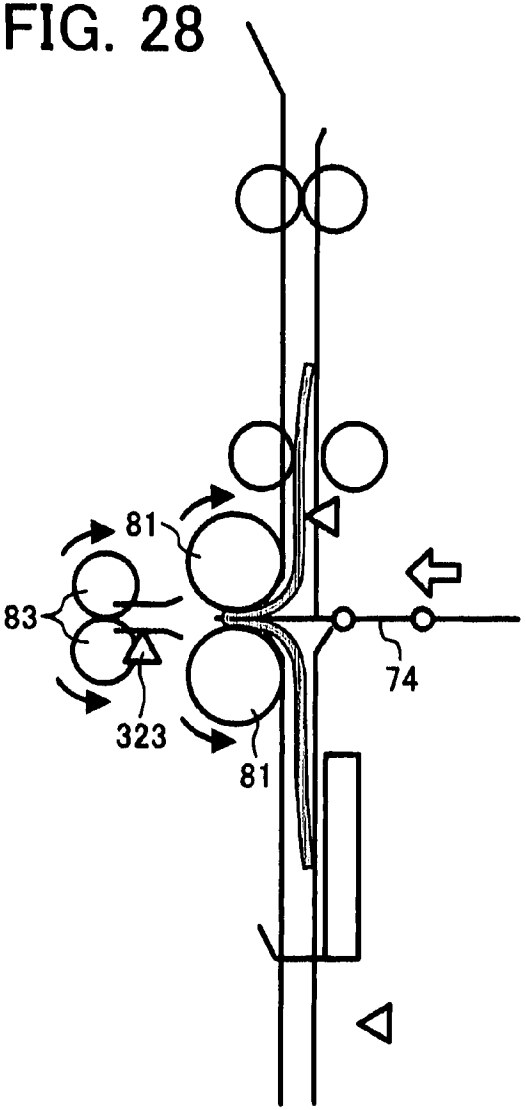
FIG. 28 is a side view illustrating a condition wherein a fold plate has started folding the sheet stack on the fold tray in the center staple and fold mode.

As shown in FIG. 27, the sheet stack abutted against the movable rear fence 73 is freed from the pressure of the lower roller pair 72. Subsequently, as shown in FIG. 28, the fold plate 74 pushes part of the sheet stack close to a staple toward the nip of the first fold roller pair 81 substantially perpendicularly to the sheet stack. The first fold roller pair 81, which is caused to rotate beforehand, conveys the sheet stack reached its nip while pressing it. As a result, the sheet stack is folded at its center.

Figure 30:
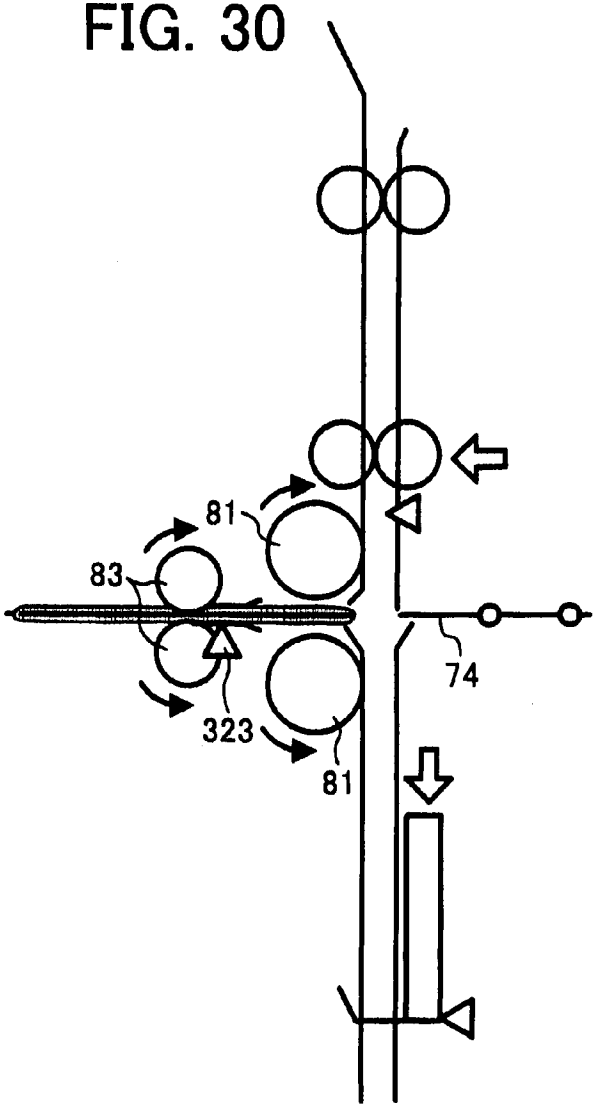
FIG. 30 is a side view illustrating a condition wherein the sheet stack is being driven out of the fold tray in the center staple and fold mode.
Figure 29:
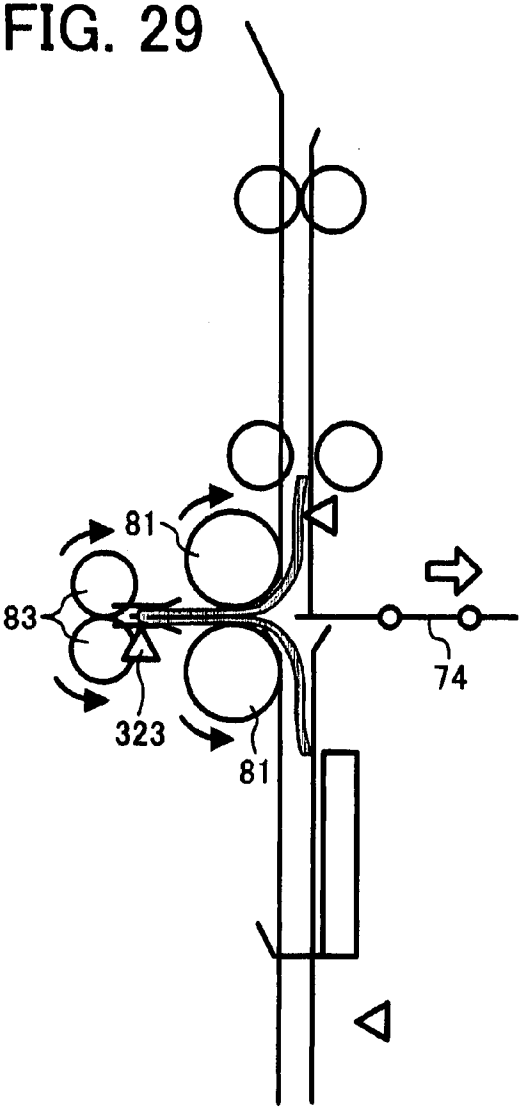
FIG. 29 is a side view illustrating a condition wherein after the fold plate has started folding the sheets stack on the fold tray in the center staple and fold mode, a fold roller pair at a second stage is folding the sheets stack.

FIGS. 28 through 30 show the details how the first fold roller pair 81 is rotated in opposite directions to press the leading edge of a folded sheet stack a plurality of times, thereby sharpening the fold of the sheet stack. As shown in FIG. 28, the fold plate 74 pushes part of a center-folded sheet stack around staples into the nip of the fold roller pair 81 in the direction perpendicular to the sheet stack. As a result, the sheet stack is conveyed by the fold roller pair 81 while being folded at its center thereby.

When the pass sensor 323 senses the leading edge of the folded sheet stack, the fold plate 74 is retracted by a preselected distance. Subsequently, the fold roller pair 81 and lower outlet roller pair 83 are caused to be rotated in the reverse direction and then stop at a predetermined position from the center of the nip. As shown in FIG. 29, the fold roller pair 81 and lower outlet roller pair 83 that have reached the above position are caused to rotate in the forward direction. As soon as the pass sensor 323 senses the leading edge of the sheet stack, the fold roller pair 81 and lower outlet roller pair 83 are caused to stop. The fold roller pair 81 repeats the above-described operation after the pass sensor 323 in order to sharpen the fold of the sheet stack. The number of times and duration of the repetition may be manually input on an operation panel (not shown) mounted on the image forming apparatus PR or automatically set by the CPU 360 in accordance with the sheet size and the number of sheets.

The fold roller pair 81 and lower outlet roller pair 83, once stopped in respective predetermined positions, are again caused to rotate in the forward direction to thereby discharge the folded sheet stack to the lower tray 203. When the arrival sensor 321 senses the trailing edge of the sheet stack, the movable rear fence 73 is returned to the home position while the lower rollers 72 are pressed against each other, preparing for the next sheet stack. Again, the rear fence 73 may be held at the same position if the sheet size and the number of sheets to be dealt with by the next job are the same. As soon as the fold roller pair 81 and lower outlet roller pair 83 start rotating in the forward direction, the fold plate 74 is returned to the home position, as shown in FIG. 30.

As shown in FIG. 30, the sheet stack with the fold sharpened is driven out to the lower tray 203 by the lower outlet roller pair 83. At this instant, as soon as the pass sensor 323 senses the trailing edge of the sheet stack, the fold plate 74 and movable rear fence 73 are returned to their home positions while the lower roller pair 72 is released from each other so as to wait for the next sheet stack. Alternatively, the rear fence 73 may be held at the same position without being returned to the home position if the next job deals with the same sheet size and the same number of sheets.

Figure 31:
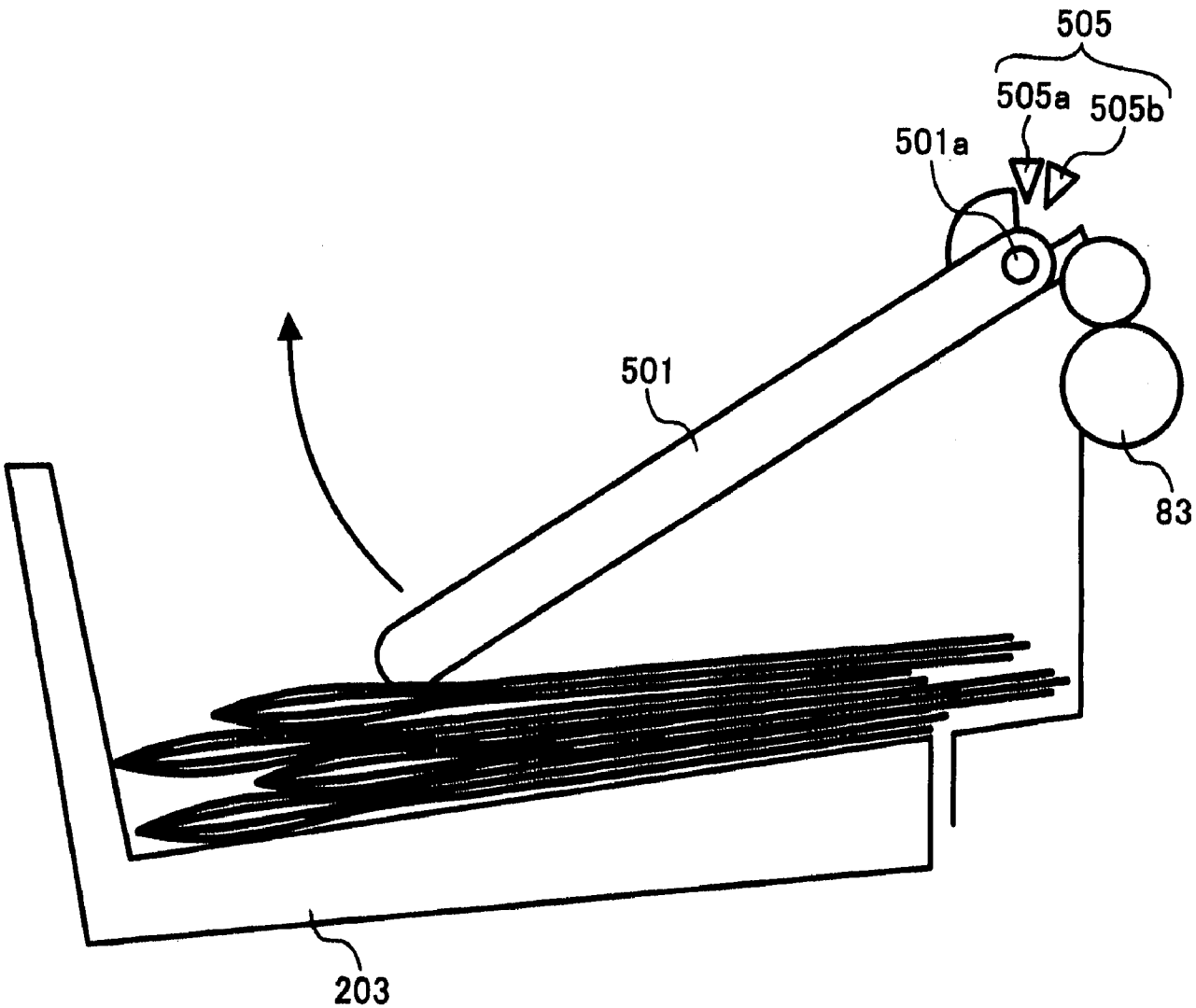
FIG. 31 is a side view illustrating a sheet loading system including a lower tray on which center-bound sheet stacks are received, in accordance with the present invention.

FIG. 31 is a side view illustrating a sheet loading system of a sheet finishing apparatus PD. The sheet loading system includes a lower tray 203 on which center-bound sheet stacks, for example, are received. The sheet stacks are output to the lower tray 203 by a pair of lower outlet rollers 83 serving as a discharging member. The lower outlet rollers 83 are disposed adjacent or proximate to the lower tray 203. A pressure arm 501 contacts a top surface of the sheet stacks on the lower tray 203. The pressure arm 501 is rotational supported on a rotation fulcrum or pivot 501*a* that is disposed adjacent or proximate the lower tray 203 and the lower outlet rollers 83, such that an angular position of the pressure arm 501 changes in response to a number of sheet stacks on the lower tray 203.

The pressure arm 501 continues to move as more sheet stacks are output to the lower tray 203. The position or movement of the pressure arm 501 is monitored by one or more sensors or detectors 505. As shown in the figures, sensors 505 includes a first sensor 505*a* and a second sensor 505*b*, and the first and second sensors 505*a* and 505*b* are disposed the adjacent the rotation fulcrum 501*a*. By this arrangement, the sensors 505*a* and 505*b* can sense the movement or the position of the pressure arm 501. It is to be understood, however, that the invention is not limited to using two sensors, and can use only one sensor or can use three or more sensors.

The CPU 360 controls the output of the sheet stacks to the lower tray 203 based on information from the first and second sensors 505*a* and 505*b*. For example, in the preferred embodiment shown in the drawings, the first sensor 505*a* senses whether sheet stacks may be discharged when the power is turned on or when a power saving mode is exited. When the first sensor 505*a* senses a particular condition (e.g., no sheet stack on the lower tray 203), the CPU 360 can permit discharge of the sheet stacks to the lower tray 203. Further, when the first sensor 505*a* senses another condition (e.g., there is a sheet stack on the lower tray 203), the CPU 360 can prevent the sheet stacks from being discharged to the lower tray 203.

In conjunction with or apart from the determination of the first sensor 505*a*, the second sensor 505*b* can be used to determine whether sheet stacks can continue to be discharged to the lower tray 203 during a job. When the second sensor 505*b* senses a particular condition (e.g., no sheet stack on the lower tray 203), the CPU 360 can permit discharge of sheet stacks. Further, when the second sensor 505*b* senses another particular condition (e.g., there is a sheet stack on the lower tray 203), the CPU 360 can prevent the sheet stacks from being discharged to the lower tray.

It is to be understood that the a combination of sensors or a single sensor can be used to indicate whether the tray is removed from the finishing apparatus and no discharge is permitted, whether the tray is present on the apparatus, and whether the lower tray 203 can receive additional sheet stacks.

Figures 32, 33:
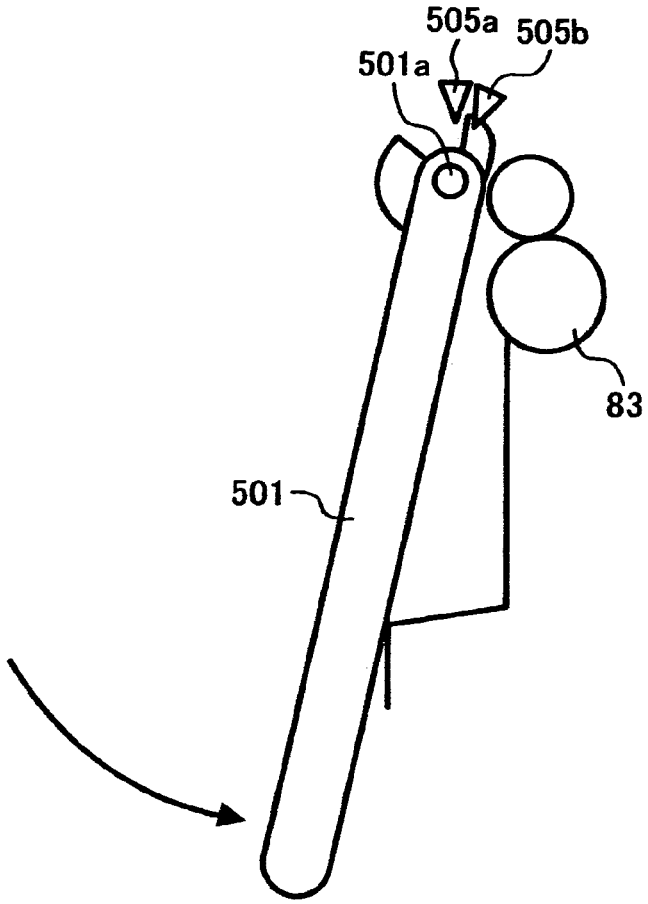
FIG. 32 is a side view illustrating the sheet loading system of FIG. 31 when the lower tray is removed.
FIG. 33 is a table showing the status of the first and second sensors as a function of positions of the pressure arm.

FIG. 32 is a side view illustrating the sheet loading system of the sheet finishing apparatus PD of FIG. 31 when the lower tray 203 is removed. The figure shows the position of the pressure arm 501 relative to the first and second sensors 505*a* and 505*b*. In the example shown in the figure, when the lower tray 203 is removed from the sheet finishing apparatus, the first sensor 505*a* is OFF, and the second sensor 505*b* in ON.

FIG. 33 is a table showing examples of the status of the first and second sensors 505*a* and 505*b* as a function of positions of the pressure arm 501. When the pressure arm 501 is disposed in position 1, where the first sensor 505*a* is OFF and second sensor 505*b* is ON, the lower tray 203 is removed from the sheet finishing apparatus PD. When the pressure arm 501 is disposed in position 2, where the first sensor 505*a* is OFF and second sensor 505*b* is OFF, the lower tray 203 is disposed on the sheet finishing apparatus PD and is ready to receive sheet stacks. When the pressure arm 501 is disposed in position 3, where the first sensor 505*a* is ON and second sensor 505*b* is OFF, the pressure arm 501 is at a low position. Depending on attributes of the job(s) of the image forming apparatus, position 3 may prevent the tray 203 from receiving additional sheet stacks. When the pressure arm 501 is disposed in position 4, where the first sensor 505*a* is ON and the second sensor 505*b* is ON, the pressure arm is in a high position. Depending on attributes of the job(s) of the image forming apparatus, position 4 may prevent the tray 203 from receiving additional sheet stacks In the exemplary embodiment, when the sheets in the sheet stacks are smaller than B4 size, the CPU 360 controls the output to the lower tray 203 according to information detected by the first and second sensors 505*a* and 505*b* and information about at least one attribute of the sheet stacks, such as a number of sheets in the sheet stack, the size of the sheets in the sheet stack, the folding pattern of the sheets in the sheet stack, etc. When the sheets in the sheet stacks are B4 size or larger, the CPU 360 controls the output to the lower tray 203 according to a counter and information about at least one attribute of the sheet stacks, such as a number of sheets in the sheet stack, the size of the sheets in the sheet stack, the folding pattern of the sheets in the sheet stack, etc.

Sheet finishing apparatuses can fold sheet stacks into various patterns, including center folding, Z-folding, triple folding, etc. As stated above, information regarding the folding pattern of the sheet stacks can be used to control the output of the sheet stacks to the lower tray 203. Control of the output can also be based on a size of the sheets in the sheet stacks, the number of sheets in the sheet stacks, and the like. It is noted, for example, that sheet stacks including larger sized sheets may only be capable of being stacked in a vertical direction, while sheet stacks including smaller sized sheets may be stacked in either a vertical or horizontal orientation. Further, additional information, for example, the thickness of sheets in the sheet stack, can be used to control the output of the sheet stacks to the lower tray 203. The use of more or different attributes of the sheets in the sheet stacks may result in better control of the output of the sheet stacks on the lower tray 203.

Further, a counter can be used in conjunction with one or more sensors 505, such that the output to the lower tray 203 can be precisely controlled without additional sensors (e.g., without the use of three or more sensors). For example, the controller can prevent output to the lower tray 203 after a predetermined number of additional outputs subsequent to the pressure arm 501 arriving in position 4. By this arrangement, the CPU 360 can precisely control output of the sheet stacks to the lower tray 203 without the costs associated with additional sensors. For example, the counter can begin counting when one of the first and second sensors 505*a* and 505*b* detects or does not detect the pressure arm 501, and output can be permitted to continue until a predetermined number of additional outputs to the lower tray 203 are counted. At the completion of the job or when the first sensor 505*a* does not detect the pressure arm 501 (indicating that the sheet stacks have been removed from the lower tray 203), the counted can be reset.

Figures 34, 34A:
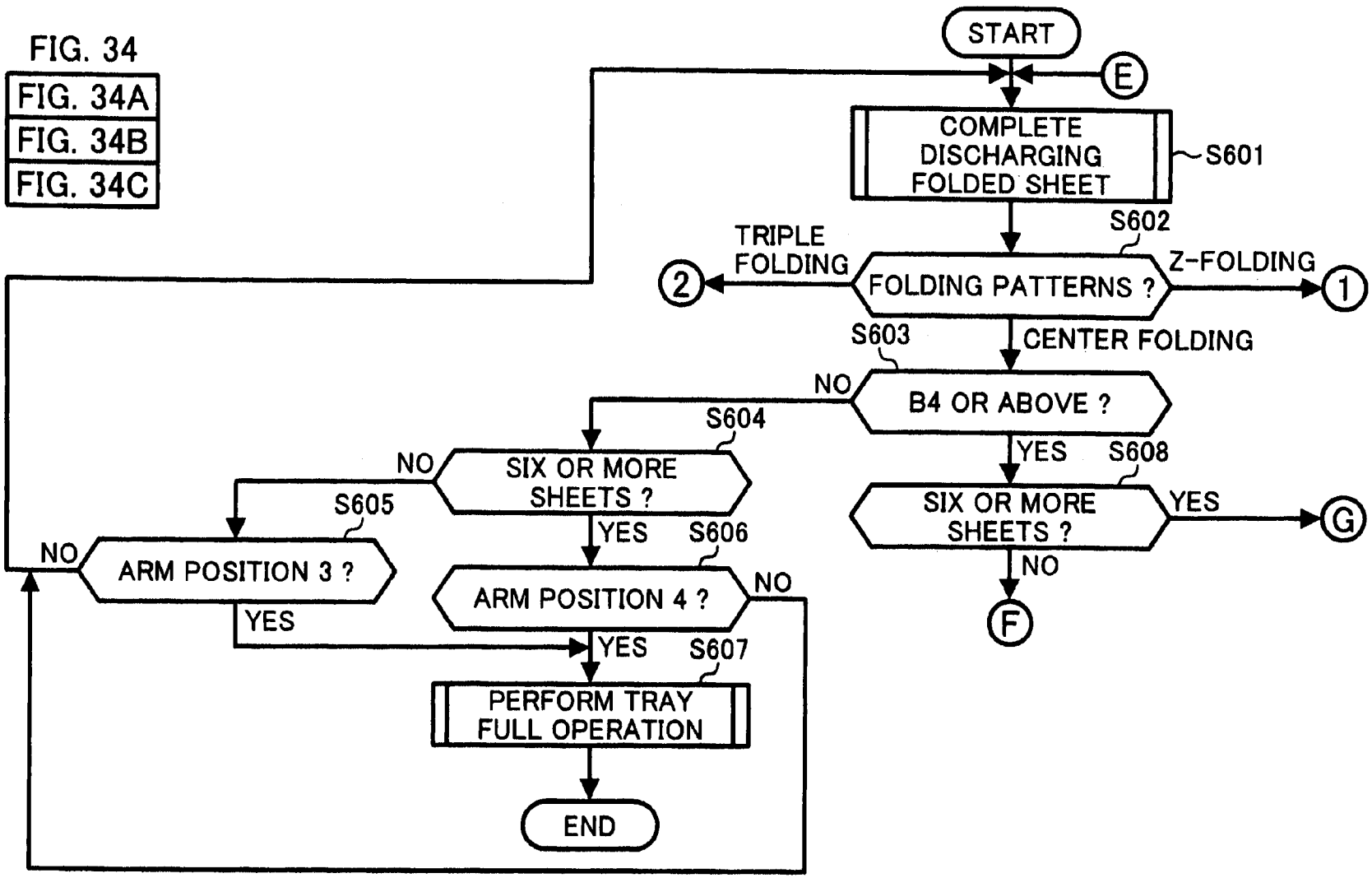
FIGS. 34A, 34B and 34C are flowcharts showing control of the sheet finishing apparatus based on positions of the pressure arm and counted numbers of sheet stacks.
Figure 34B:
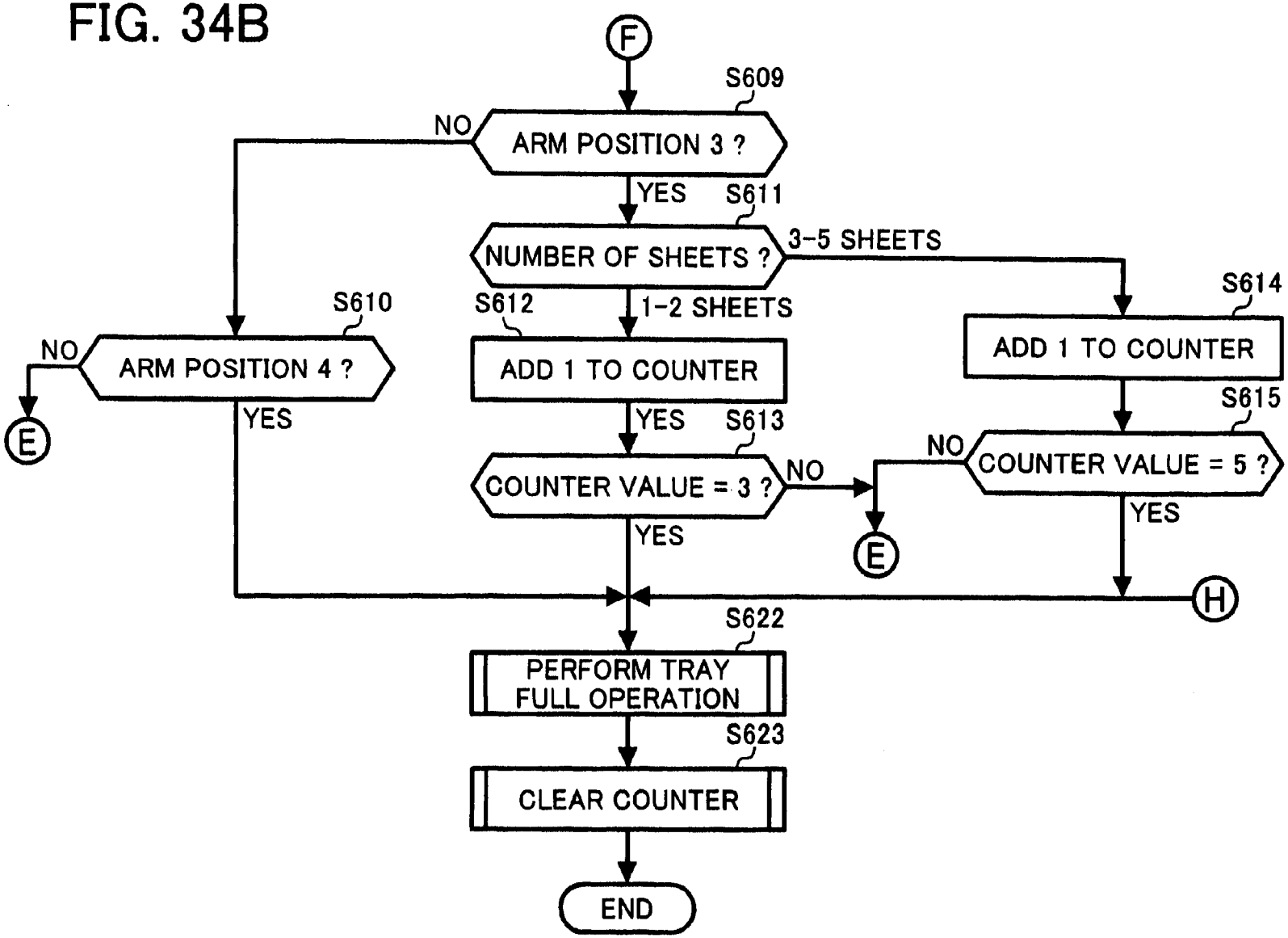
Figure 34C:
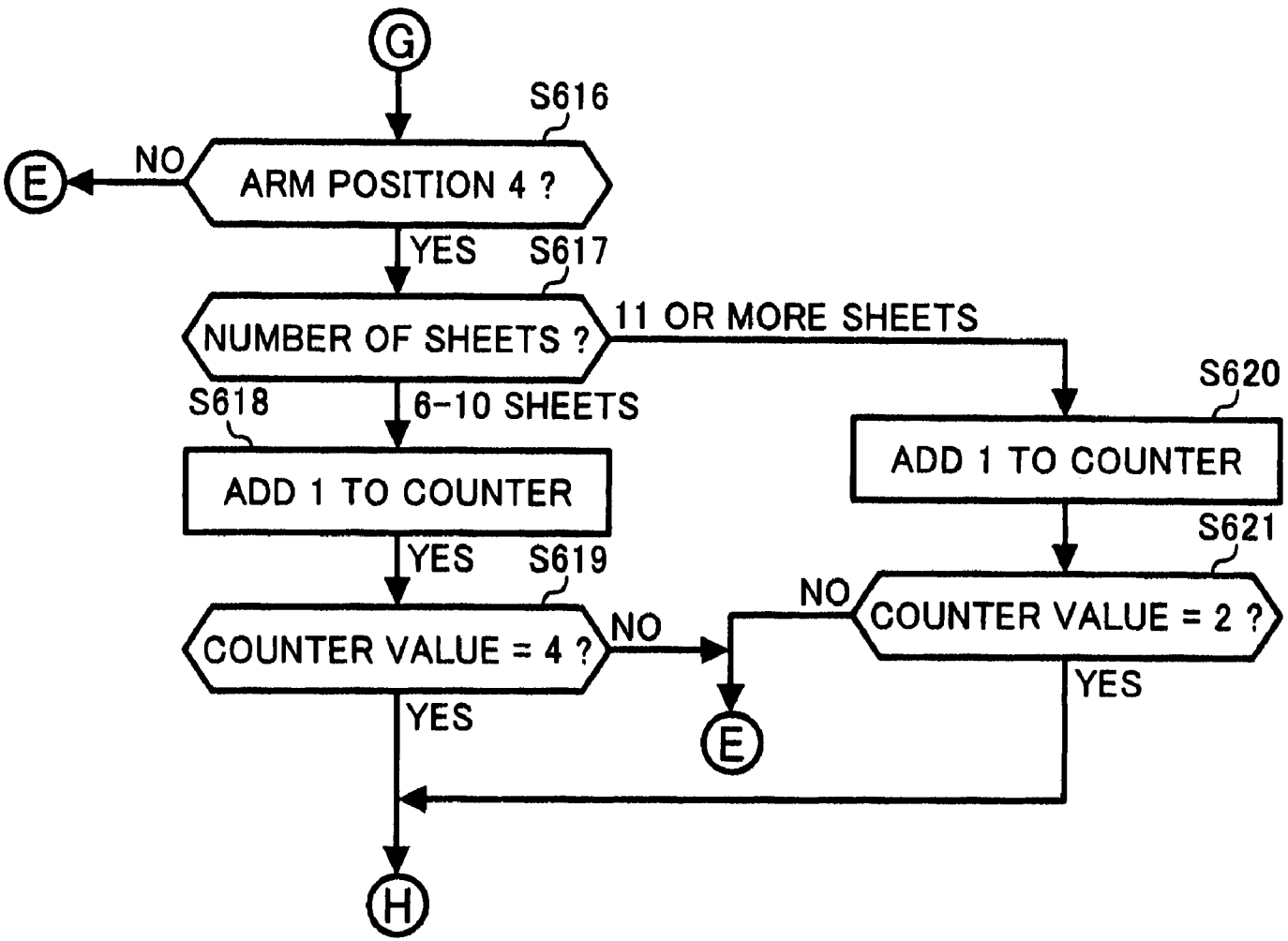

FIGS. 34A, 34B and 34C are flowcharts showing control of the sheet finishing apparatus based on positions of the pressure arm and counted numbers of sheet stacks. It is to be understood the operation is discussed with respect to a tray of a particular size, and that therefore the operation of a system in accordance with the present invention may vary depending on the size of the tray. Control for triple folded, Z-folded, and other folding pattern sheet stacks is not included in these flowcharts. It is noted that control can be simplified by eliminating dependence of the control on folding patterns of the sheet stacks, number of sheets in the sheet stacks, and counts of sheet stacks outputted to the lower tray 203. Alternatively, control of the output of the sheet stacks to the lower tray 203 can be based on additional or different attributes.

As shown in FIGS. 34A-34C, the CPU 360 completes a process permitting discharge of the folded sheet stack in step S601, and then determines the type of folding patterns, i.e., triple folding, center folding or Z-folding in step S602. As previously stated, the operations for triple folding and Z-folding are not included in the figures. When center folding is selected, the CPU 360 determines whether the sheets in the sheet stack are B4 size or larger, in step S603.

When the sheets of the sheet stack have a size smaller than B4, the result of step S603 is NO, and the process proceeds to step S604. When the sheets are size B4 or larger, the result of step S603 is YES, the process proceeds to step S608.

In step S604, the CPU 360 determines whether the number of sheets in the sheet stack is 6 or more. When the number of sheets is 5 or less, the result of step S604 is NO, and the process proceeds to step S605. When the number of sheets is at least 6, the result of step S604 is YES, and the process proceeds to step S606.

When the number of sheets is 5 or less sheets, the CPU 360 determines whether the pressure arm 501 is oriented in position 3, in step S605. When the result of step S605 is YES, the CPU 360 performs the tray full operation (low position) in step S607. When the result of step S605 is NO, the process returns to step S601. When the number of sheets is 6 or more sheets, the CPU 360 determines whether the pressure arm 501 is oriented in position 4, in step S606. When the result of step S606 is YES, the CPU 360 performs the tray full operation (high position) in step S607. When the answer in step S606 is NO, the process returns to step S601.

When the result of step S603 is YES, the CPU 360 determines whether the number of sheets is 6 or more, in step S608. When the result of step S608 is YES, the CPU 360 determines whether the pressure arm 501 is oriented in position 4, in step S616. When the result of step S616 is NO, the procedure returns to step S601.

When the result of step S608 is NO, the CPU 360 determines whether the pressure arm 501 is oriented in position 3, in step S609. When the result of step S609 is NO, the CPU 360 determines whether the pressure arm 501 is oriented in position 4, in step S610. When the result of step S610 is NO, the procedure returns to step S601.

When the result of step S609 is YES, the CPU 360 determines whether the number of sheets is either 1 to 2 or 3 to 5, in step S611. When the number of sheets is 1 to 2, the CPU 360 adds 1 to the counter in step S612, and determines whether the counter value is 3, in step S613.

When the counter value is 3, the CPU 360 performs the tray full operation, in step S622. The counter is then cleared in step S623. When the counter value is not 3, the procedure returns to step S601.

When the number of sheet is 3 to 5, the CPU 360 adds 1 to the counter, in step S614. The CPU 360 determines whether the counter value is 5, in step S615. When the counter value is 5, the CPU 360 performs the tray full operation, in step S622. The counter is then cleared in step S623. When the counter value is not 5, the procedure returns to step S601.

When the pressure arm 501 is oriented in position 4 in step S616, the CPU 360 determines the number of sheets, in step S617. When the number of sheets is 6 to 10, the CPU 360 adds 1 to the counter in step S618. The CPU 360 determines whether the counter value is 4, in step S619. When the counter value is 4, the CPU 360 performs the tray full operation in step S622. The counter is cleared in step S623. When the counter value is not 4, the procedure returns to step S601.

When the number of sheets is 11 or more in step S617, the CPU 360 adds 1 to the counter in step S620, and determines whether the counter value is 2 in step S621. When the counter value is 2, the CPU 360 performs the tray full operation in step S622. The counter is cleared in step S623. When the counter value is not 2, the procedure returns to step S601.

When two sequential jobs include different folding patterns, paper sizes, number of sheets in the sheet stacks, etc., the lower tray 203 may not be able to receive additional sheet stacks regardless of the outputs of the sensors 505*a* and 505*b*. For example, the sheet stacks on the tray 203 may be unstable if a large quantity of sheet stacks including center folded A4 paper are received in the lower tray 203, and then a quantity of sheet stacks including folded A3 paper is received in the lower tray 203. Therefore, when the CPU 360 determines that attributes differ between sequential jobs, the CPU 360 may prevent output of the sheet stacks of a second job onto the tray 203 on which the sheet stacks from a first job are disposed.

Figure 35:
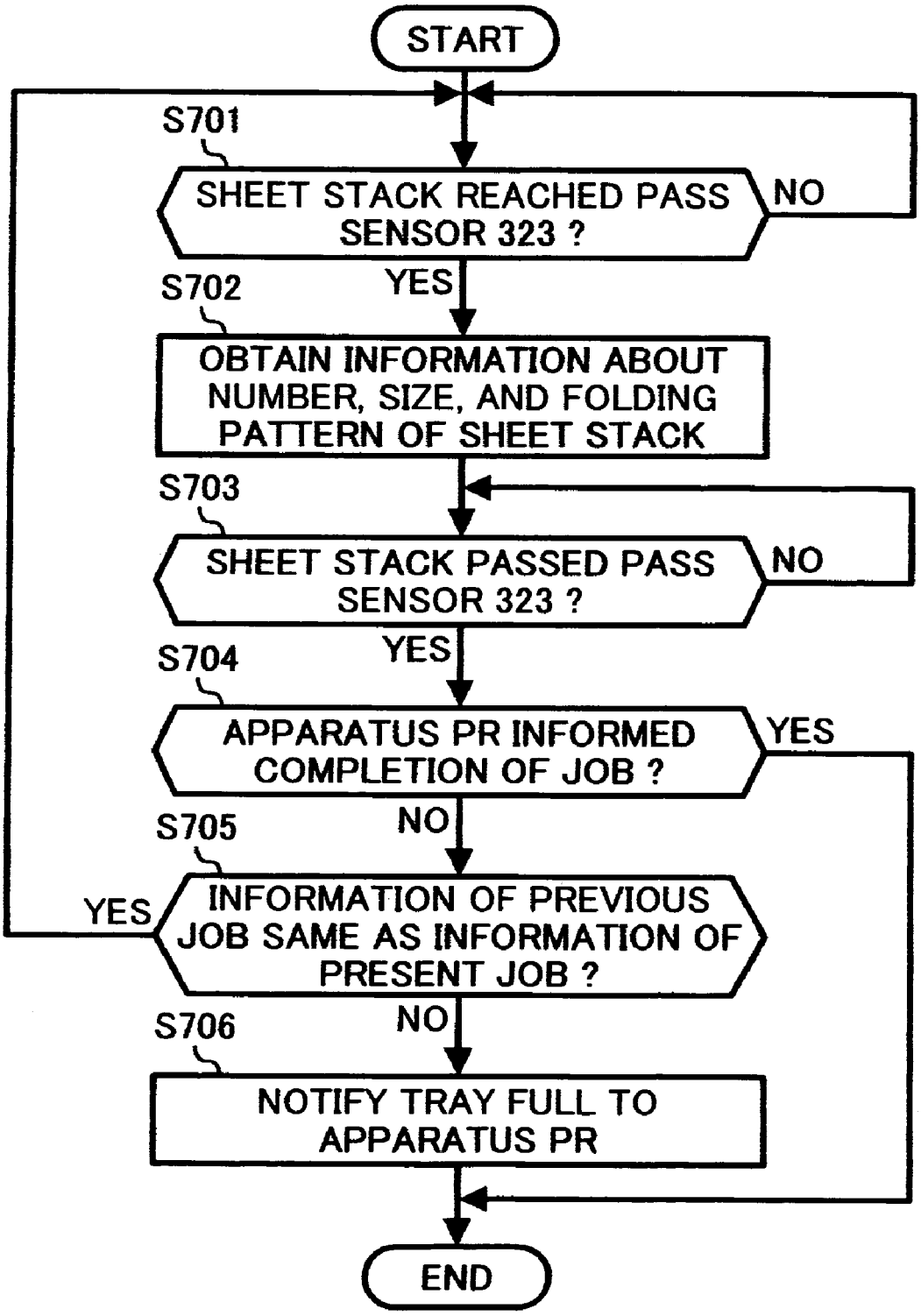
FIG. 35 is a flowchart showing control of the sheet finishing apparatus when sequential jobs include different attributes.

FIG. 35 is a flowchart showing control of the sheet finishing apparatus when sequential jobs include different attributes. In step S701, the CPU 360 determines whether a sheet stack has reached the fold position pass sensor 323. When the sheet stack has reached the fold position pass sensor 323, the CPU 360 obtains information regarding attributes of the sheet stack, such as a number of sheets in the sheet stack, a size of the sheets in the sheet stack, a folding pattern of the sheet stack, etc., in step S702. The process continues to step S703. When the sheet stack has not reached the fold position pass sensor 323, the process continues until the sheet stack reaches the sensor 323.

In step S703, the CPU 360 determines whether the sheet stack has passed the fold position pass sensor 323. When the sheet stack has passed the fold position pass sensor 323, the CPU 360 determines whether the image forming apparatus PR has indicated that a present job or a subsequent job is completed, in step S704. When the sheet stack has not passed the fold position pass sensor 323 yet, the process continues until the sheet stack passes the fold position pass sensor 323.

When the image forming apparatus PR has indicated the completion of the present job, the procedure ends. When the image forming apparatus PR has not indicated the completion of the present job, the process proceeds to step S705.

In step S705, the CPU 360 determines whether the attributes of a previous job or a primary job is the same as that attributes of the present job. When the attributes of the previous job are the same as that of the present job, the process returns to step S701. When the attributes of the previous job are different from that of the present job, the process proceeds to step S706. In step S706, the CPU 360 notifies the image forming apparatus PR that the tray is full, and the procedure ends.

According to the operations described above, when for example the number, size, and folding pattern of the sheet stacks of the primary job are the same as the subsequent job, the procedure continues. When any one of the number, size, and folding pattern of the sheet stacks of the primary job is different from the subsequent job, the CPU 360 sends a command to the image forming apparatus PR to terminate the image forming operation, and to notify the user that the lower tray 203 cannot receive sheet stacks from the subsequent job.

Even when the CPU 360 monitors the state of the first and second sensors 505*a* and 505*b* of the lower tray 203, if the CPU 360 determines the sheet stacks in the lower tray 203 may be unstable, as shown in the flowchart of FIGS. 35, the CPU 360 indicates to the image forming apparatus PR that the lower tray 203 is full.

Figure 36:
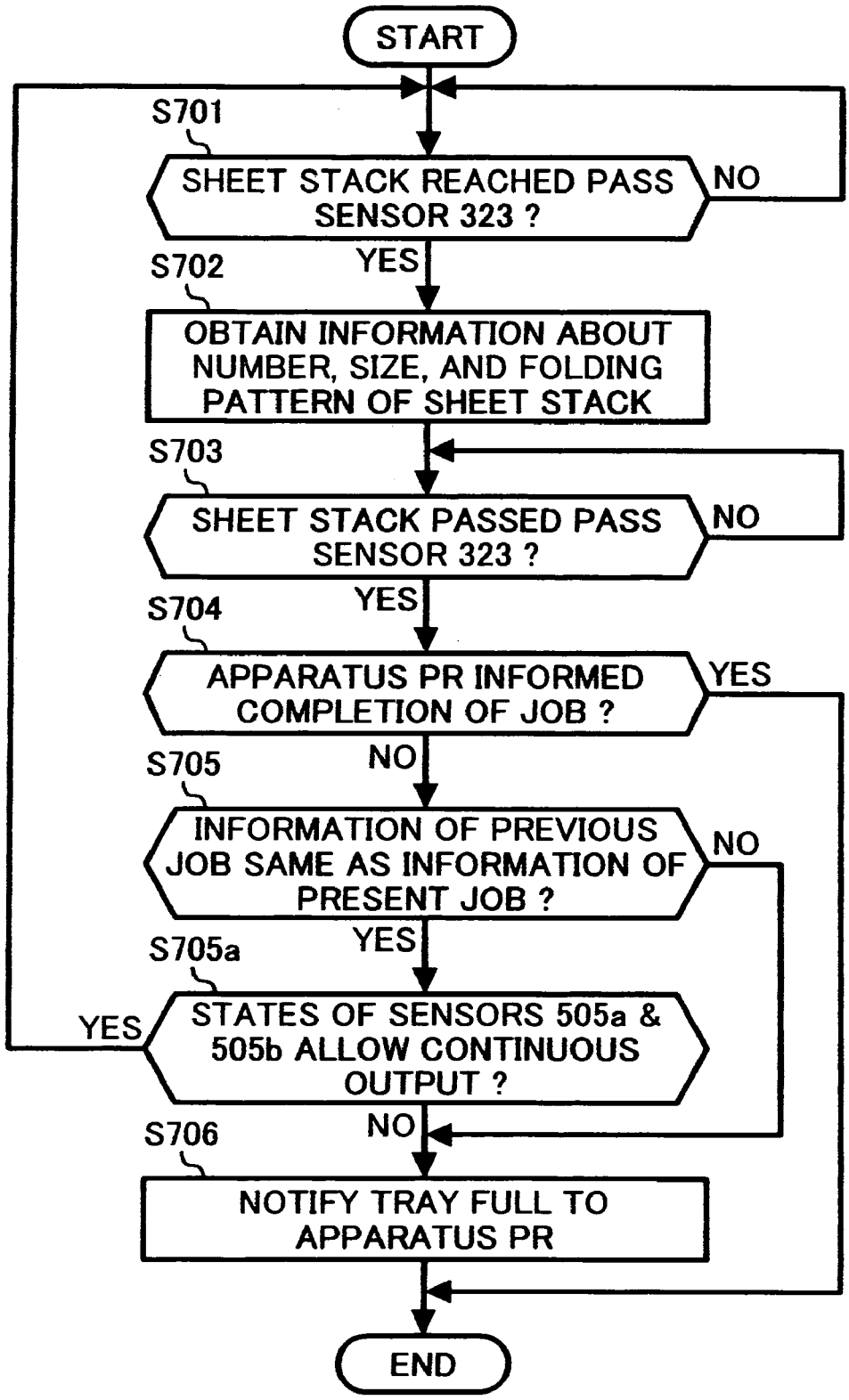
FIG. 36 is a flowchart showing control of the sheet finishing apparatus when sequential jobs, in which continuous output is permitted.

FIG. 36 is a flowchart showing control of the sheet finishing apparatus when sequential jobs, in which continuous output is permitted. The procedure shown in FIG. 36 is similar to that of FIG. 35. However, in FIG. 36, when the attributes of the previous job are the same as that of the present job, the result of step S705 is YES, and the process proceeds to step S705*a*. When the attributes of the previous job are different from that of the present job, the process proceeds to step S706, which is same as that shown in FIG. 35.

In step S705*a*, the CPU 360 determines whether the first and second sensors 505*a* and 505*b* permit output of the sheet stacks to the lower tray 203. When the first and second sensors 505*a* and 505*b* permit output to the lower tray 203, the result of step S705*a* is YES, and the process returns to step S701. When the first and second sensors 505*a* and 505*b* do not permit output to the lower tray 203, the result of step S705*a* is NO, and the process proceeds to step S706.

In this embodiment, the CPU 360 determines whether to output sheet stacks to the lower tray 203 according to information about the number of sheets in the sheet stack, the size of the sheets in the sheet stacks, and the folding pattern of the sheet stacks, etc., in conjunction with information from the sensors 505*a* and 505*b* regarding the status of the lower tray 203.

When controlling the sheet finishing apparatus including the counter, the CPU 360 may perform different controls during a job and during a standby state. For example, when recording sheets stored in the image forming apparatus PR run out during a job, the CPU 360 may stop the operation performed by the sheet finishing apparatus. In such case, the CPU 360 changes the control for monitoring the loading state during the job to that during the standby state. Even though the control for the standby state is changed, the CPU 360 may clear the number of counts so the sheet loading operation during the following job is not controlled. Therefore, only when the CPU 360 determines that the number, size, and folding pattern of sheet stacks of a primary job are the same as those of a subsequent job, the number of counts is based on those of the primary job so as to prevent the sheet finishing apparatus from causing a malfunction.

Figure 37:
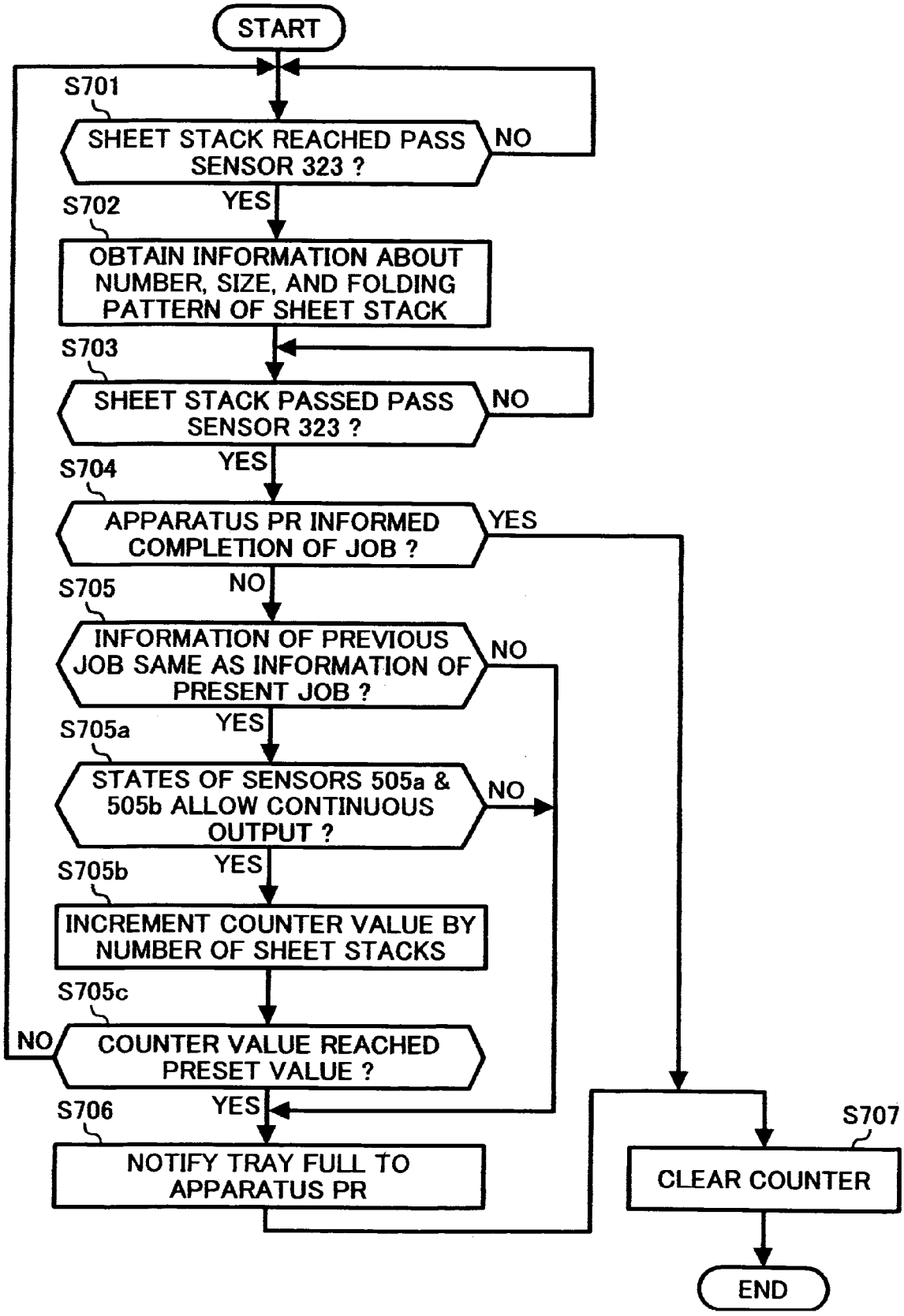
FIG. 37 is a flowchart showing control of the sheet finishing apparatus including a counter.

FIG. 37 is a flowchart showing control of the sheet finishing apparatus including a counter. The procedure shown in FIG. 37 is similar to that shown in FIG. 36. However, in FIG. 37, step S705*b* occurs when the result of step S705*a* is YES, step S705*c* occurs when the result of step S705*b* is YES, and step S707 occurs after step S706. Specifically, when the first and second sensors 505*a* and 505*b* do not permit output of the sheet stacks to the lower tray 203, the result of step S705*a* is NO, and the process proceeds to step S706. When the first and second sensors 505*a* and 505*b* permit output to the lower tray 203, the result of step S705*a* is YES, and the process proceeds to step S705*b*.

In step S705*b*, the CPU 360 increases the counter value by an increment equal to the number of sheet stacks, and the process proceeds to step S705*c*. In step S705*c*, the CPU 360 determines whether the counter value has reached the predetermined value. When the counter value has reached the predetermined value, the result of step S705*c* is YES, and the process proceeds to step S706. When the counter value has not reached the predetermined value, the result of step S705*c* is NO, and the process returns to step S701. The process continues until the counter value reaches the predetermined value.

In step S706, the CPU 360 indicates to the image forming apparatus PR that the tray is full, and the process proceeds to step S707. In step S707, the CPU 360 clears the counter value, and ends the procedure.

As described above, the CPU 360 of the sheet finishing apparatus PD limits output of the sheet stacks to the lower tray 203, e.g., by the tray full operation, based on the angular movement or position of the pressure arm 501, as detected by the first and second sensors 505*a* and 505*b*.

For example, when the results of steps S605, S606, S610, S613, S615, S619, and S621 are YES, the CPU 360 prevents outputting of the sheet stacks to the lower tray 203, and when the results of these steps are NO, the process returns to step S601 to continue the sheet loading operation even though the sheet stacks have already been received on the lower tray 203. Thus, the user does not have to remove the sheet stacks when the tray 203 is able to receive more sheet stacks thereon.

Further, as previously described, the CPU 360 can precisely control output of the sheet stacks according to the output of the sensors, so that an optimal loading ability may be provided up to the maximum number of sheet stacks with respect to variety of sheets.

When the attributes including the number, size, and folding pattern of the previous job are entirely the same as that of the present job, the CPU 360 permits the sheet finishing apparatus PD to continue the outputting to the lower tray 203. When the attributes of the previous job are different from that of the present job, the CPU 360 can control the image forming apparatus PR to stop the image forming operation. Thus, the present invention is more convenient to the user than the known systems.

Further, when it is determined that the number, size, and folding pattern of sheet stacks of the primary job are the same as those of the subsequent job, the number of counts is based on the number of counts from the primary job so as to prevent the sheet finishing apparatus from causing a malfunction.

The above-described embodiments are illustrative, and numerous additional modifications and variations are possible in light of the above teachings. For example, elements and/or features of different illustrative and exemplary embodiments herein may be combined with each other and/or substituted for each other within the scope of this disclosure and appended claims. It is therefore to be understood that within the scope of the appended claims, the disclosure of this patent specification may be practiced otherwise than as specifically described herein.

The present application claims priority to Japanese patent application No. 2004-307045, filed in the Japan Patent Office on Oct. 21, 2004, and Japanese patent application No. 2005-010471, filed in the Japan Patent Office on Jan. 18, 2005, the disclosures of which are incorporated by reference herein in their entirety.

The invention claimed:

1. A sheet finishing apparatus, comprising:

a discharging member configured to discharge recording media;

a tray configured to receive the discharged recording media;

a rotatable moving member configured to contact the discharged recording media such that an angular position of the rotatable member changes in response to a number of the recording media on the tray;

a first detecting member configured to detect a movement of the moving member;

a controller configured to control an output of the recording media to the tray based on an output of the first detecting member; and a second detecting member configured to detect the movement of the moving member corresponding to removal of the tray from the sheet finishing apparatus.

2. The sheet finishing apparatus according to claim 1, further comprising:

a counter configured to count the recording media output to the tray, wherein the controller is configured to control the output of the recording media to the tray based on the count of the recording media output to the tray.

3. The sheet finishing apparatus according to claim 1, wherein the controller is configured to control the output of the recording media to the tray based on an output of the second detecting member.

4. A sheet finishing apparatus, comprising:

means for discharging recording media;

means for receiving the discharged recording media;

means for contacting the discharged recording media, an angular position of the means for contacting changing in response to a number of the recording media on the means for receiving;

first means for detecting movement of the means for contacting;

means for controlling an output of the recording media to the means for receiving based on an output of the first means for detecting;

second means for detecting the movement of the moving member, the second means for detecting sensing the movement of the moving member corresponding to removal of the means for receiving from the sheet finishing apparatus.

5. The sheet finishing apparatus according to claim 4, further comprising:

means for counting the recording media output to the means for receiving, wherein the means for controlling controls the output of the recording media to the means for receiving based on the count of the recording media output to the means for receiving.

6. The sheet finishing apparatus according to claim 4, wherein the means for controlling is configured to control the output of the recording media to the means for receiving based on an output of the second means for detecting.

7. A sheet finishing apparatus, comprising:

a discharging member configured to discharge recording media;

a tray configured to receive the discharged recording media;

a rotatable moving member configured to contact the discharged recording media such that an angular position of the rotatable member changes in response to a number of the recording media on the tray;

a detecting member configured to detect a movement of the moving member; and a controller configured to control an output of the recording media to the tray based on an output of the detecting member and a result of a comparison between first and second jobs of the sheet finishing apparatus.

8. The sheet finishing apparatus according to claim 7, further comprising:

a counter configured to count the recording media output to the tray, wherein the controller is configured to control the output of the recording media to the tray based on the count of the recording media output to the tray.

9. A sheet finishing apparatus, comprising:

means for discharging recording media;

means for receiving the discharged recording media;

means for contacting the discharged recording media, an angular position of the means for contacting changing in response to a number of the recording media on the means for receiving;

means for detecting movement of the means for contacting; and means for controlling an output of the recording media to the means for receiving based on an output of the means for detecting and a result of a comparison between first and second jobs of the sheet finishing apparatus.

10. The sheet finishing apparatus according to claim 9, further comprising:

means for counting the recording media output to the means for receiving, wherein the means for controlling controls the output of the recording media to the means for receiving based on the count of the recording media output to the means for receiving.

11. A sheet finishing apparatus, comprising:

a discharging member configured to discharge recording media;

a tray configured to receive the discharged recording media;

a rotatable moving member configured to contact the discharged recording media such that an angular position of the rotatable member changes in response to a number of the recording media on the tray;

a detecting member configured to detect a movement of the moving member; and a controller configured to control an output of the recording media to the tray based on an output of the detecting member, information on a first job of the sheet finishing apparatus, and information on a second job of the sheet finishing apparatus.

12. The sheet finishing apparatus according to claim 11, further comprising:

a counter configured to count the recording media output to the tray, wherein the controller is configured to control the output of the recording media to the tray based on the count of the recording media output to the tray.

13. A sheet finishing apparatus, comprising:

means for discharging recording media;

means for receiving the discharged recording media;

means for contacting the discharged recording media, an angular position of the means for contacting changing in response to a number of the recording media on the means for receiving;

means for detecting movement of the means for contacting; and means for controlling an output of the recording media to the means for receiving based on an output of the means for detecting, information on a first job of the sheet finishing apparatus, and information on a second job of the sheet finishing apparatus.

14. The sheet finishing apparatus according to claim 13, further comprising: means for counting the recording media output to the means for receiving, wherein the means for controlling controls the output of the recording media to the means for receiving based on the count of the recording media output to the means for receiving.

15. A sheet finishing apparatus for an image forming apparatus, comprising:

a tray configured to receive recording media thereon;

a moving member configured to contact the recording media on the tray such that a position of the member changes in response to a number of the recording media on the tray;

a first detector configured to detect a position of the moving member; and a second detector configured to detect the movement of the moving member corresponding to removal of the tray from the sheet finishing apparatus.

16. The sheet finishing apparatus according to claim 15, wherein the moving member is configured to at least one of move linearly and rotate.

17. The sheet finishing apparatus according to claim 16, wherein the moving member comprises a contacting surface configured to contact a surface of the recording media, the contacting surface configured to move in response to the number of the recording media on the tray.

18. The sheet finishing apparatus according to claim 17, wherein the moving member comprises first and second ends, the first end including the contacting surface, and the second end configured to be detected by the detector.

19. The sheet finishing apparatus according to claim 18, wherein the moving member is configured to rotate such that the detector detects the second end in a first position and does not detect the second end in a second position.

* * * * *